US009322170B2

(12) United States Patent
Tsai

(10) Patent No.: US 9,322,170 B2
(45) **Date of Patent: *Apr. 26, 2016**

(54) BRACING DEVICE

(71) Applicant: Chong-Shien Tsai, Taichung (TW)

(72) Inventor: Chong-Shien Tsai, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/610,642

(22) Filed: Jan. 30, 2015

(65) Prior Publication Data

US 2015/0225951 A1 Aug. 13, 2015

(30) Foreign Application Priority Data

Feb. 10, 2014 (TW) ..... 103104202 A

(51) Int. Cl.

| | |
|---|---|
| ***E04B 1/98*** | (2006.01) |
| ***E04H 9/02*** | (2006.01) |
| ***E04C 3/04*** | (2006.01) |
| ***E04C 3/00*** | (2006.01) |
| ***E04C 3/06*** | (2006.01) |
| ***E04C 3/02*** | (2006.01) |
| *E04H 9/06* | (2006.01) |

(52) U.S. Cl.

CPC ... *E04C 3/04* (2013.01); *E04C 3/00* (2013.01); *E04C 3/02* (2013.01); *E04C 3/06* (2013.01); *E04B 1/98* (2013.01); *E04B 1/985* (2013.01); *E04C 2003/026* (2013.01); *E04C 2003/0413* (2013.01); *E04H 9/02* (2013.01); *E04H 9/06* (2013.01)

(58) Field of Classification Search

CPC ..... E04C 3/00; E04C 3/02; E04C 2003/0413; E04B 1/985; E04B 1/98; E04H 9/02; E04H 9/06

USPC ..... 52/848, 836, 167.1, 167.3, 426, 416, 52/417, 167.4, 167.8; 188/105, 378, 379

See application file for complete search history.

(56) References Cited

U.S. PATENT DOCUMENTS

| | | | | |
|---|---|---|---|---|
| 5,473,850 | A * | 12/1995 | Balding | E04B 2/8629 52/426 |
| 7,305,799 | B2 * | 12/2007 | Smelser | E04C 3/02 52/167.1 |
| 7,373,758 | B2 * | 5/2008 | Tsai | E04H 9/02 52/167.1 |
| 8,807,307 | B2 * | 8/2014 | Choi | E04H 9/02 188/105 |
| 8,881,491 | B2 * | 11/2014 | Christopoulos | E04H 9/022 52/167.1 |
| 2003/0222188 | A1 * | 12/2003 | Smelser | E04C 3/02 248/188.91 |

(Continued)

FOREIGN PATENT DOCUMENTS

| | | |
|---|---|---|
| TW | M321445 | 11/2007 |
| TW | M345092 | 11/2008 |

(Continued)

*Primary Examiner* — Chi Q Nguyen

(74) *Attorney, Agent, or Firm* — patenttm.us

(57) ABSTRACT

A bracing device has a supporting module and a restraining element mounted around the supporting module to provide a restraining-supporting effect to the supporting module. The supporting module has at least one supporting element. The at least one supporting element is elongated and has an axial segment and two connecting heads. The axial segment has at least one concave edge and at least one loading section. The connecting heads are respectively formed on two connecting ends of the axial segment. The restraining element has at least one viewing hole aligning along the at least one loading section of the axial segment to enable a user to see the at least one supporting element of the bracing device via the at least one viewing hole without dismantling the restraining element.

36 Claims, 76 Drawing Sheets

(56) References Cited

U.S. PATENT DOCUMENTS

2004/0107654 A1* 6/2004 Powell ..... E04H 9/02 52/167.3
2005/0005539 A1* 1/2005 Nakamura ..... F16F 7/00 52/167.3
2015/0135611 A1* 5/2015 Beard ..... E04B 1/24 52/167.3

FOREIGN PATENT DOCUMENTS

TW M345836 12/2008
TW M389142 9/2010

* cited by examiner

BRACING DEVICE

BACKGROUND OF THE INVENTION

1. Field of the Invention

The present invention relates to a strengthening support device for buildings and civil engineering structures, and more particularly to a bracing device that has at least one viewing hole to enable an inspector to see an interior structure of the bracing device conveniently to ensure the structural safety of a building or a civil engineering structure.

2. Description of Related Art

To strengthen the structural toughness and the supporting strength of a large building and civil engineering structure, conventional bracing devices are used between the beams and the pillars of the building to provide a proper axial resilience, to strengthen the structure and to eliminate the vibration energy and other performance. The applicant had previously proposed a bracing device for a structure such as the Taiwan Patent Numbers: M321445, M345092, M345836 and M389142. In the above-mentioned patents, the bracing device has a supporting element and a restraining element. The restraining element is mounted around the supporting element to provide a supporting and restraining effect to the supporting element, and this can prevent the supporting element from buckling under pressure.

The applicant has previously proposed various types of bracing device that can meet the different supporting needs of buildings. When the buildings are deformed by an earthquake or a strong wind, the conventional bracing devices can be used to against the lateral forces that are produced by the earthquake or the strong wind to reduce the shaking conditions of buildings. However, after the earthquake or the strong wind, an inspector cannot inspect the damage of the supporting element due to the restraining element is fully mounted around the supporting element. Then, the inspector needs to dismantle the restraining element from the supporting element during an inspecting process of the structural safety of the building. Particularly, the cost of re-constructing the restraining element is high, the re-construction of the restraining element is difficult and this will become a major limit when inspecting the structural safety of the building. Consequently, the inspector only can skip the inspection of the supporting element of the conventional bracing device and this will generate hidden worries of the structural safety of the building.

To overcome the shortcomings, the present invention tends to provide a bracing device to mitigate or obviate the aforementioned problems.

SUMMARY OF THE INVENTION

The main objective of the invention is to provide a bracing device that has at least one viewing hole to enable an inspector to see an interior structure of the bracing device conveniently to ensure the structural safety of a building or a civil engineering structure.

The bracing device in accordance with the present invention has a supporting module and a restraining element mounted around the supporting module to provide a restraining-supporting effect to the supporting module. The supporting module has at least one supporting element. The at least one supporting element is elongated and has an axial segment and two connecting heads. The axial segment has at least one concave edge and at least one loading section. The connecting heads are respectively formed on two connecting ends of the axial segment. The restraining element has at least one viewing hole aligning along the at least one concave edge of the axial segment to enable a user to see the at least one supporting element of the bracing device via the at least one viewing hole without dismantling the restraining element.

Other objects, advantages and novel features of the invention will become more apparent from the following detailed description when taken in conjunction with the accompanying drawings.

DETAILED DESCRIPTION OF PREFERRED EMBODIMENT

Figure 1:
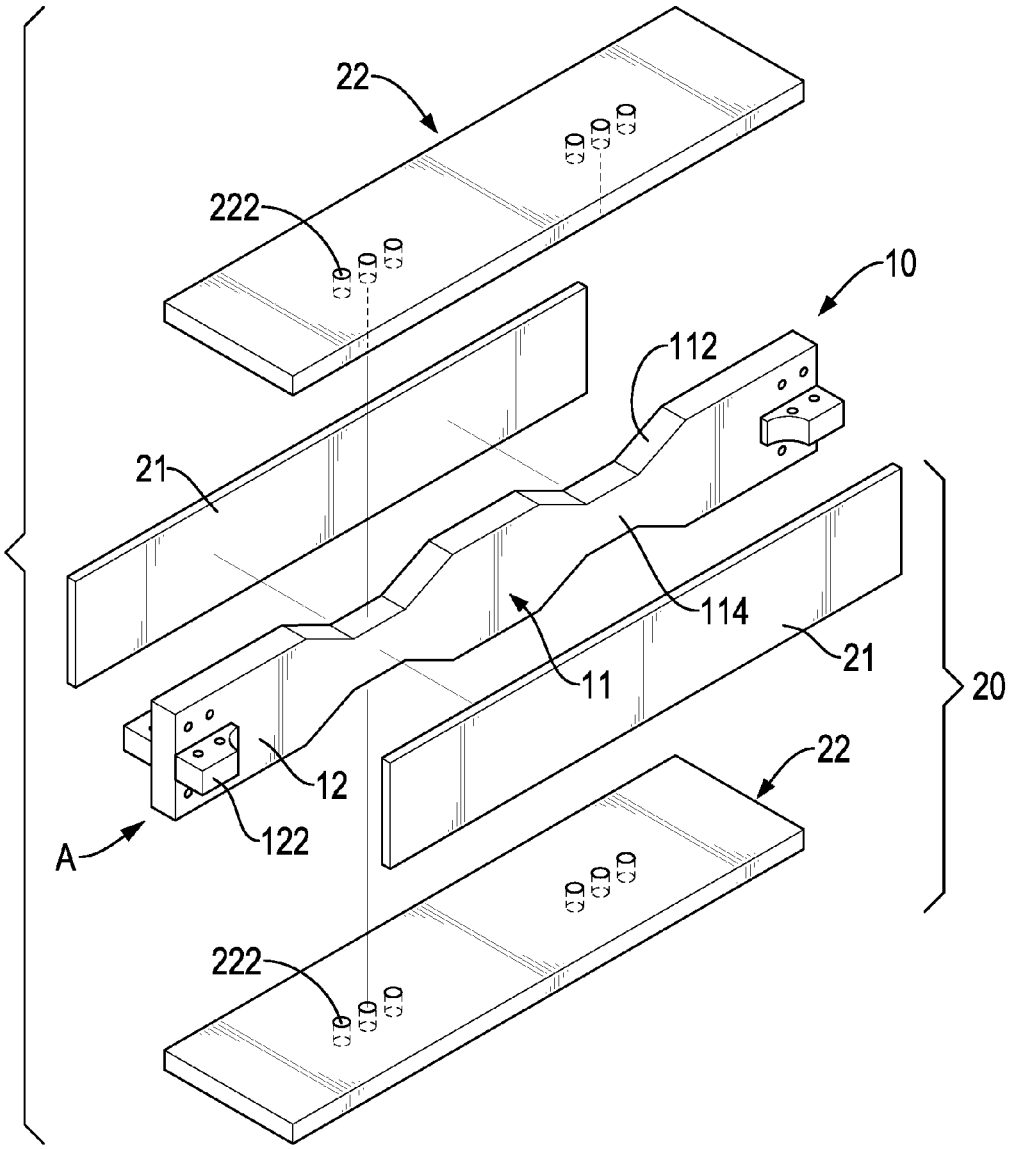
FIG. 1 is an exploded perspective view of a first embodiment of a bracing device in accordance with the present invention.

A bracing device in accordance with the present invention can be applied to a building, a bridge or an instrument between pillars and beams of such structures, and comprises a supporting module A and a restraining element 20 mounted around the supporting module A to provide a restraining-supporting effect to the supporting module A. The supporting module A has at least one supporting element 10. The at least one supporting element 10 is elongated and has an axial segment 11 and two connecting heads 12.

The axial segment 11 is elongated-plate-shaped and has a first side, a second side, two sidewalls, two connecting ends, at least one concave edge 112 and at least one loading section 114. The at least one concave edge 112 is nonlinear and is formed in the first side or the second side of the axial segment 11 to form the first side or the second side of the axial segment 11 as an nonlinear side. The at least one loading section 114 is formed on the axial segment 11 at a position corresponding to the at least one concave edge 112 between the connecting ends of the axial segment 11. The connecting heads 12 are respectively formed on the connecting ends of the axial segment 11.

The restraining element 20 has at least one viewing hole 212, 222, 232 with different shape, aligning along the at least one concave edge 112 of the axial segment 11 to enable a user to see the supporting element 10 of the bracing device via the at least one viewing hole 212, 222, 232 without dismantling the restraining element 20.

The bracing device in accordance with the present invention has several embodiments and will be described as follows.

With reference to FIG. 1, in a first embodiment of a bracing device in accordance with the present invention, the axial segment 11 has at least one concave edge 112 formed in the first side of the axial segment 11 and at least one concave edge 112 formed in the second side of the axial segment 11. Preferably, the axial segment 11 has four concave edges 112, two of the concave edges 112 are formed in the first side and the other two of the concave edges 112 are formed in the second side of the axial segment 11. The axial segment 11 has two loading sections 114 formed on the axial segment 11 between the four concave edges 112.

Each one of the connecting heads 12 has an inner sidewall, an outer sidewall, two connecting blocks 122 and multiple connecting holes. The connecting blocks 122 are respectively formed on and protrude from the sidewalls of the connecting head 12 to enable the connecting head 12 to be a cross shape. The connecting holes are formed through the sidewalls and the connecting blocks 122 of the connecting head 12. Then, the supporting element 10 can be connected to a pillar or a beam of a building by fasteners such as bolts or rivets mounting through the connecting holes of the connecting heads 12 to connect the supporting element 10 with the pillar or the beam of the building. In addition, the supporting element 10 also can be connected to the pillar or the beam of the building by welding.

The restraining element 20 is mounted around the axial segment 11 of the supporting element 10 and has two side boards 21 and two restraining boards 22. Each side board 21 has a first side and a second side. The side boards 21 respectively abut on the sidewalls of the axial segment 11 between the connecting blocks 122 of the connecting heads 12. The restraining boards 22 are respectively and securely mounted on the first sides and the second sides of the side boards 21 by welding or fastening in a strong axis direction of the axial segment 11. The strong axis direction is a direction which aligns along a direction of the concave edges 112 that are formed in the axial segment 11. Each one of the restraining boards 22 has at least two viewing holes 222 formed through the restraining board 22 and respectively align along the loading sections 114 of the supporting element 10. Preferably, the restraining boards 22 are elongated boards with sufficient widths and this can provide an auxiliary supporting effect to the bracing device at the strong axis of the supporting element 10 by the restraining boards 22. Furthermore, each one of the restraining boards 22 has six viewing holes 222 formed through the restraining board 22 at intervals, and three of the viewing holes 222 align along one of the loading sections 114 of the supporting element 10 and the other three viewing holes 222 align along the other loading section 114 of the supporting element 10. Then, a user can easily see the loading sections 114 of the supporting element 10 via the viewing holes 222 of the restraining boards 22 of the restraining element 20.

Figure 2:
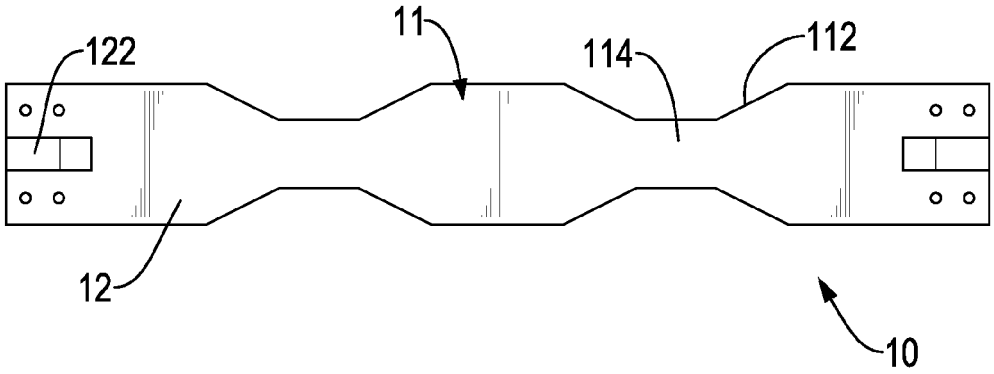
FIG. 2 is a side view of a first embodiment of a supporting element of the bracing device in FIG. 1.

In addition, the supporting element 10 of the bracing device in accordance with the present invention has two embodiments. With reference to FIG. 2, in a first embodiment of the supporting element 10, the axial segment 11 has four concave edges 112. Two of the concave edges 112 are formed in the first side of the axial segment 11 at an interval and the other two concave edges 112 are formed in the second side of the axial segment 11 at an interval to form two loading sections 114 on the axial segment 11 with the concave edges 112 that are formed in the first side of the axial segment 11. The connecting heads 12 are cross shaped and are respectively formed on the connecting ends of the axial segment 11.

Figure 3:
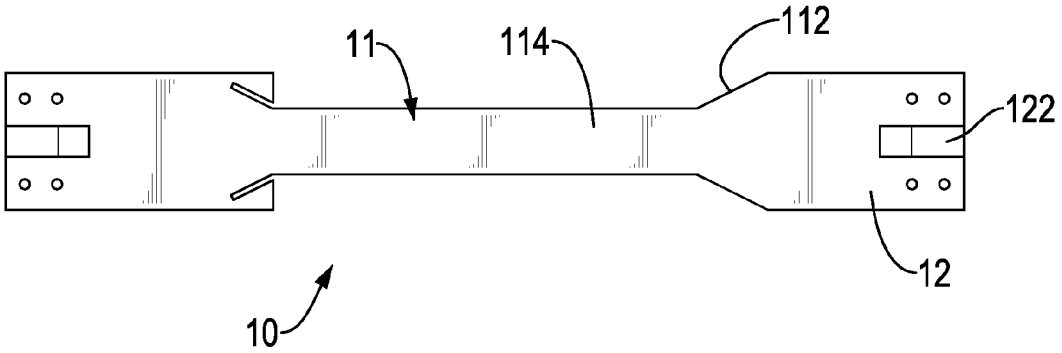
FIG. 3 is a side view of a second embodiment of a supporting element of the bracing device in FIG. 1.

With reference to FIG. 3, in a second embodiment of the supporting element 10, the axial segment 11 has two concave edges 112, one of the concave edges 112 is formed in the first side of the axial segment 11 and the other one concave edge 112 is formed in the second side of the axial segment 11 to form a loading section 114 on the axial segment 11 between the two concave edges 112. The connecting heads 12 are cross shaped and are respectively formed on the connecting ends of the axial segment 11.

Figure 4:
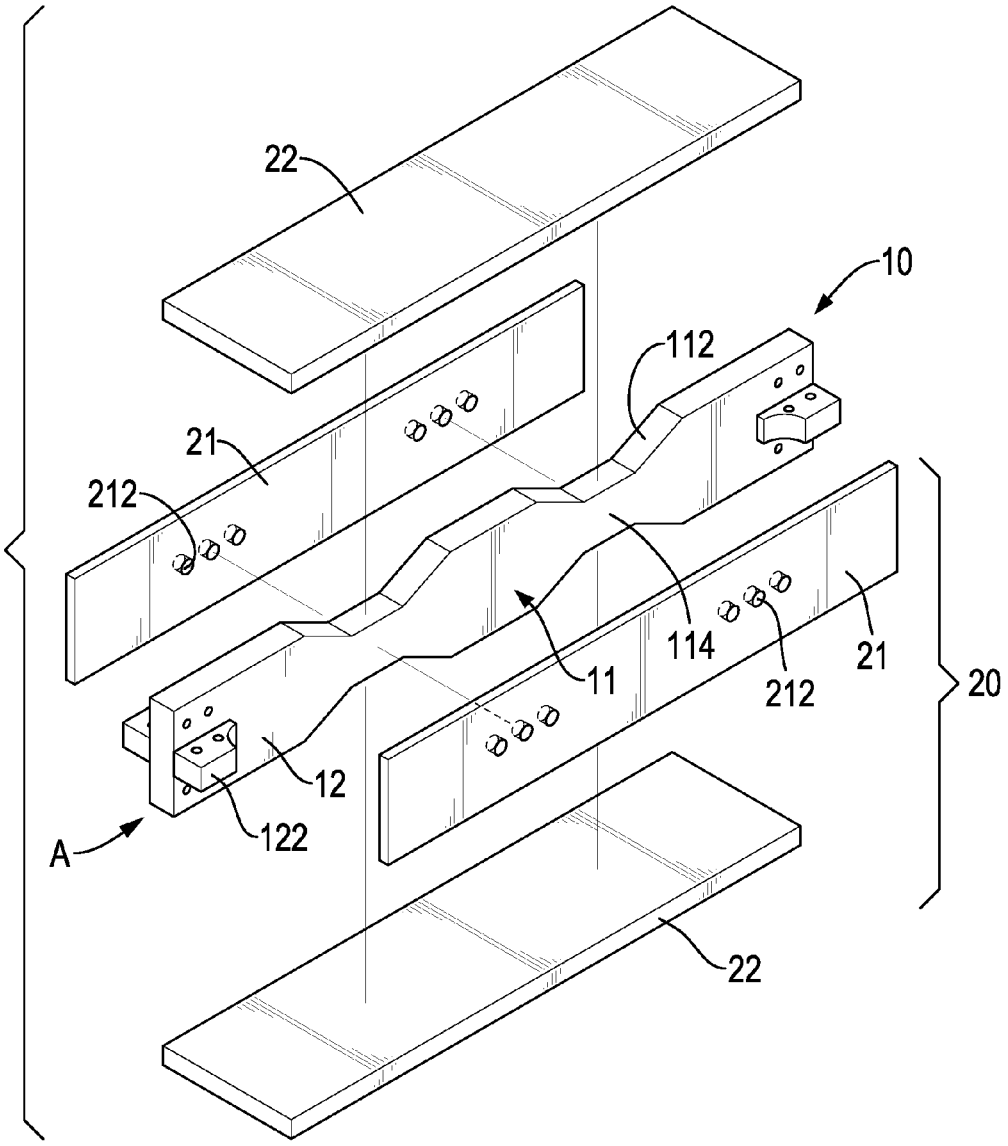
FIG. 4 is an exploded perspective view of a second embodiment of a bracing device in accordance with the present invention.

With reference to FIG. 4, a second embodiment of a bracing device in accordance with the present invention is substantially the same as the first embodiment except the following features. Each one of the side boards 21 has six viewing holes 212 formed through the side board 21 at intervals, and three of the viewing holes 212 align along one of the loading sections 114 of the supporting element 10 and the other three viewing holes 212 align along the other loading section 114 of the supporting element 10. Then, the user can easily see the loading sections 114 of the supporting element 10 via the viewing holes 212 of the side boards 21 of the restraining element 20. In addition, the restraining boards 22 do not have the viewing holes 222.

Figure 5:
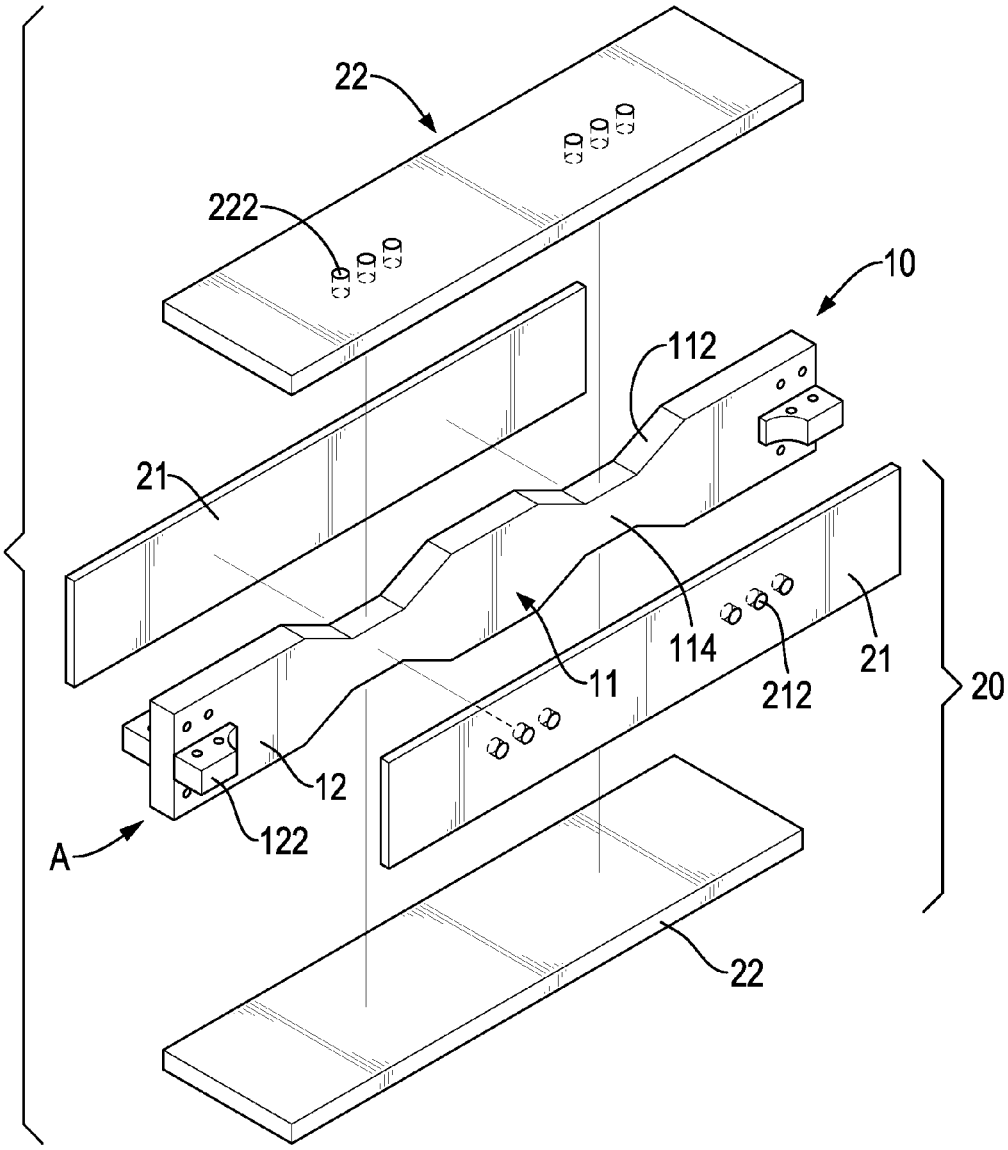
FIG. 5 is an exploded perspective view of a third embodiment of a bracing device in accordance with the present invention.

With reference to FIG. 5, a third embodiment of a bracing device in accordance with the present invention is substantially the same as the first embodiment in FIG. 1 except the following features. One of the side boards 21 has six viewing holes 212 formed through the side board 21 at intervals, and three of the viewing holes 212 align along one of the loading sections 114 of the supporting element 10 and the other three viewing holes 212 align along the other loading section 114 of the supporting element 10. In addition, one of the restraining boards 22 has six viewing holes 222 formed through the restraining board 22 at intervals, and three of the viewing holes 222 align along one of the loading sections 114 of the supporting element 10 and the other three viewing holes 222 align along the other loading section 114 of the supporting element 10. Then, the user can easily see the loading sections 114 of the supporting element 10 via the viewing holes 212 of the corresponding side boards 21 or the viewing holes 222 of the corresponding restraining board 22 of the restraining element 20.

Figure 6:
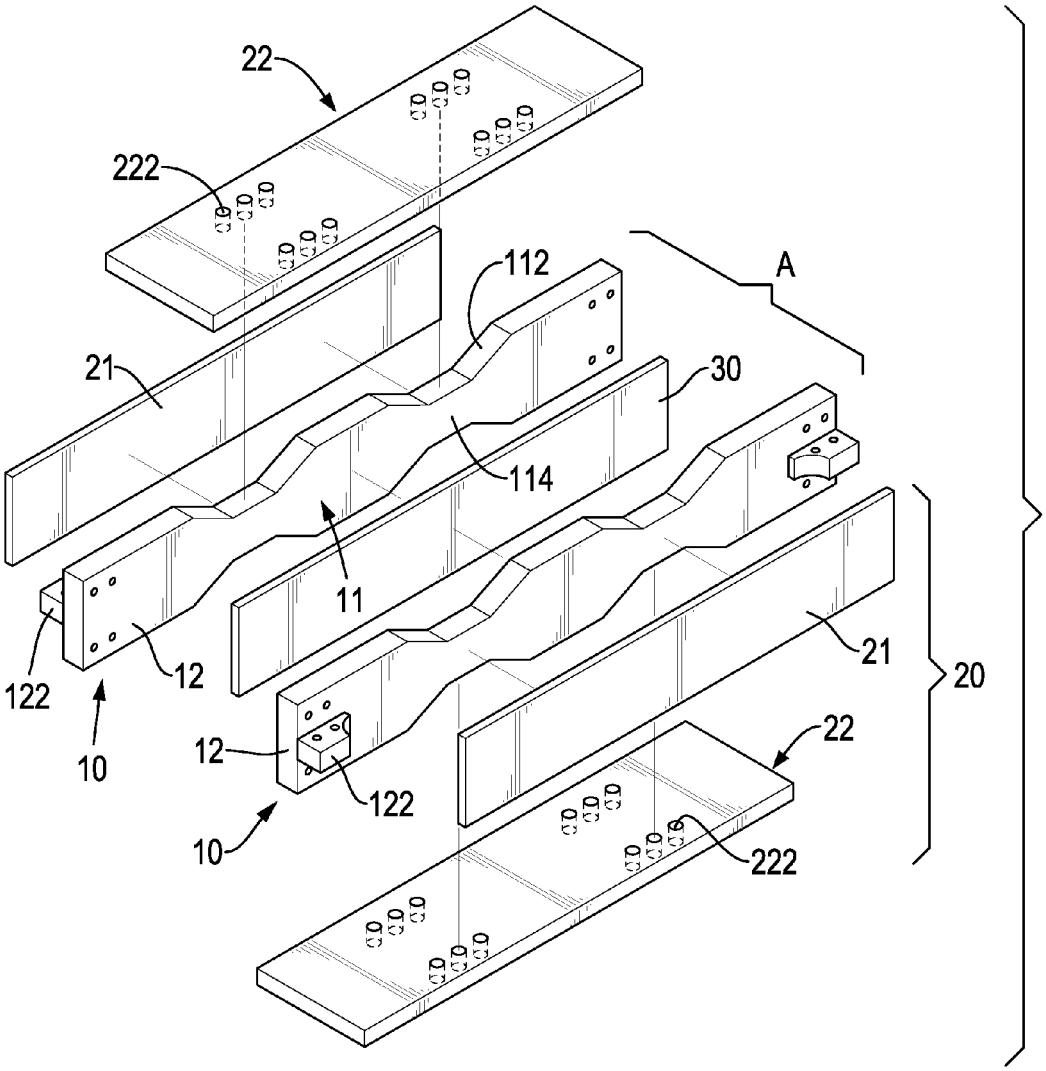
FIG. 6 is an exploded perspective view of a fourth embodiment of a bracing device in accordance with the present invention.

With reference to FIG. 6, a fourth embodiment of a bracing device in accordance with the present invention is substantially the same as the first embodiment except the following features. The supporting module A has a connecting board 30 and two supporting elements 10. The connecting board 30 is elongated-plate-shaped and has two sidewalls. Preferably, the connecting board 30 may be composed of two plates. The supporting elements 10 respectively abut on the sidewalls of the connecting board 30, and each supporting element 10 has an axial segment 11 and two connecting heads 12.

The axial segments 11 abut on the connecting board 30, and each one of the axial segments 11 has a first side, a second side, an inner sidewall, an outer sidewall, two connecting ends, four concave edges 112 and two loading sections 114. The concave edges 112 are nonlinear and are formed in the first side and the second side of the axial segment 11. The loading sections 114 are formed on the axial segment 11 at a position corresponding to the concave edges 112.

The connecting heads 12 may be T-shaped, are respectively formed on the connecting ends of the axial segment 11 and face the sidewalls of the connecting board 30. Each one of the connecting heads 12 has an inner sidewall, an outer sidewall, a connecting block 122 and multiple connecting holes. The inner sidewalls of the connecting heads 12 of the supporting elements 10 face the sidewalls of the connecting board 30. The connecting block 122 is formed on and protrudes from the outer sidewall of the connecting head 12.

The restraining element 20 has two side boards 21 and two restraining boards 22. The side boards 21 respectively abut on the outer sidewalls of the axial segments 11 between the connecting blocks 122 of the connecting heads 12. Each side board 21 has a first side and a second side. The restraining boards 22 are respectively and securely mounted on the first sides and the second sides of the side boards 21. Each one of the restraining boards 22 has at least four viewing holes 222 formed through the restraining board 22. Two of the at least four viewing holes 222 respectively align along the two loading sections 114 of one of the supporting elements 10 and the other two viewing holes 222 respectively align along the two loading sections 114 of the other one supporting element 10.

Figure 7:
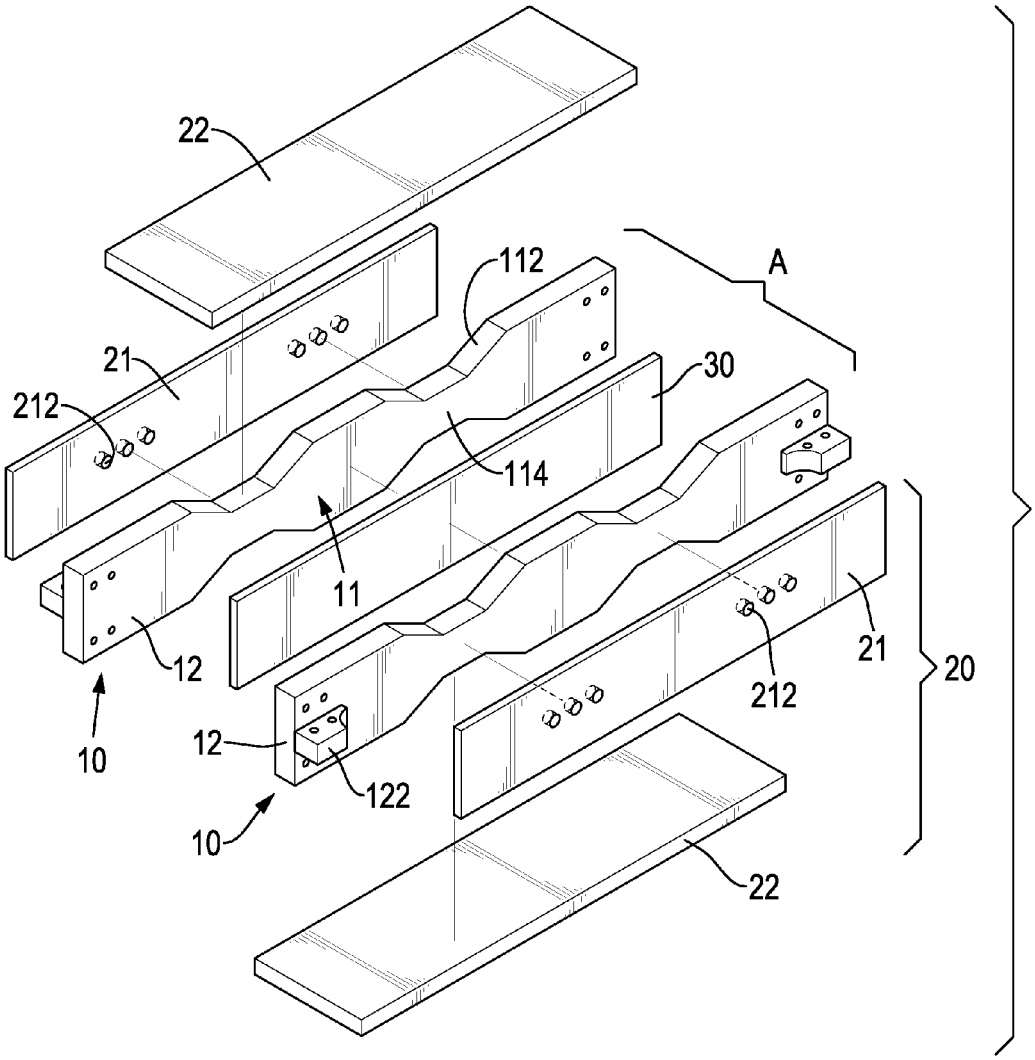
FIG. 7 is an exploded perspective view of a fifth embodiment of a bracing device in accordance with the present invention.

With reference to FIG. 7, a fifth embodiment of a bracing device in accordance with the present invention is substantially the same as the fourth embodiment in FIG. 6 except the following features. Each one of the side boards 21 has six viewing holes 212 formed through the side board 21 at intervals, and three of the viewing holes 212 align along one of the loading sections 114 of the supporting element 10 and the other three viewing holes 212 align along the other loading section 114 of the supporting element 10. Then, the user can easily see the loading sections 114 of the supporting element 10 via the viewing holes 212 of the side boards 21 of the restraining element 20. In addition, the restraining boards 22 do not have the viewing holes 222.

Figure 8:
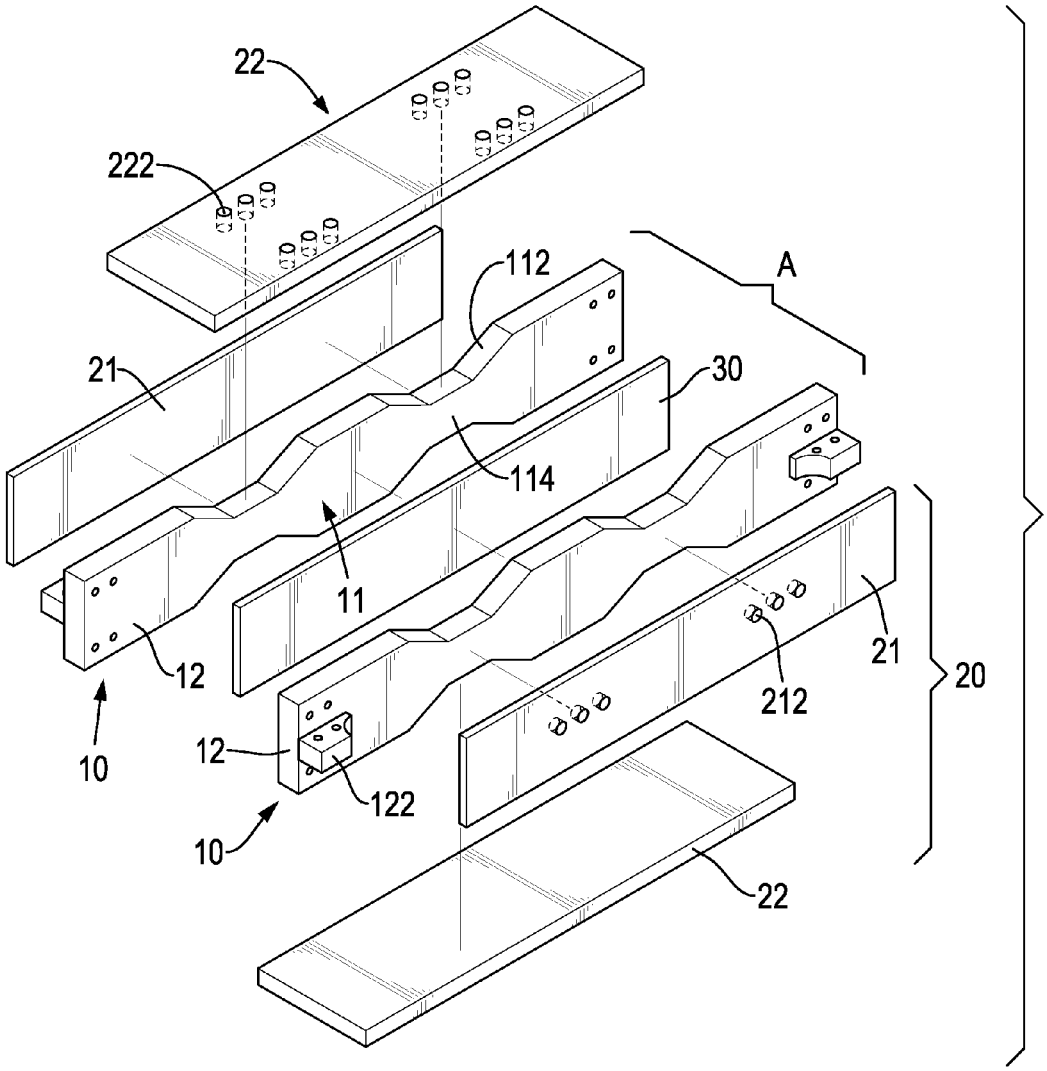
FIG. 8 is an exploded perspective view of a sixth embodiment of a bracing device in accordance with the present invention.
Figure 9:
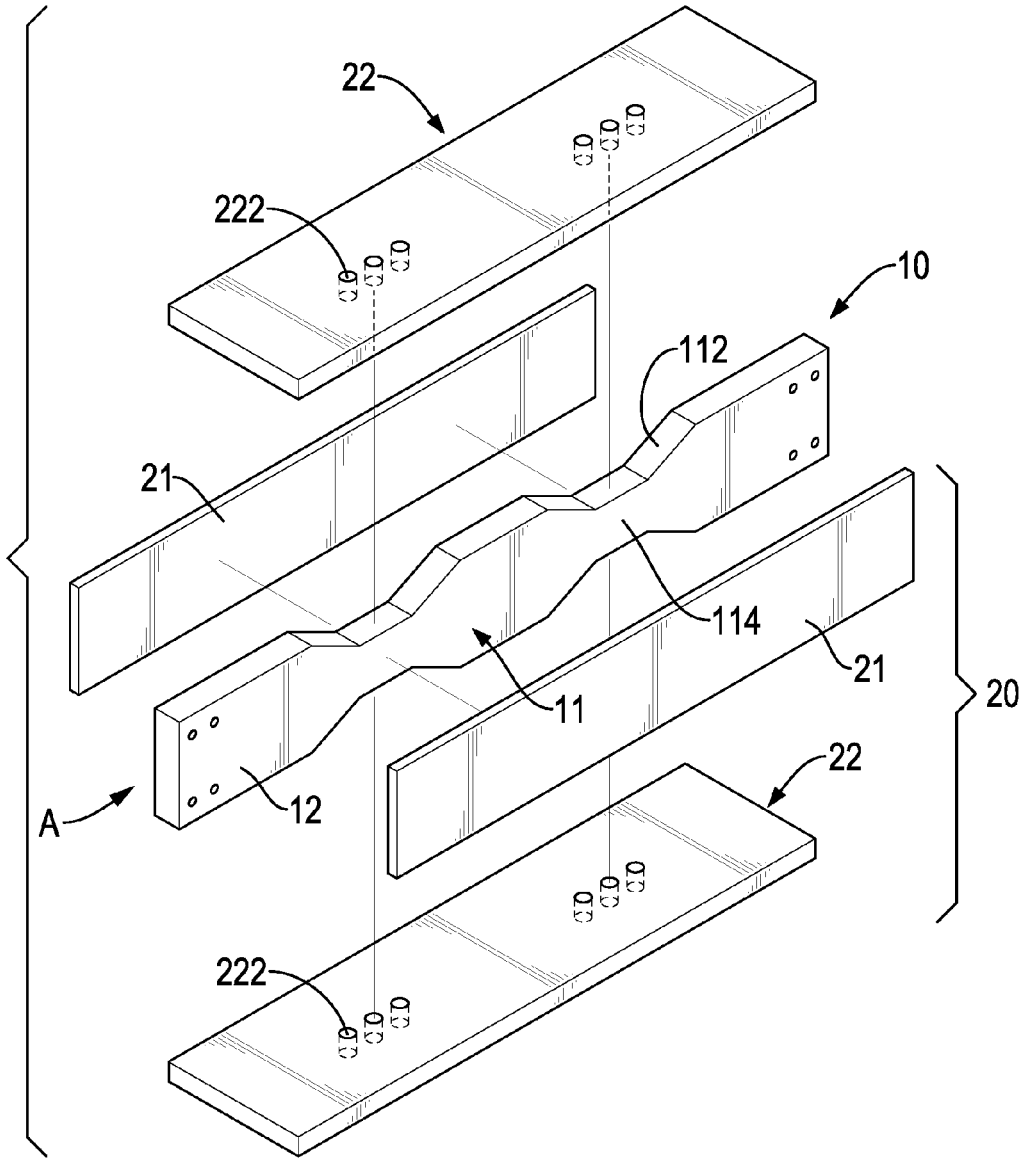
FIG. 9 is an exploded perspective view of a seventh embodiment of a bracing device in accordance with the present invention.
Figure 10:
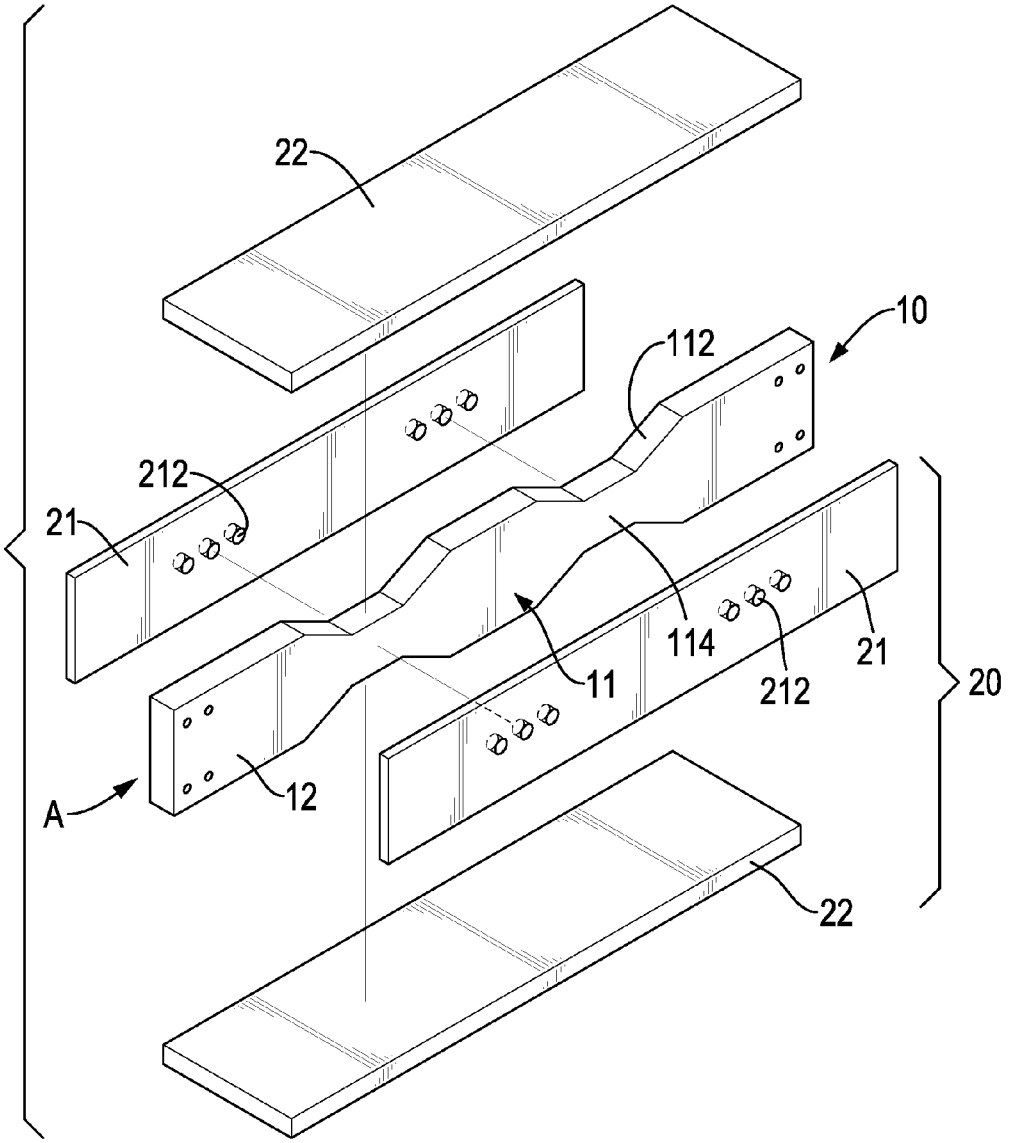
FIG. 10 is an exploded perspective view of an eighth embodiment of a bracing device in accordance with the present invention.
Figure 11:
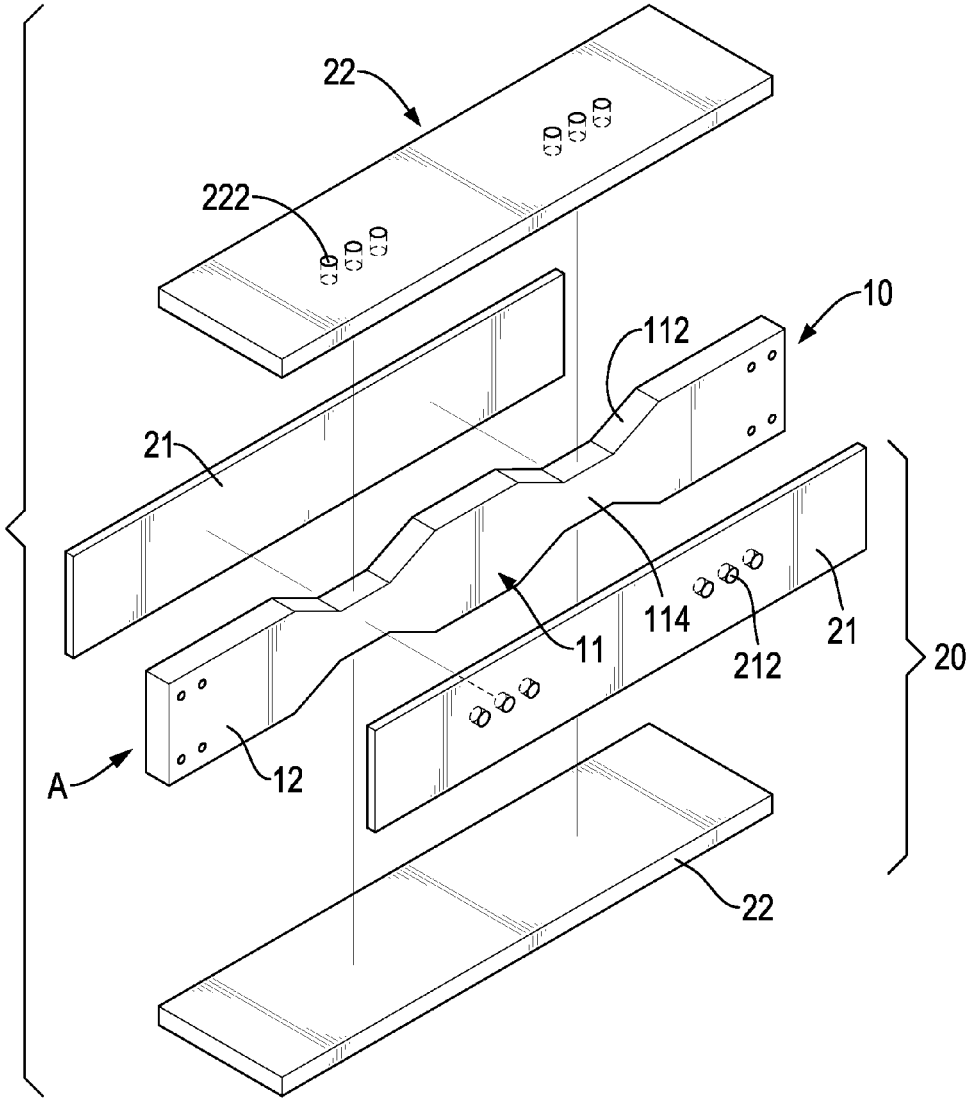
FIG. 11 is an exploded perspective view of a ninth embodiment of a bracing device in accordance with the present invention.
Figure 12:
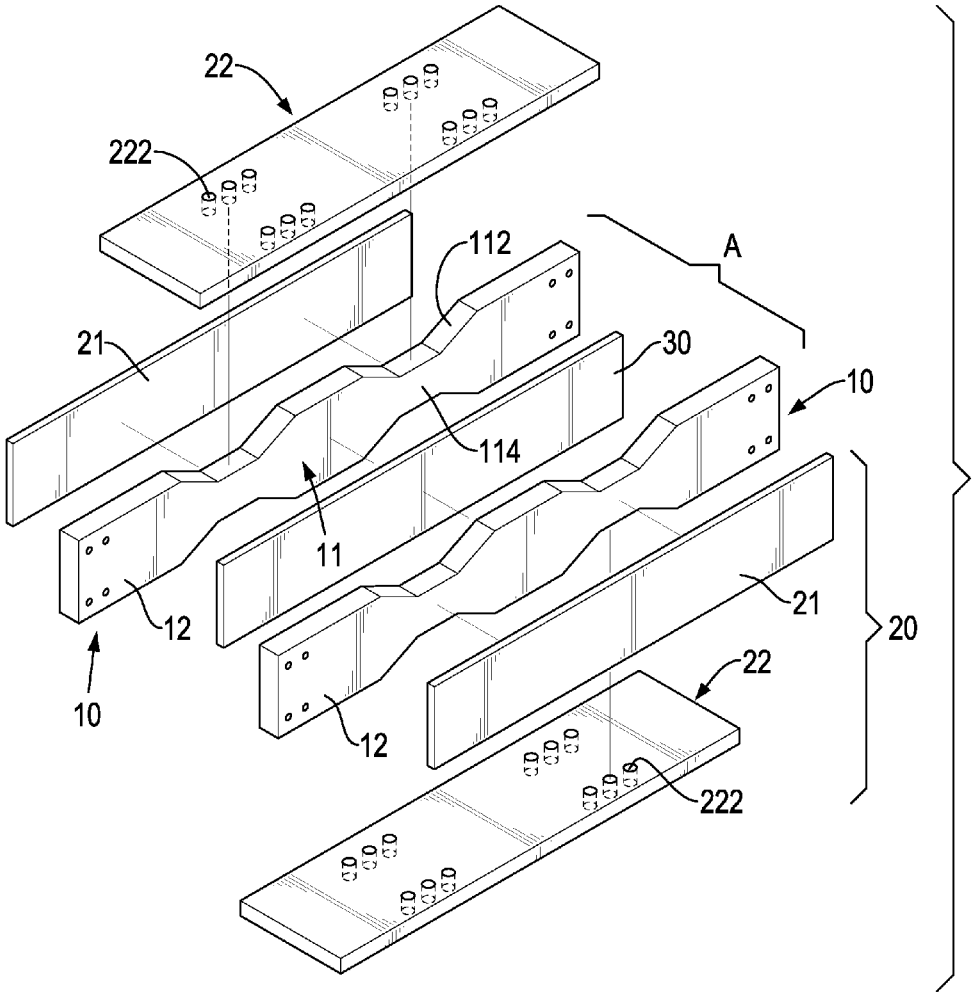
FIG. 12 is an exploded perspective view of a tenth embodiment of a bracing device in accordance with the present invention.
Figure 13:
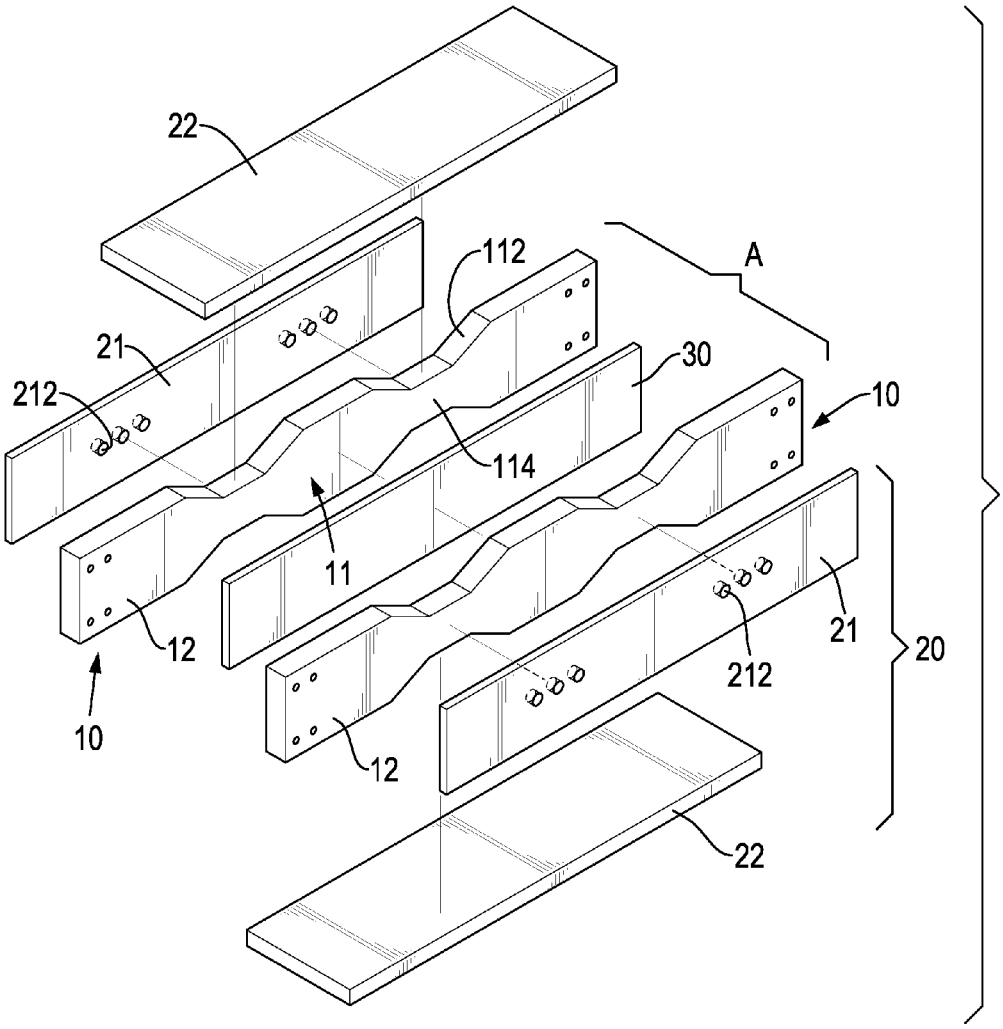
FIG. 13 is an exploded perspective view of an eleventh embodiment of a bracing device in accordance with the present invention.
Figure 14:
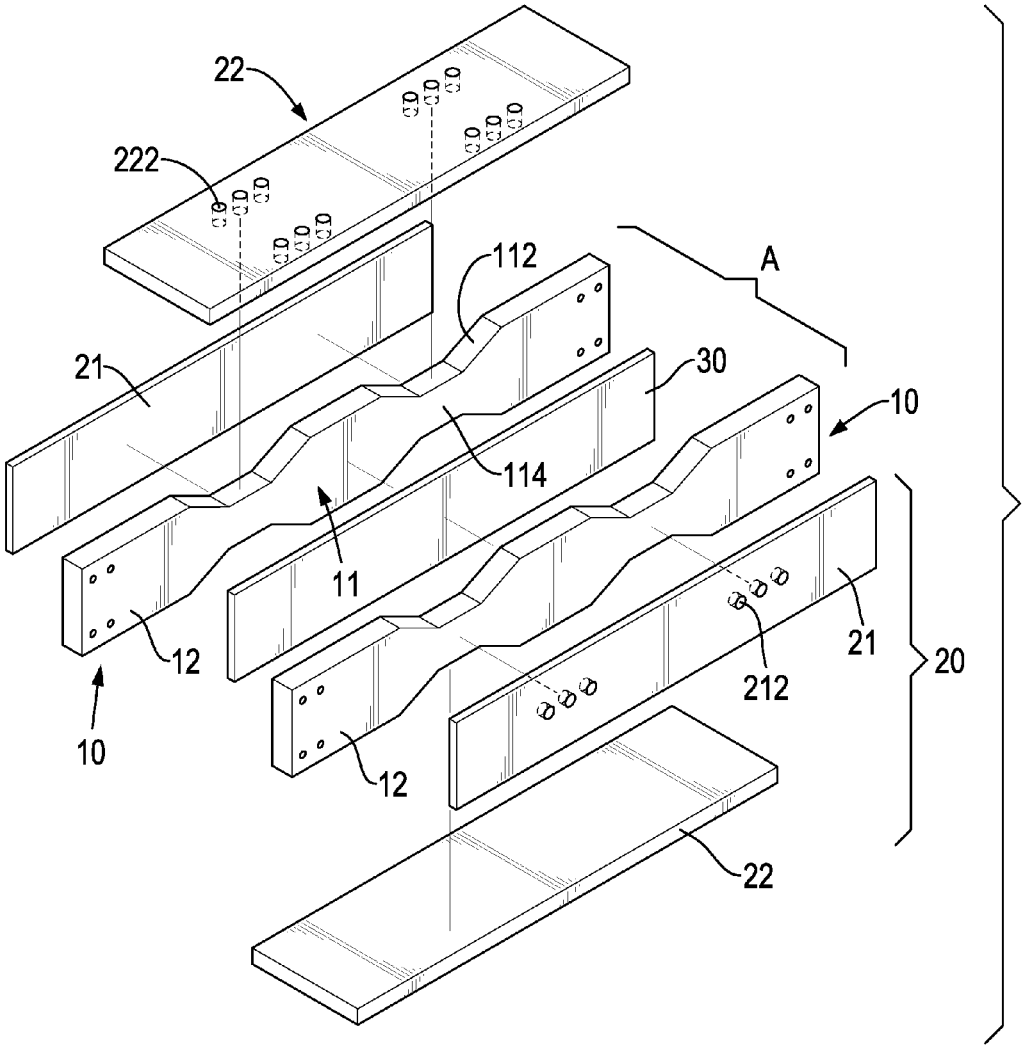
FIG. 14 is an exploded perspective view of a twelfth embodiment of a bracing device in accordance with the present invention.
Figure 15:
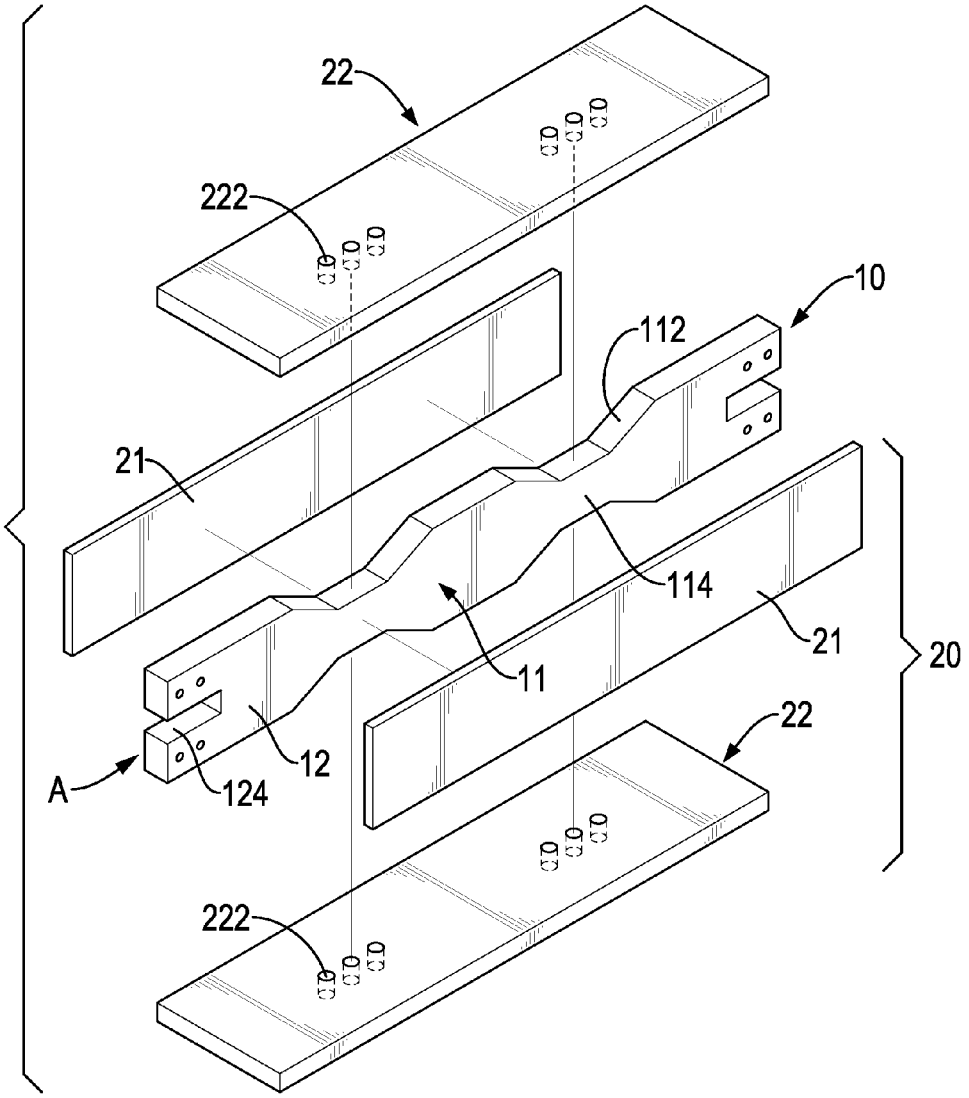
FIG. 15 is an exploded perspective view of a thirteenth embodiment of a bracing device in accordance with the present invention.
Figure 16:
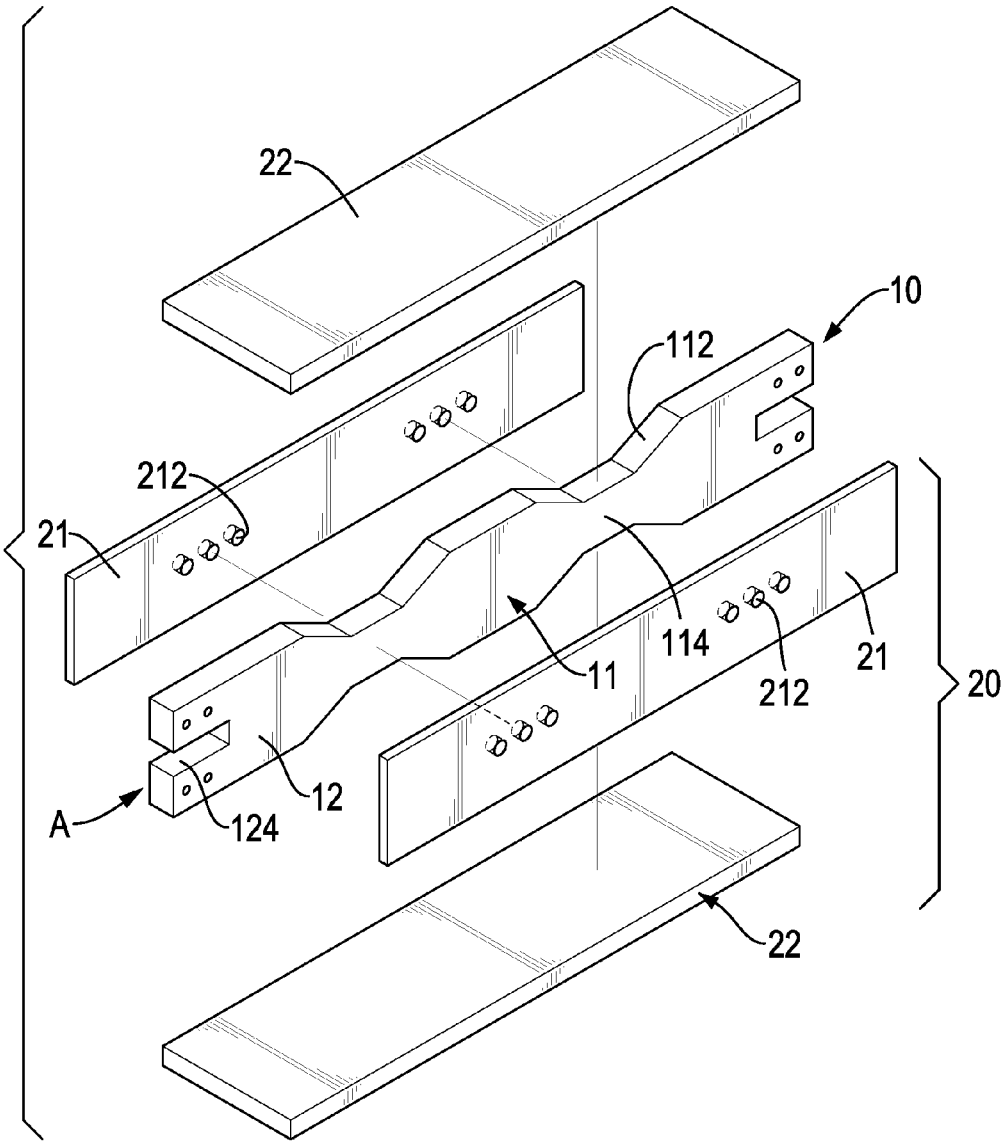
FIG. 16 is an exploded perspective view of a fourteenth embodiment of a bracing device in accordance with the present invention.
Figure 17:
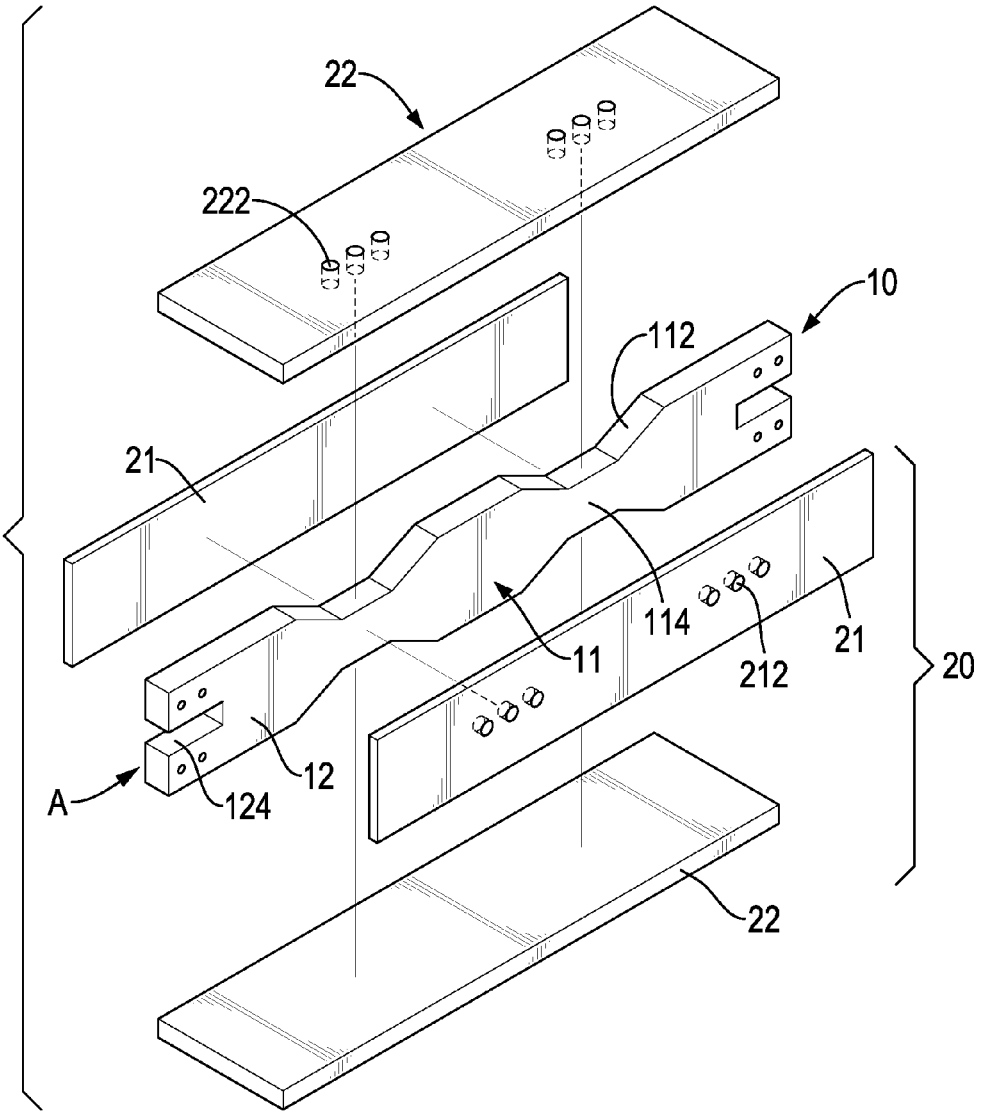
FIG. 17 is an exploded perspective view of a fifteenth embodiment of a bracing device in accordance with the present invention.
Figure 18:
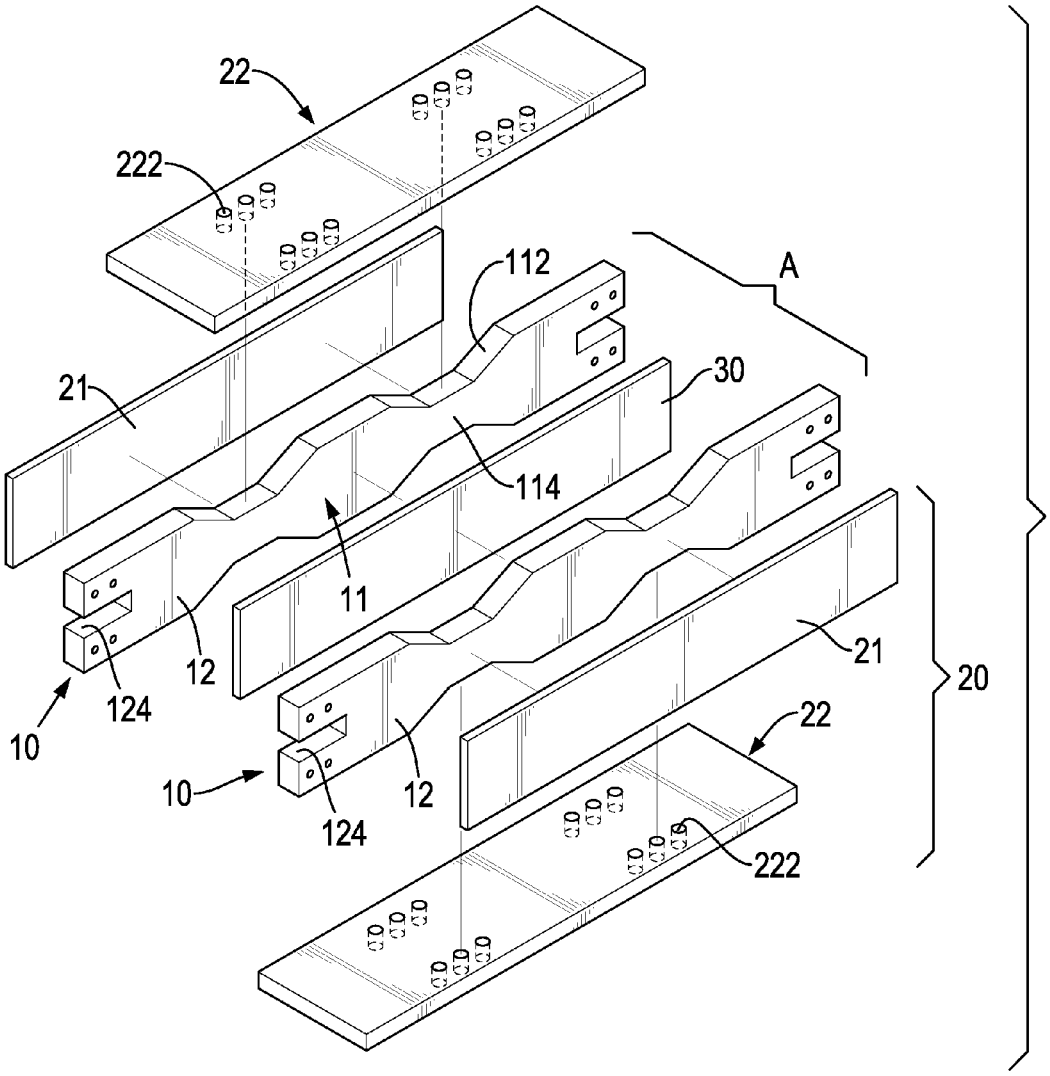
FIG. 18 is an exploded perspective view of a sixteenth embodiment of a bracing device in accordance with the present invention.
Figure 19:
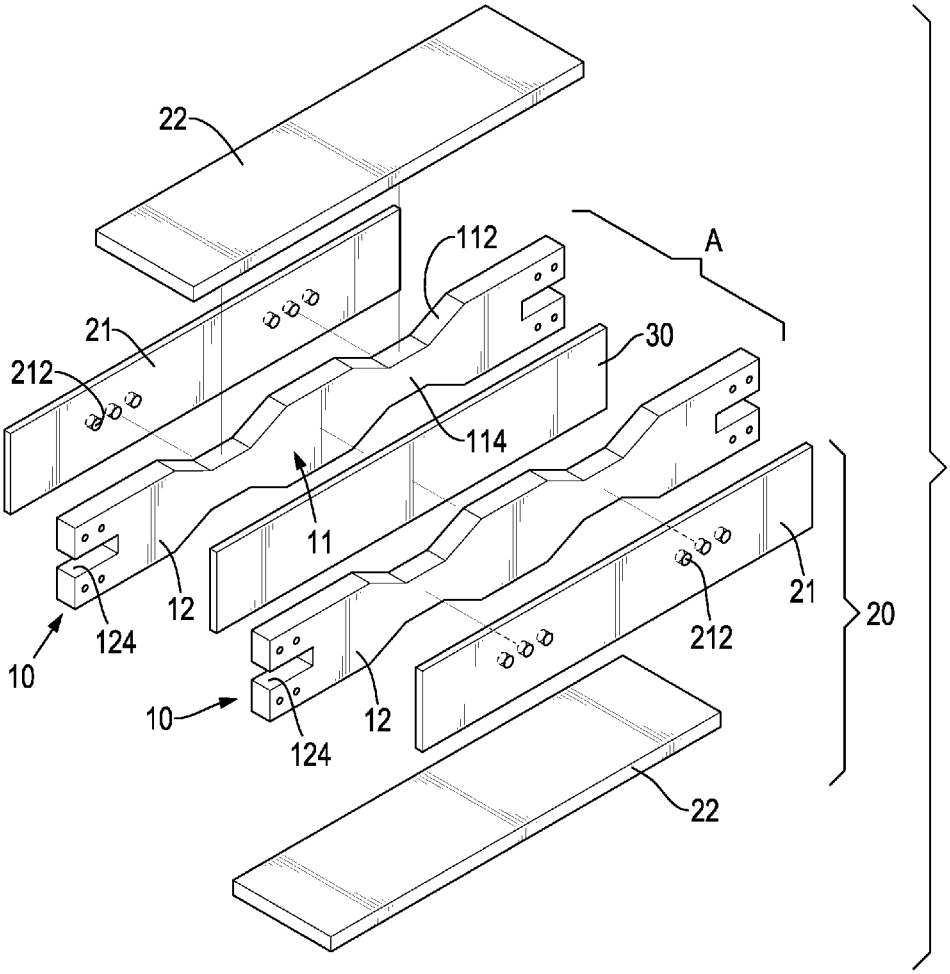
FIG. 19 is an exploded perspective view of a seventeenth embodiment of a bracing device in accordance with the present invention.
Figure 20:
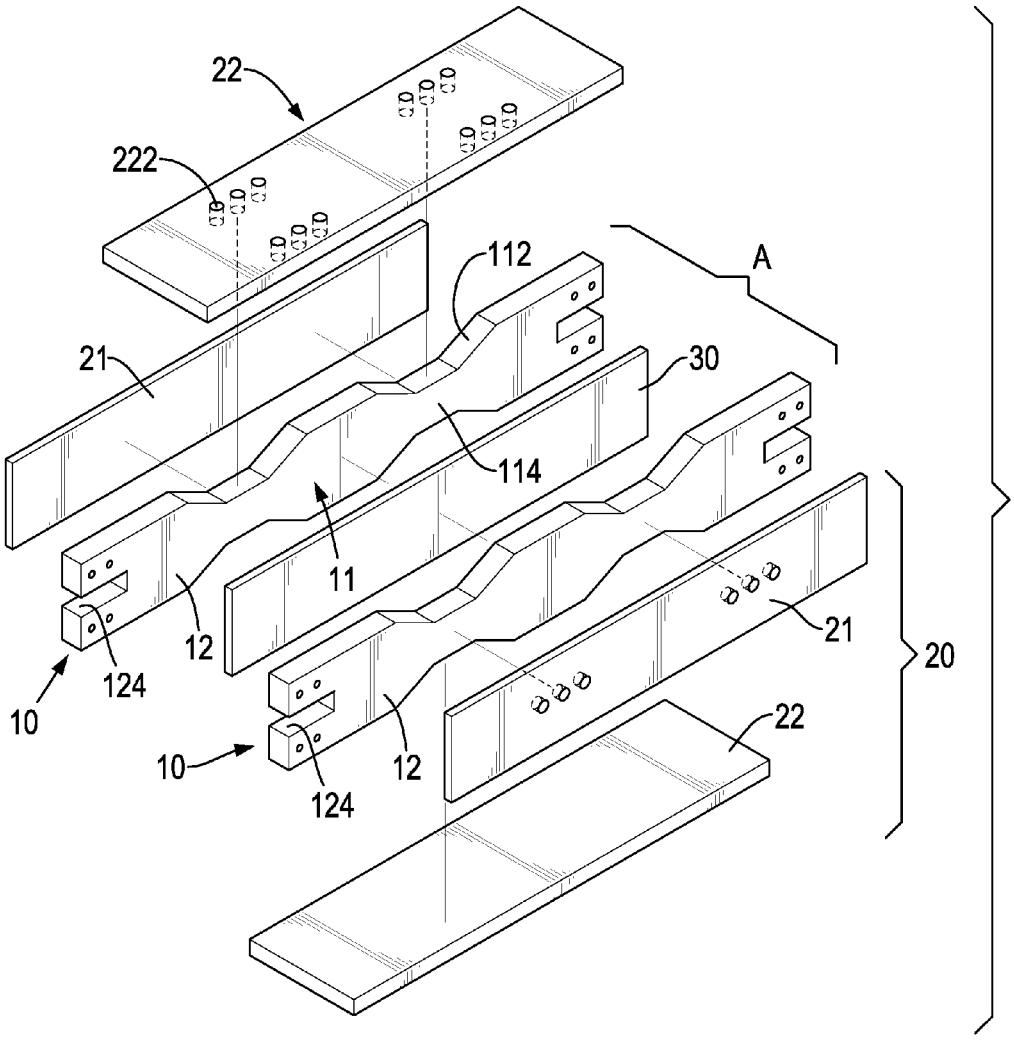
FIG. 20 is an exploded perspective view of an eighteenth embodiment of a bracing device in accordance with the present invention.
Figure 21:
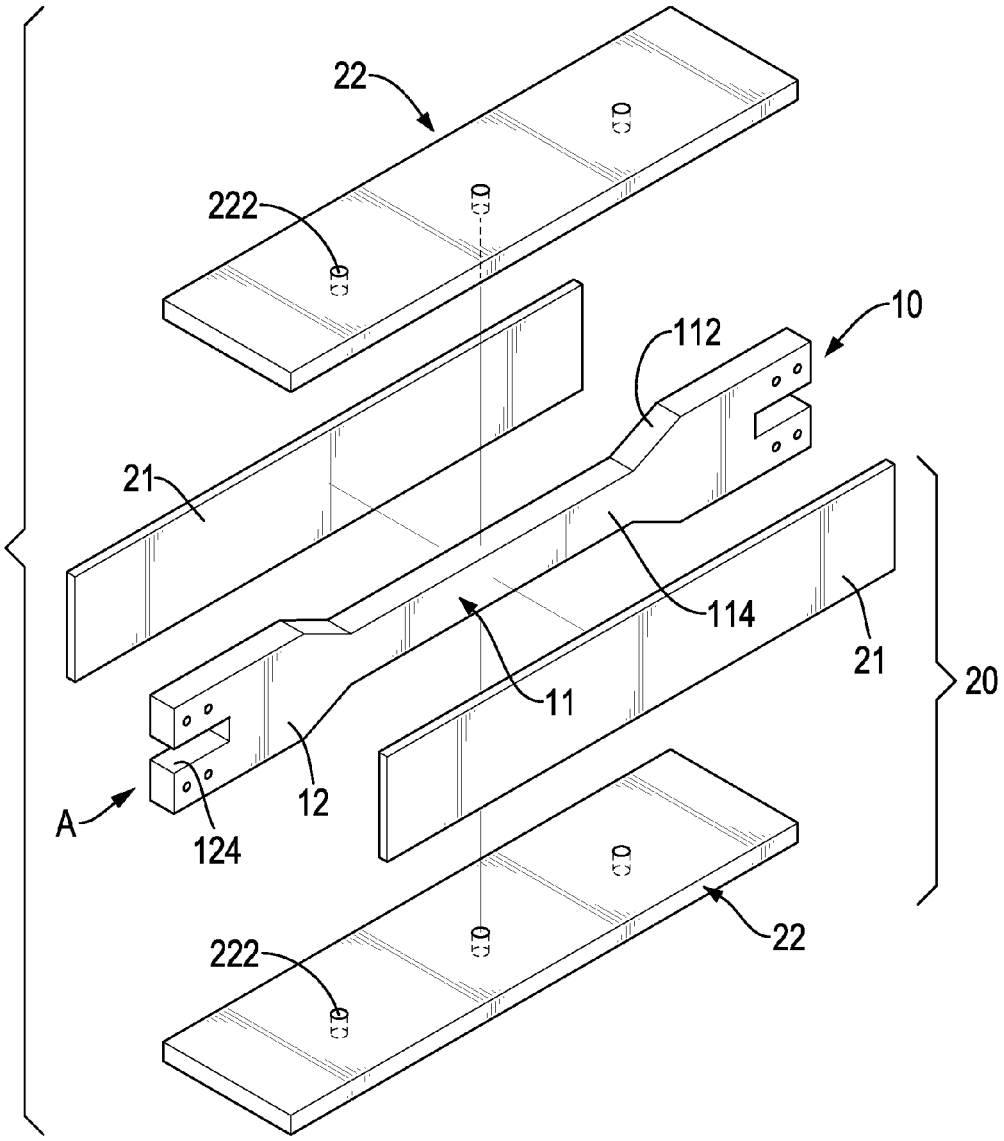
FIG. 21 is an exploded perspective view of a nineteenth embodiment of a bracing device in accordance with the present invention.
Figure 22:
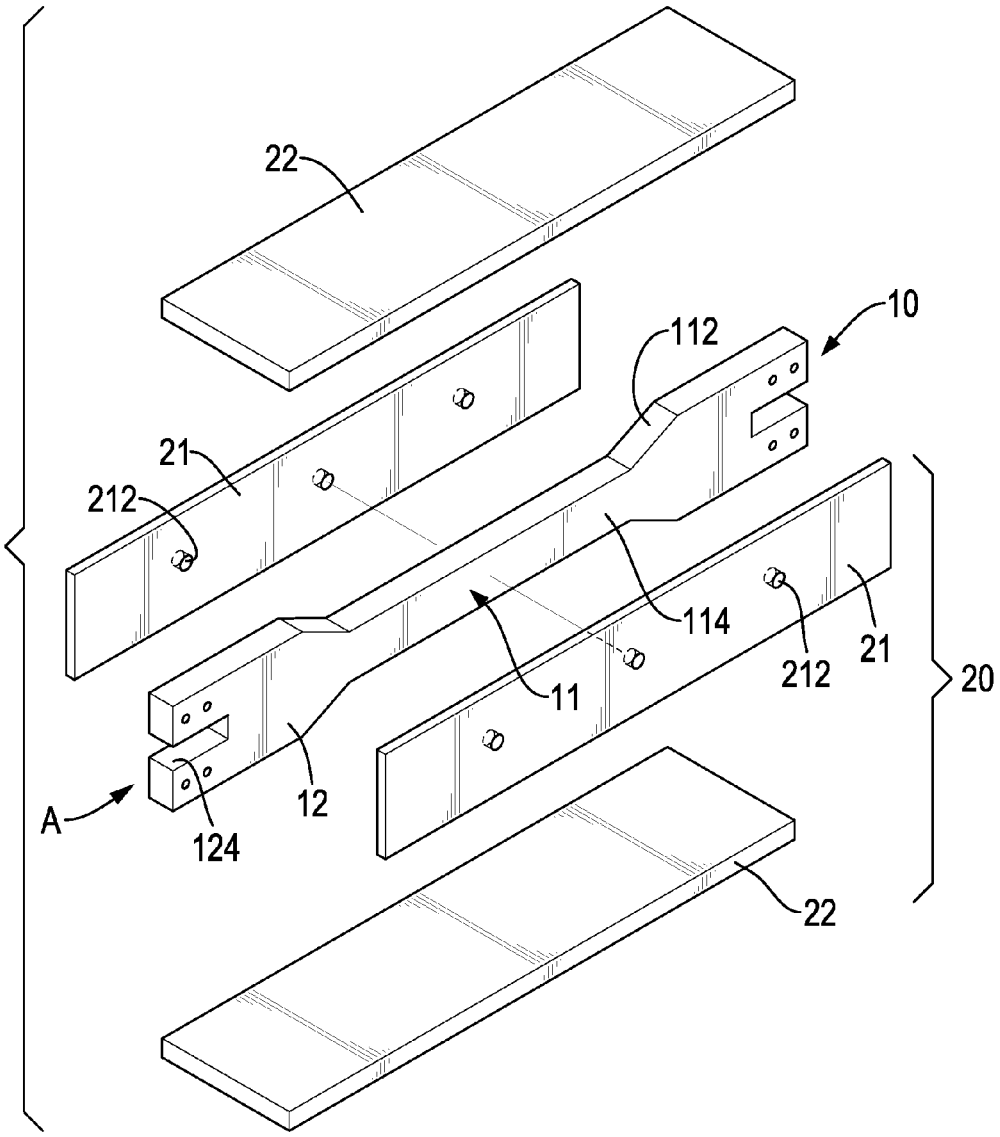
FIG. 22 is an exploded perspective view of a twentieth embodiment of a bracing device in accordance with the present invention.
Figure 23:
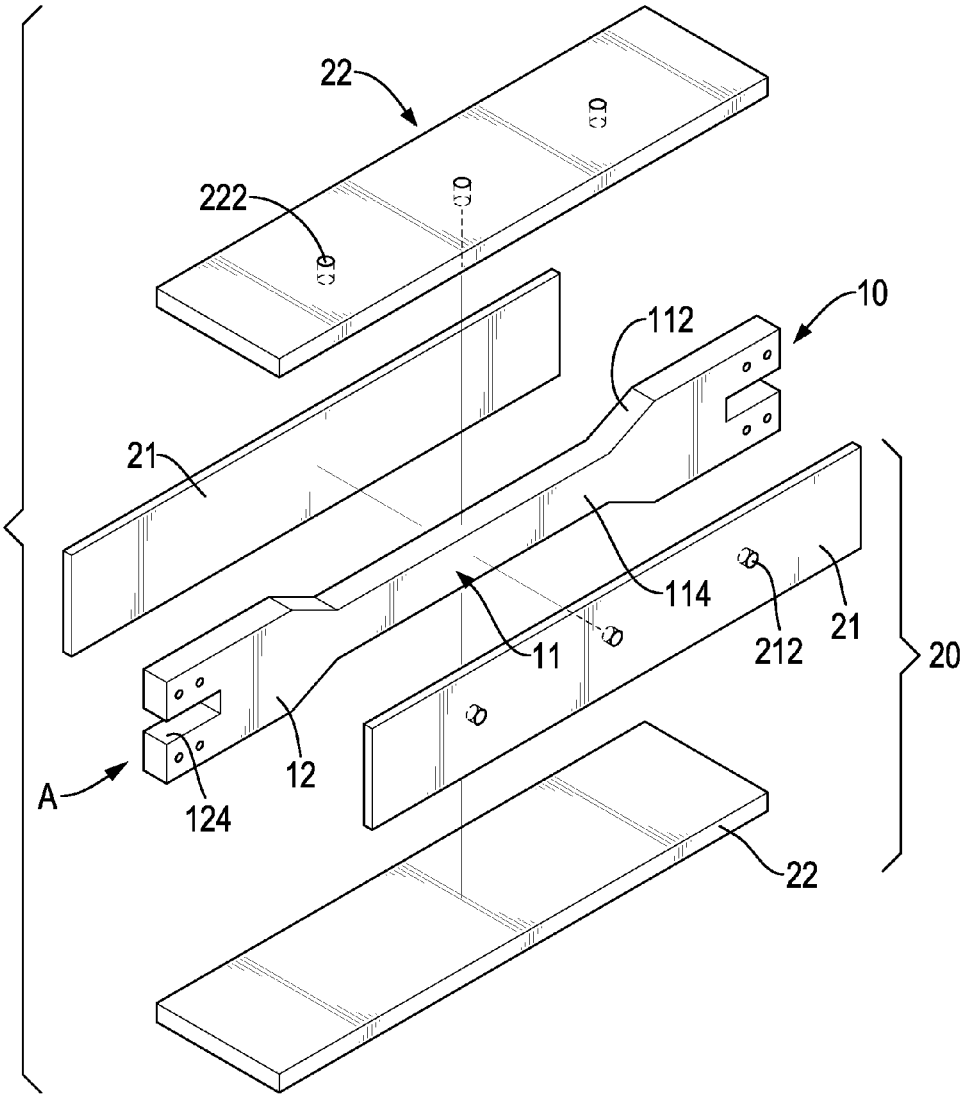
FIG. 23 is an exploded perspective view of a twenty-first embodiment of a bracing device in accordance with the present invention.
Figure 24:
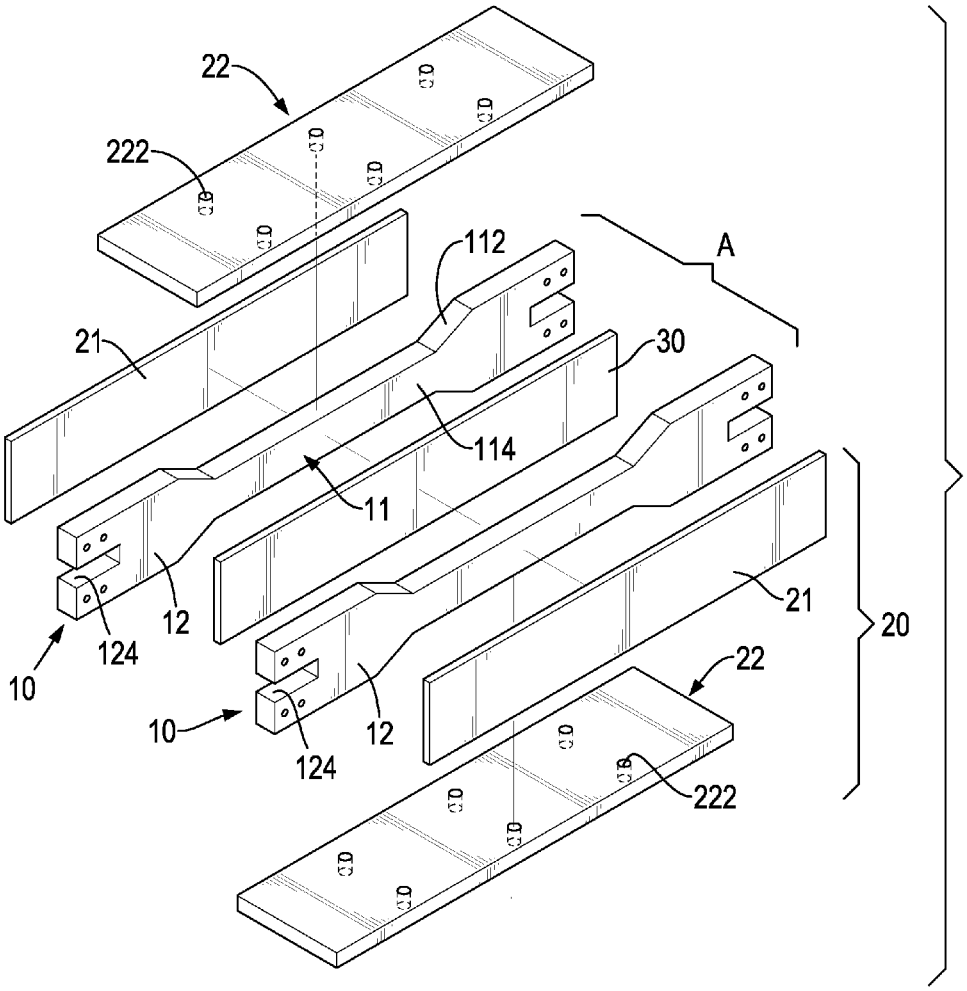
FIG. 24 is an exploded perspective view of a twenty-second embodiment of a bracing device in accordance with the present invention.
Figure 25:
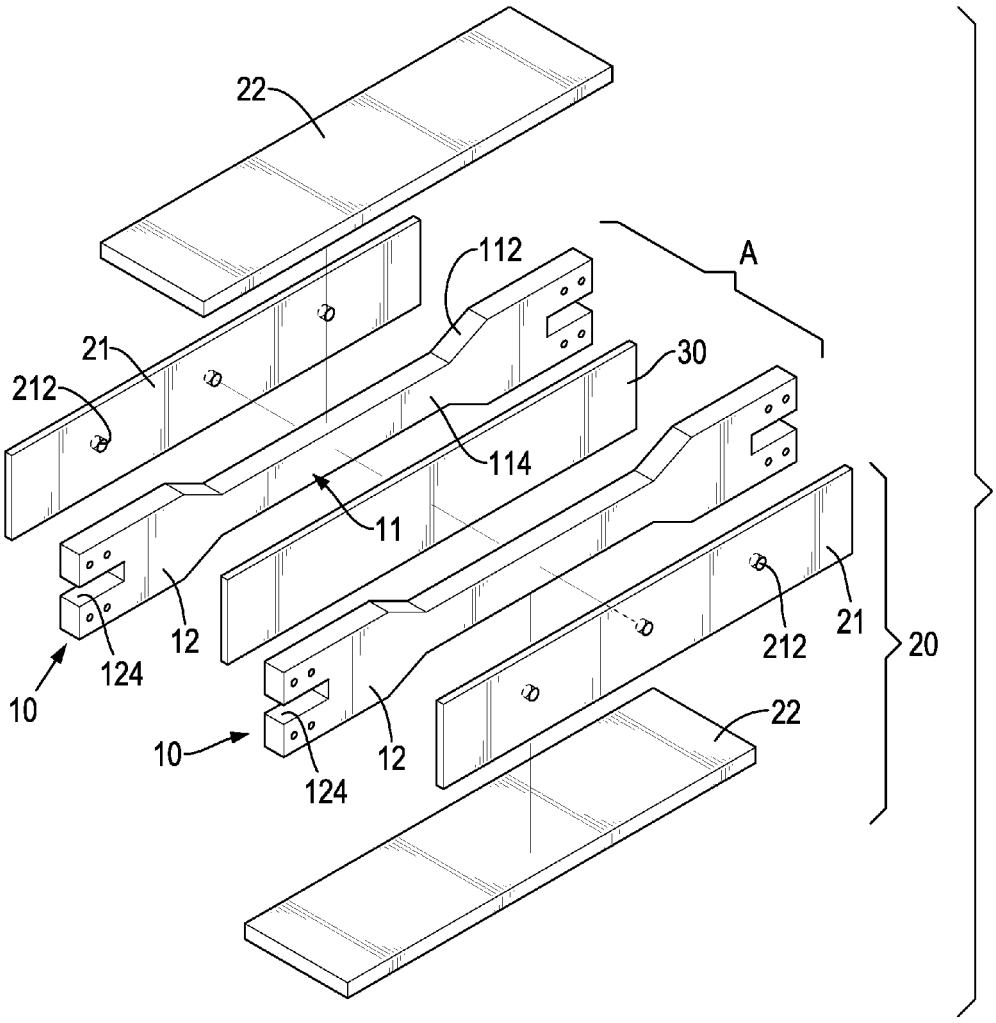
FIG. 25 is an exploded perspective view of a twenty-third embodiment of a bracing device in accordance with the present invention.
Figure 26:
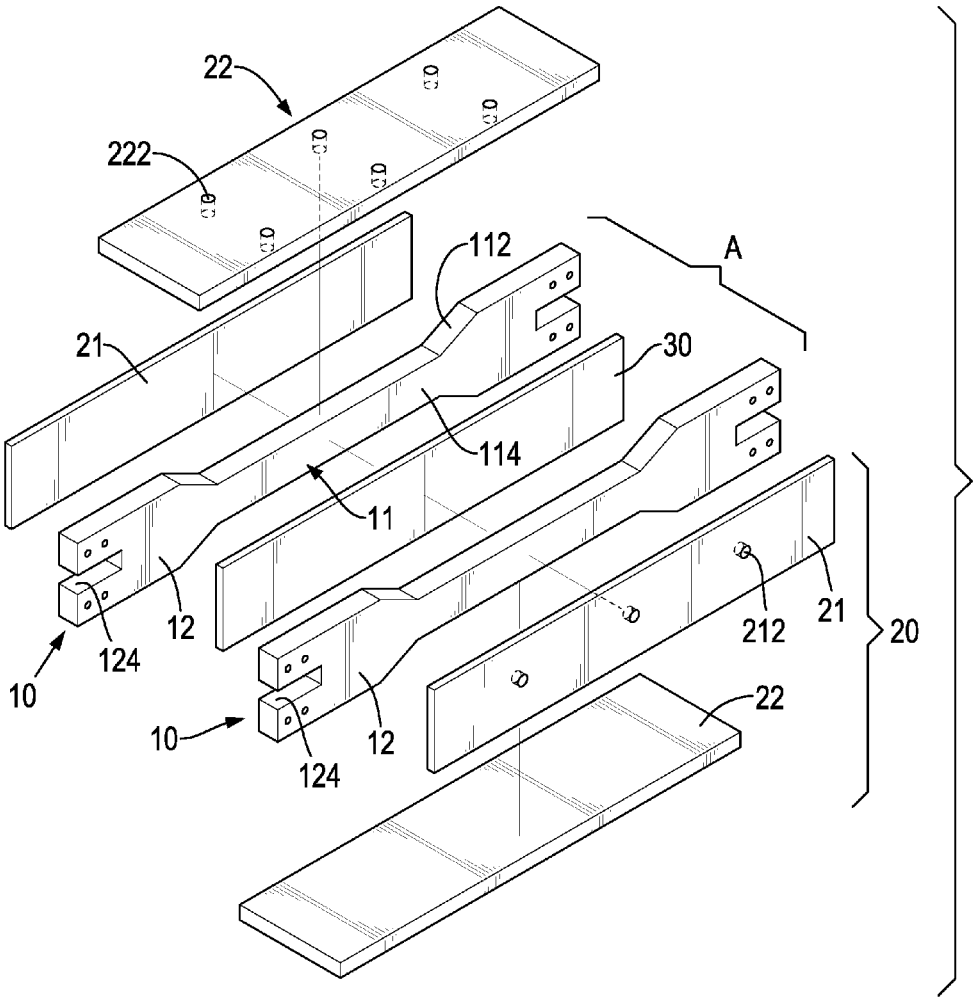
FIG. 26 is an exploded perspective view of a twenty-fourth embodiment of a bracing device in accordance with the present invention.

With reference to FIG. 8, a sixth embodiment of a bracing device in accordance with the present invention is substantially the same as the fourth embodiment in FIG. 6 except the following features. One of the side boards 21 has six viewing holes 212 formed through the side board 21 at intervals, and three of the viewing holes 212 align along one of the loading sections 114 of the supporting element 10 and the other three viewing holes 212 align along the other loading section 114 of the supporting element 10. In addition, one of the restraining boards 22 has six viewing holes 222 formed through the restraining board 22 at intervals, and three of the viewing holes 222 align along one of the loading sections 114 of the supporting element 10 and the other three viewing holes 222 align along the other loading section 114 of the supporting element 10. Then, the user can easily see the loading sections 114 of the supporting element 10 via the viewing holes 212 of the corresponding side boards 21 or the viewing holes 222 of the corresponding restraining board 22 of the restraining element 20.

With reference to FIGS. 9 to 14, seventh to twelfth embodiments of a bracing device in accordance with the present invention are respectively and substantially the same as the first to sixth embodiments in FIGS. 1 and 4 to 8 except the following features. Each one or at least one of the connecting heads 12 of each supporting element 10 is flat-shaped without having the connecting blocks 122, and the connecting holes are formed through the connecting head 12.

With reference to FIGS. 15 to 20, thirteenth to eighteenth embodiments of a bracing device in accordance with the present invention are respectively and substantially the same as the first to sixth embodiments in FIGS. 1 and 4 to 8 except the following features. Each one or at least one of the connecting heads 12 of each supporting element 10 is flat-shaped without having the connecting blocks 122, and the connecting holes are formed through the connecting head 12. In addition, each one or at least one of the connecting heads 12 of each supporting element 10 has a connecting notch 124 formed through the connecting head 12 between the connecting holes.

With reference to FIGS. 21 to 26, nineteenth to twenty-fourth embodiments of a bracing device in accordance with the present invention are respectively and substantially the same as the thirteenth to eighteenth embodiments in FIGS. 15 to 20 except the following features. Each one of the supporting elements 10 has two concave edges 112 respectively formed in the first side and the second side of the axial segment 11 of the supporting element 10, and a loading section 114 formed on the axial segment 11 between the two concave edges 112.

Figure 27:
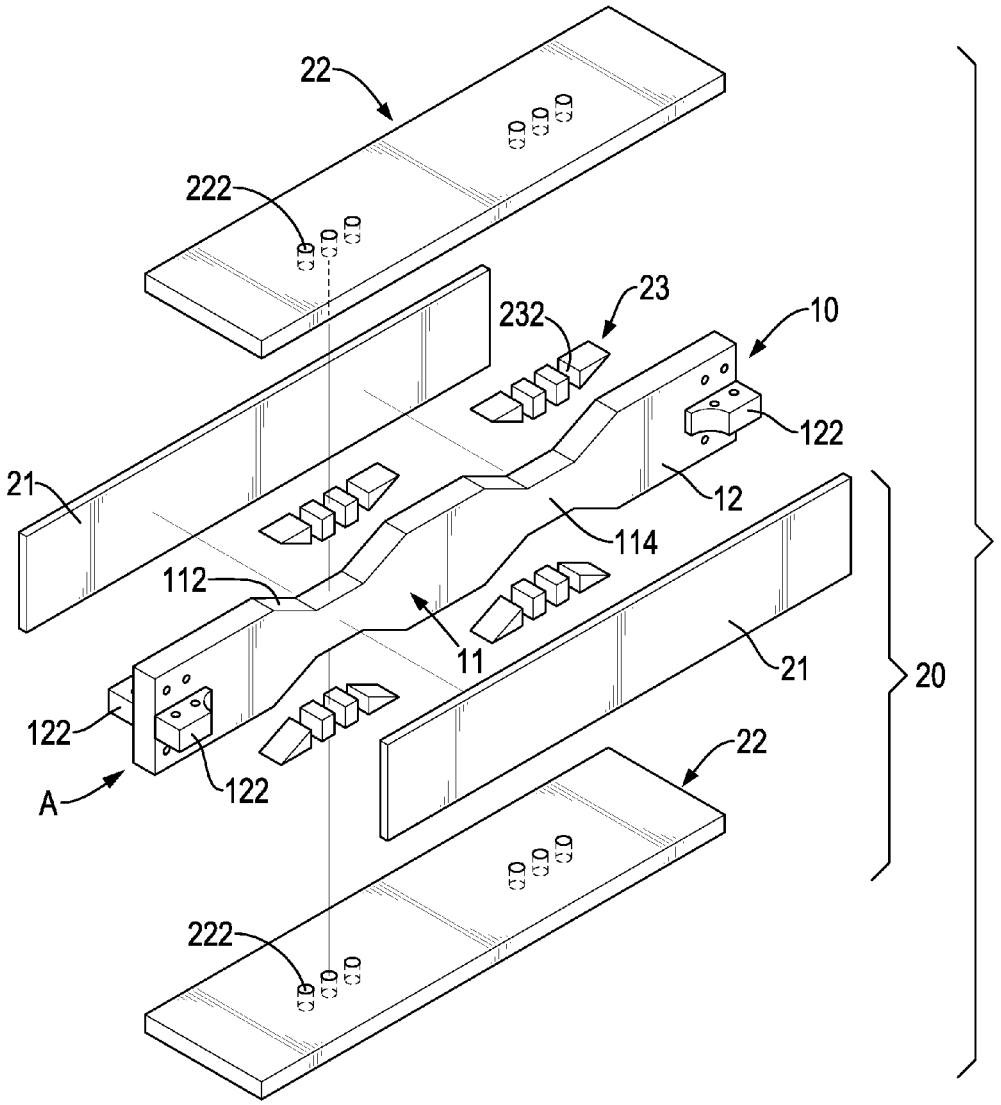
FIG. 27 is an exploded perspective view of a twenty-fifth embodiment of a bracing device in accordance with the present invention.

With reference to FIG. 27, a twenty-fifth embodiment of a bracing device in accordance with the present invention is and substantially the same as the first embodiment in FIG. 1 except the following features. The restraining element 20 has a positioning element 23 mounted in each one of the concave edges 112 of the supporting element 10, connected to the side boards 21 or one of the restraining boards 22 by welding, fastening or riveting. Furthermore, each one of the positioning element 23 has multiple viewing holes 232 respectively aligning along with the viewing holes 222 of a corresponding restraining board 22. Then, the user can see condition of the loading sections 114 of the supporting element 10 via the viewing holes 222, 232 of the restraining boards 22 and the positioning elements 23 of the restraining element 20.

Figure 28:
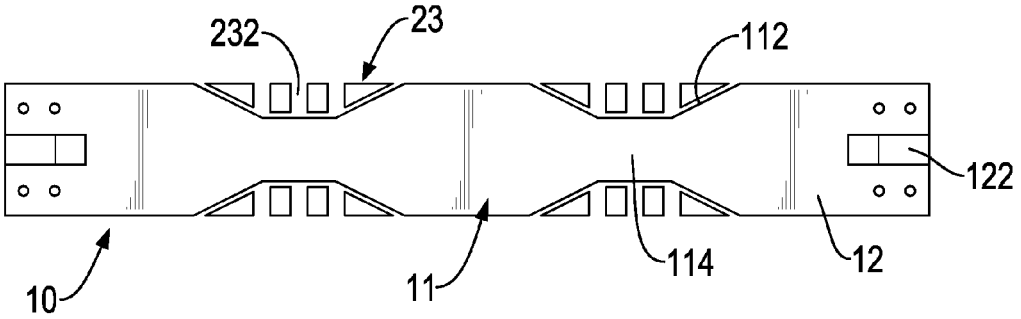
FIG. 28 is an operational side view of the first embodiment of the supporting element of the bracing device in FIG. 2.

In addition, in the first embodiment of the supporting element 10 as shown in FIG. 2, the axial segment 11 has four concave edges 112. Two of the concave edges 112 are formed in the first side of the axial segment 11 at an interval and the other two concave edges 112 are formed in the second side of the axial segment 11 at an interval to form two loading sections 114 on the axial segment 11 with the concave edges 112 that are formed in the first side of the axial segment 11. With reference to FIG. 28, the restraining element 20 has four positioning elements 23 respectively mounted in the concave edges 112 of the axial segment 11 between the side boards 21 and the restraining boards 22. In addition, each one of the positioning elements 23 has a shape corresponding to a shape of a corresponding concave edge 112 of the axial segment 11, an interval formed between the positioning element 23 and the corresponding concave edge 112 and multiple viewing holes 232 aligning along the viewing holes 222 of a corresponding restraining board 22. Preferably, the supporting element 10 and the positioning elements 23 are formed by a cutting machine cutting an elongated board to take the maximum advantage of the economic efficiency of the material of the elongated board.

Figure 29:
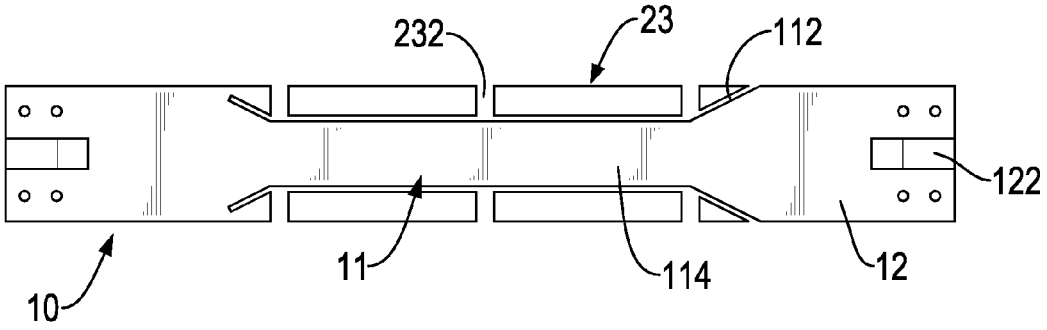
FIG. 29 is an operational side view of the second embodiment of the supporting element of the bracing device in FIG. 3.

In the second embodiment of the supporting element 10 as shown in FIG. 3, the axial segment 11 has two concave edges 112, one of the concave edges 112 is formed in the first side of the axial segment 11 and the other one concave edge 112 is formed in the second side of the axial segment 11 to form a loading section 114 on the axial segment 11 between the two concave edges 112. With reference to FIG. 29, the restraining element 20 has two positioning elements 23 respectively mounted in the concave edges 112 of the axial segment 11 between the side boards 21 and the restraining boards 22. In addition, each one of the positioning elements 23 has a shape corresponding to a shape of a corresponding concave edge 112 of the axial segment 11, an interval formed between the positioning element 23 and the corresponding concave edge 112 and multiple viewing holes 232 aligning along the viewing holes 222 of a corresponding restraining board 22.

Figure 30:
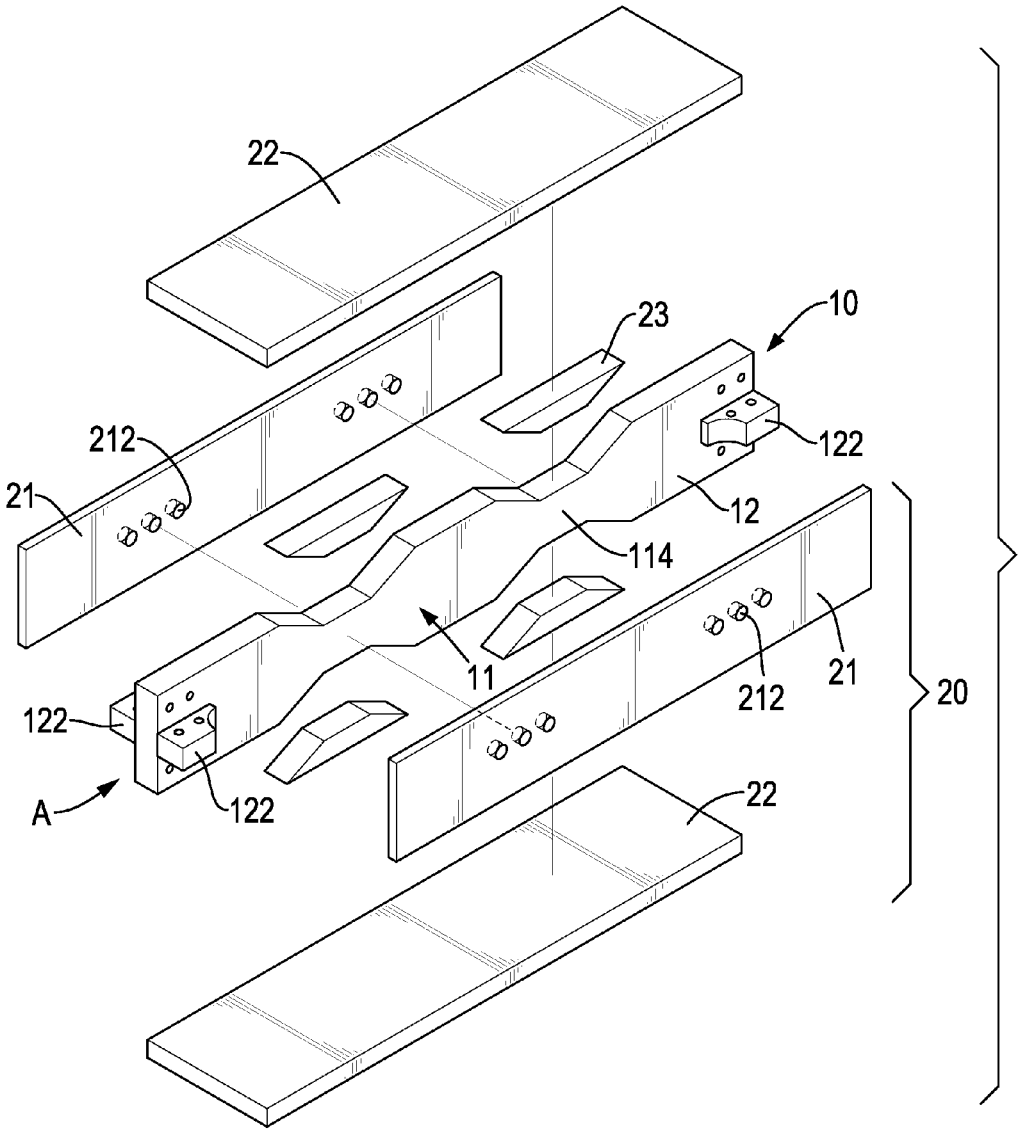
FIG. 30 is an exploded perspective view of a twenty-sixth embodiment of a bracing device in accordance with the present invention.

With reference to FIG. 30, a twenty-sixth embodiment of a bracing device in accordance with the present invention is and substantially the same as the twenty-fifth embodiment in FIG. 27 except the following features. Each one of the side boards 21 has six viewing holes 212 formed through the side board 21 at intervals, and three of the viewing holes 212 align along one of the loading sections 114 of the supporting element 10 and the other three viewing holes 212 align along the other loading section 114 of the supporting element 10. In addition, the restraining boards 22 and the positioning elements do not have the viewing holes 222, 232.

Figure 31:
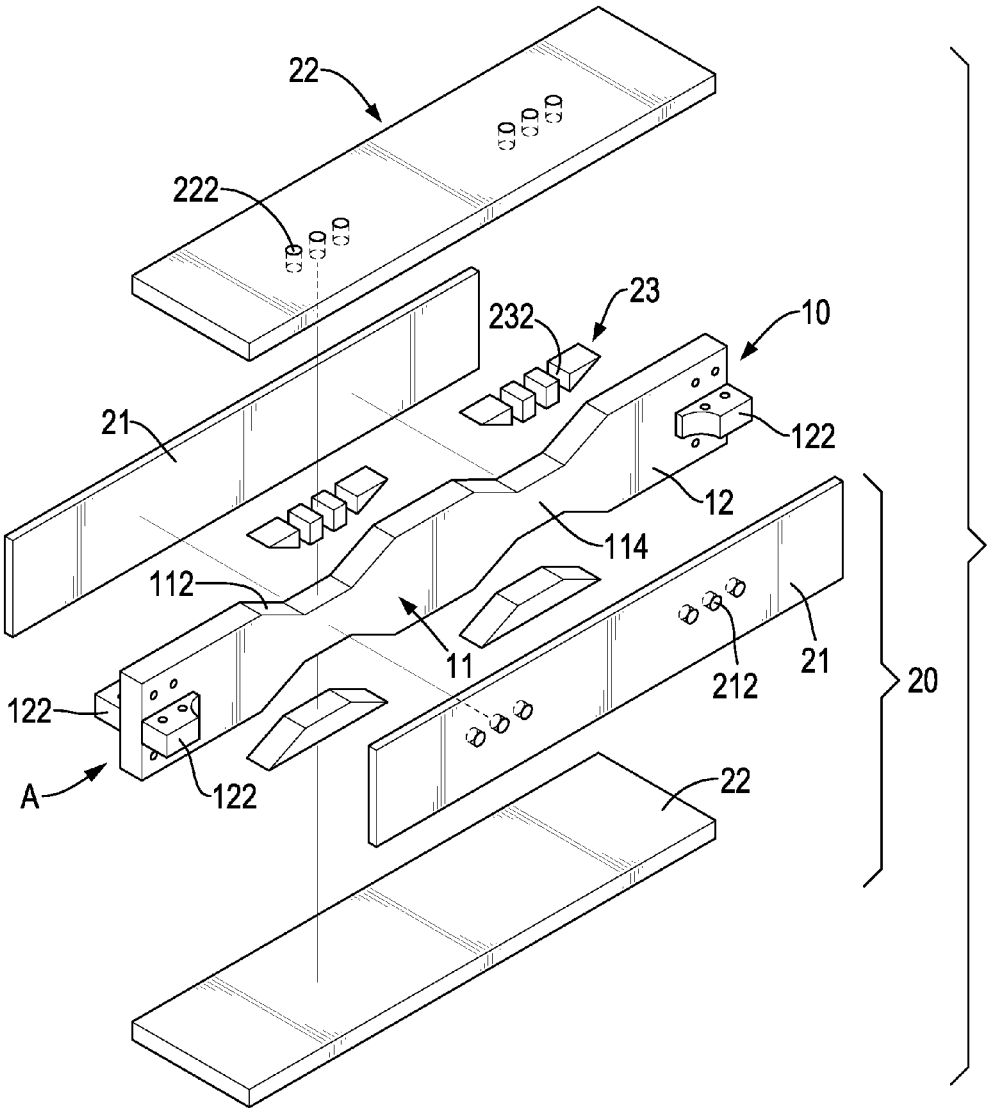
FIG. 31 is an exploded perspective view of a twenty-seventh embodiment of a bracing device in accordance with the present invention.

With reference to FIG. 31, a twenty-seventh embodiment of a bracing device in accordance with the present invention is and substantially the same as the twenty-fifth embodiment in FIG. 27 except the following features. One of the side boards 21 has six viewing holes 212 formed through the side board 21 at intervals, and three of the viewing holes 212 align along one of the loading sections 114 of the supporting element 10 and the other three viewing holes 212 align along the other loading section 114 of the supporting element 10. One of the restraining boards 22 has six viewing holes 222 formed through the restraining board 22 at intervals, and three of the viewing holes 222 align along one of the loading sections 114 of the supporting element 10 and the other three viewing holes 222 align along the other loading section 114 of the supporting element 10. In addition, the restraining element 20 has four positioning elements 23, two of the positioning elements 23 have viewing holes 232 aligning along the viewing holes 222 of a corresponding restraining board 22.

Figure 32:
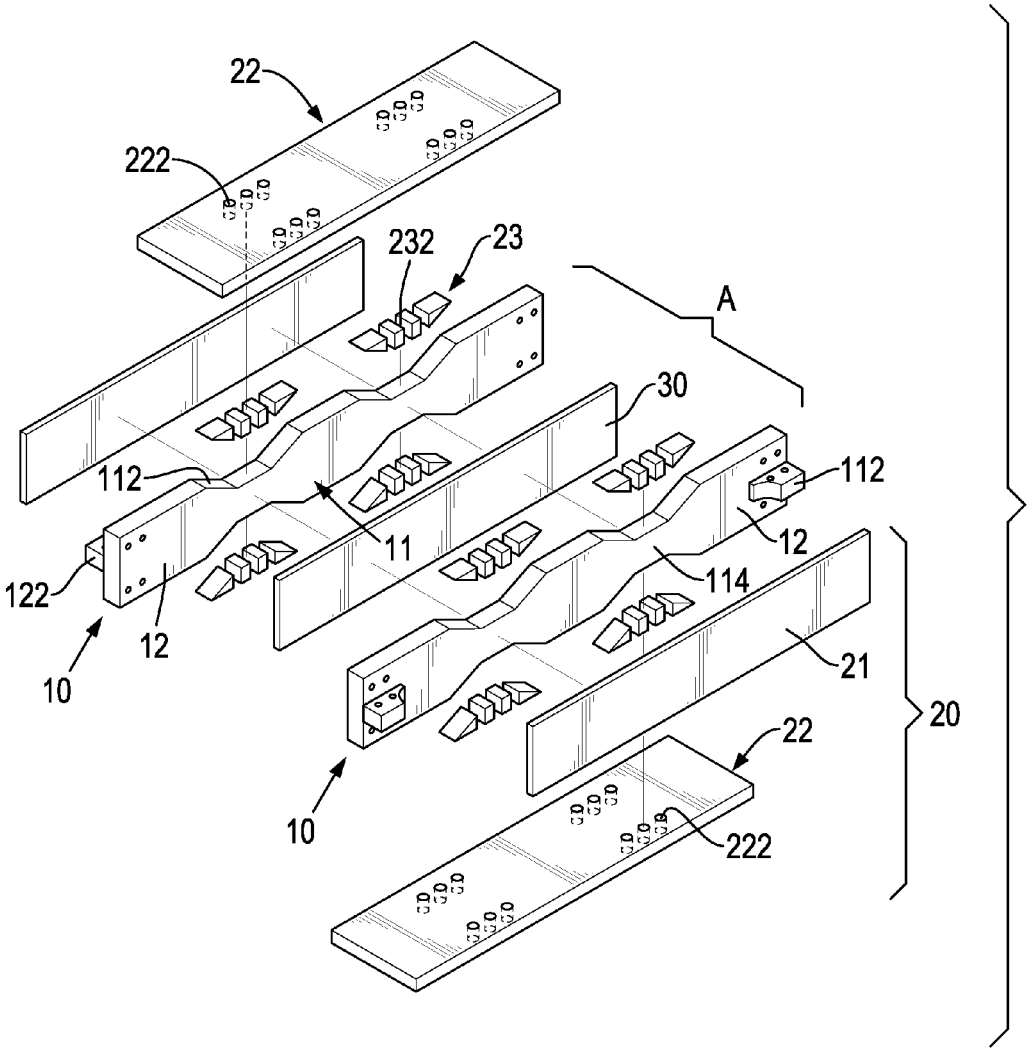
FIG. 32 is an exploded perspective view of a twenty-eighth embodiment of a bracing device in accordance with the present invention.

With reference to FIG. 32, a twenty-eighth embodiment of a bracing device in accordance with the present invention is and substantially the same as the fourth embodiment in FIG. 6 except the following features. The restraining element 20 has a positioning element 23 mounted in each concave edge 112 of the two supporting elements 10, and each positioning element 23 has multiple viewing holes 232 aligning along the viewing holes 222 of a corresponding restraining board 22. Then, the user can see the loading sections 114 of the supporting elements 10 via the viewing holes 222, 232 of the restraining boards 22 and the positioning elements 23.

Figure 33:
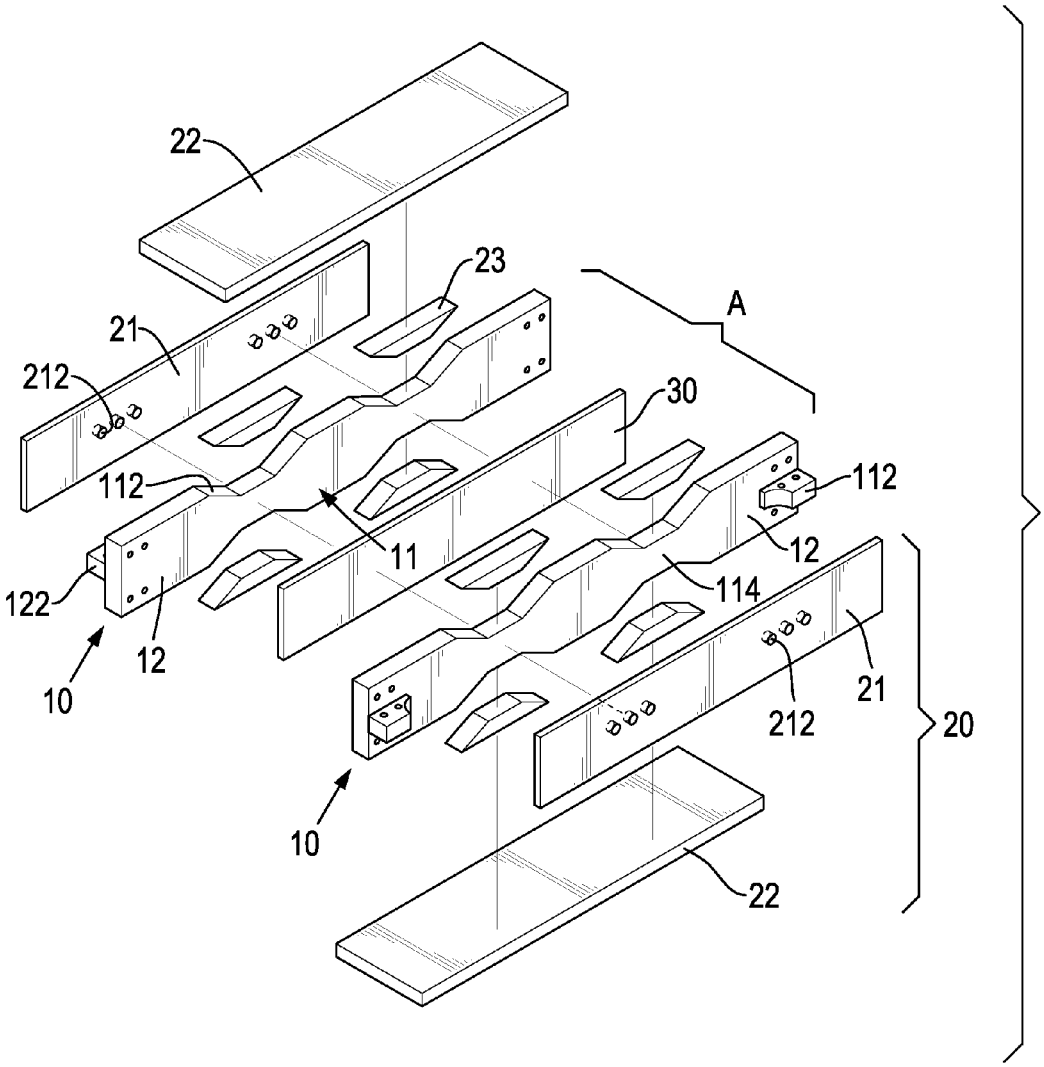
FIG. 33 is an exploded perspective view of a twenty-ninth embodiment of a bracing device in accordance with the present invention.

With reference to FIG. 33, a twenty-ninth embodiment of a bracing device in accordance with the present invention is and substantially the same as the twenty-eighth embodiment in FIG. 32 except the following features. Each one of the side boards 21 has six viewing holes 212 formed through the side board 21 at intervals, and three of the viewing holes 212 align along one of the loading sections 114 of a corresponding supporting element 10 and the other three viewing holes 212 align along the other loading section 114 of the corresponding supporting element 10. The restraining boards 22 and the positioning elements 23 do not have the viewing holes 222, 232.

Figure 34:
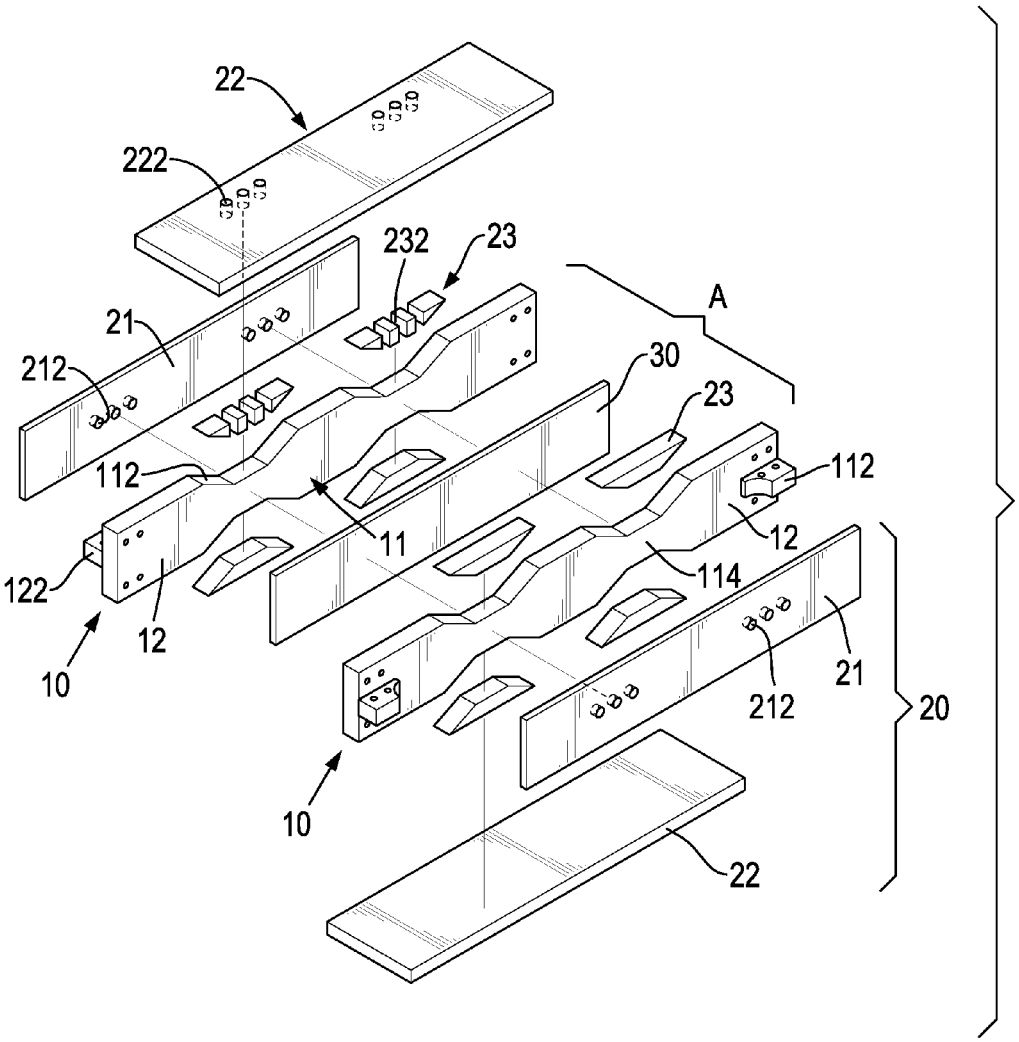
FIG. 34 is an exploded perspective view of a thirtieth embodiment of a bracing device in accordance with the present invention.
Figure 35:
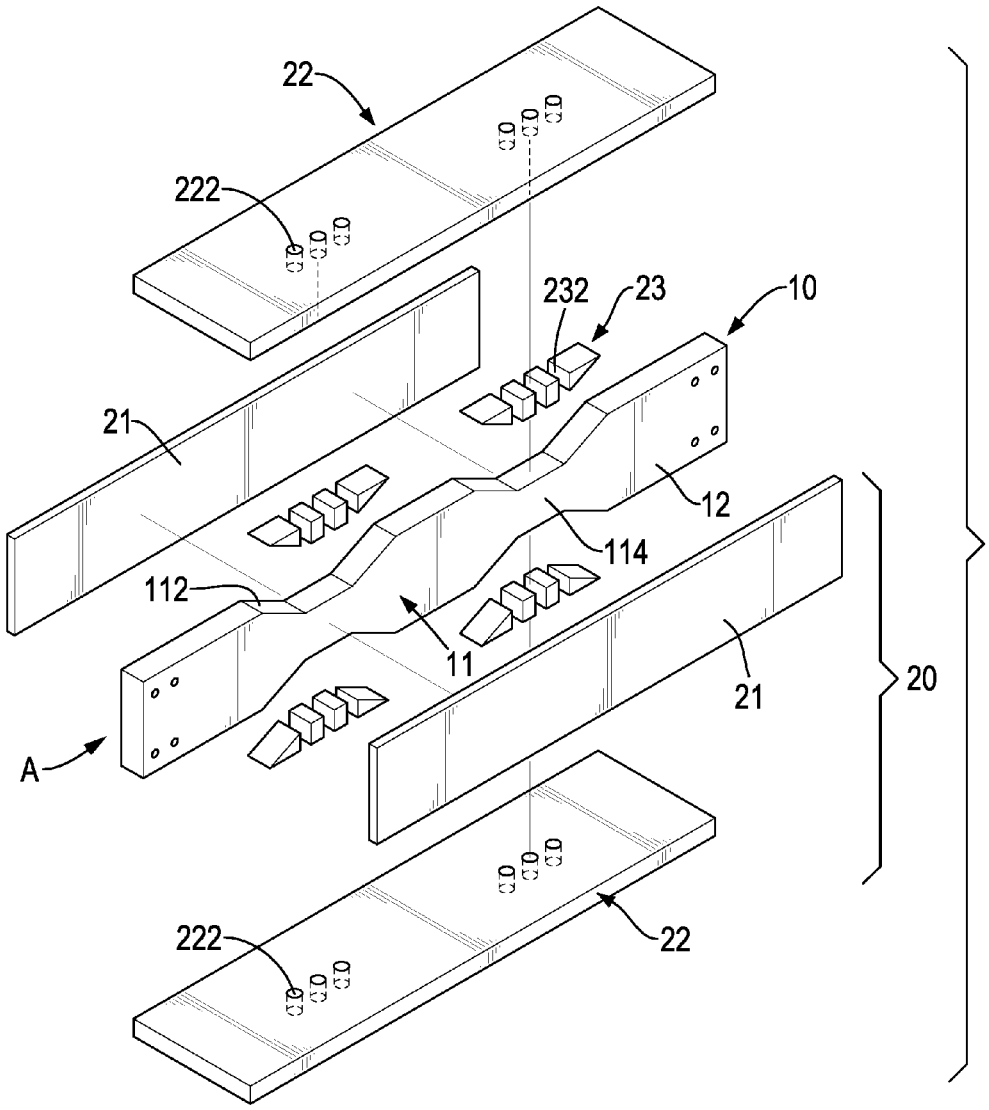
FIG. 35 is an exploded perspective view of a thirty-first embodiment of a bracing device in accordance with the present invention.
Figure 36:
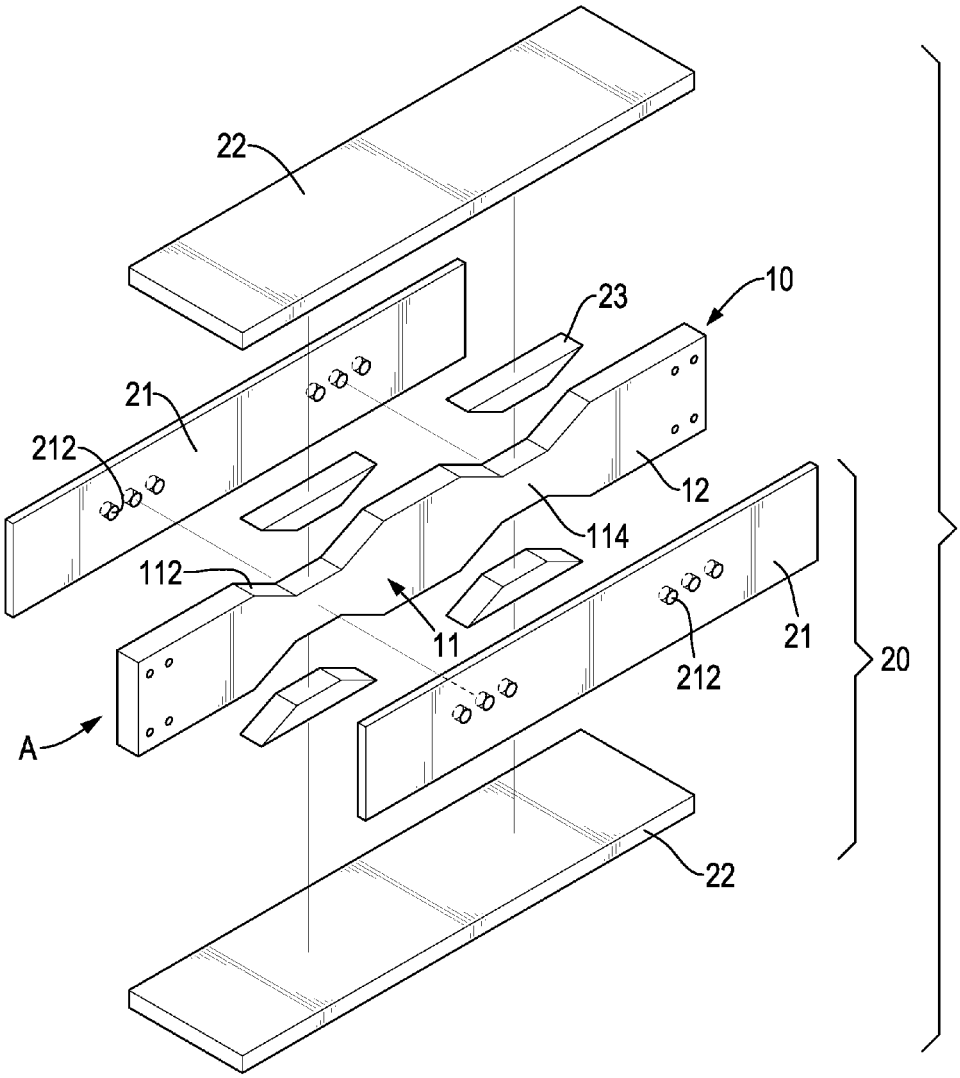
FIG. 36 is an exploded perspective view of a thirty-second embodiment of a bracing device in accordance with the present invention.
Figure 37:
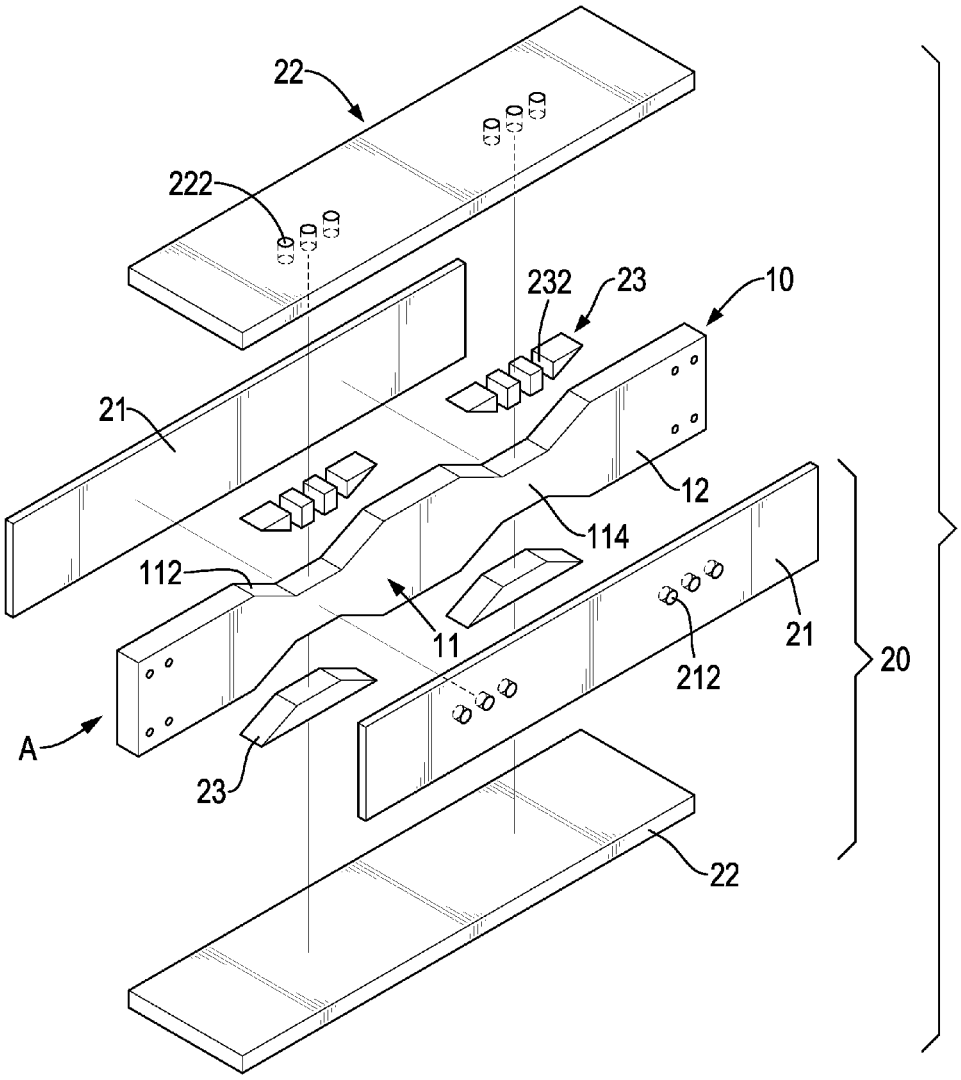
FIG. 37 is an exploded perspective view of a thirty-third embodiment of a bracing device in accordance with the present invention.
Figure 38:
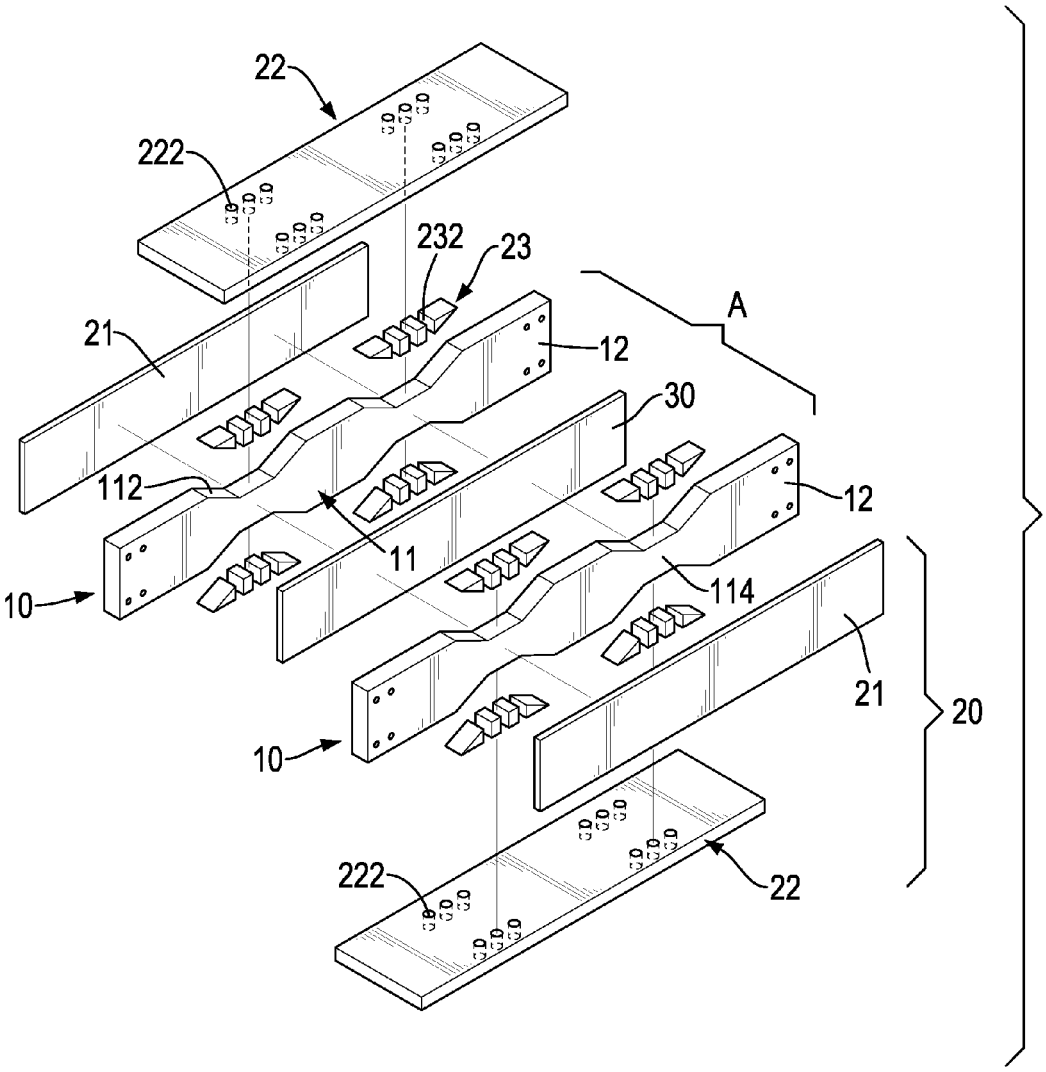
FIG. 38 is an exploded perspective view of a thirty-fourth embodiment of a bracing device in accordance with the present invention.
Figure 39:
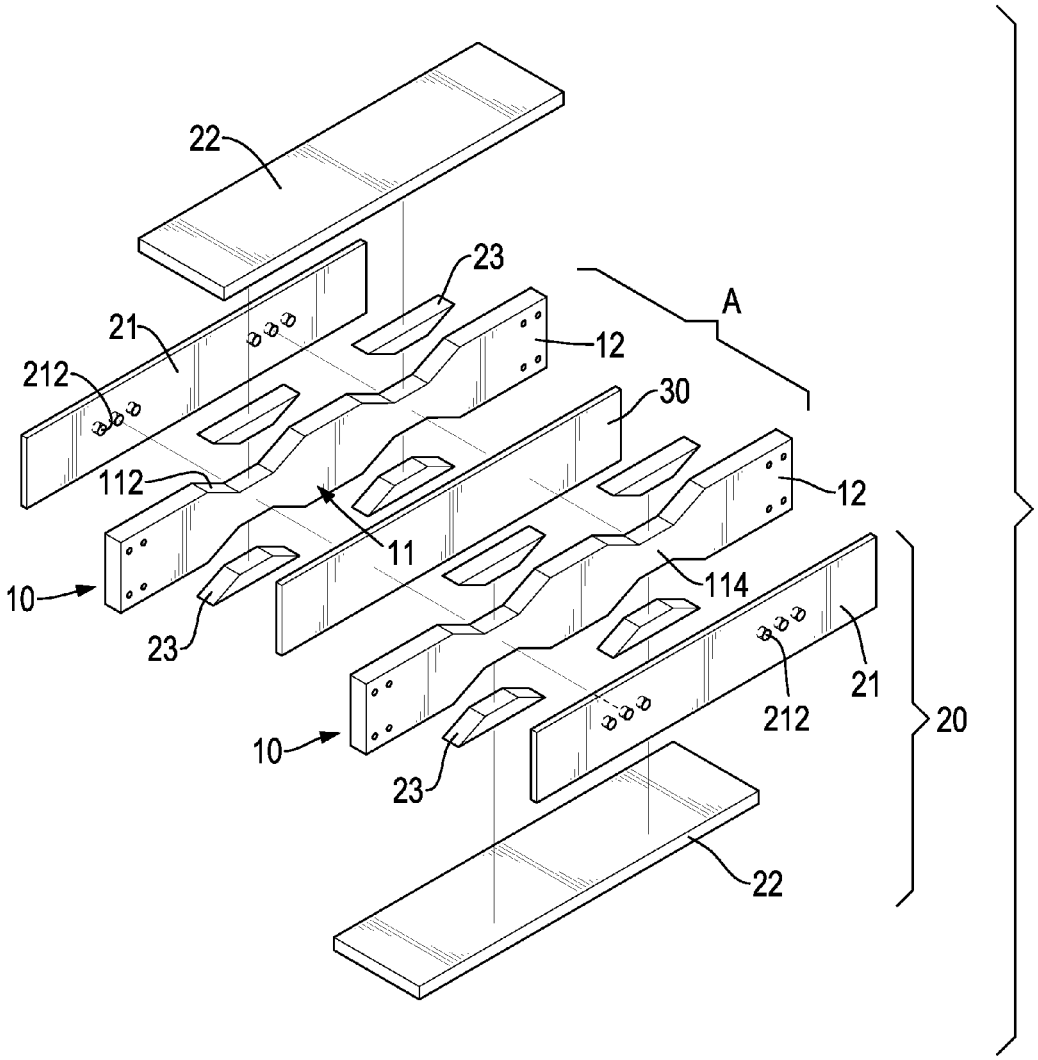
FIG. 39 is an exploded perspective view of a thirty-fifth embodiment of a bracing device in accordance with the present invention.
Figure 40:
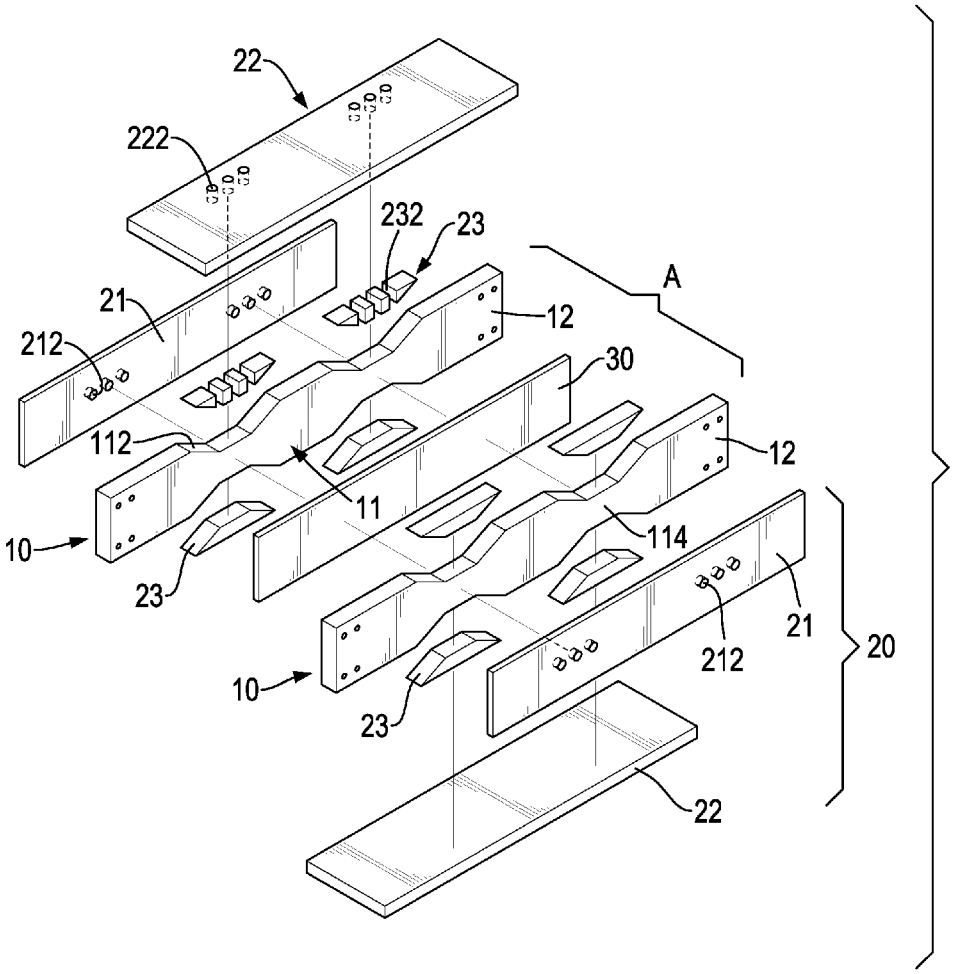
FIG. 40 is an exploded perspective view of a thirty-sixth embodiment of a bracing device in accordance with the present invention.
Figure 41:
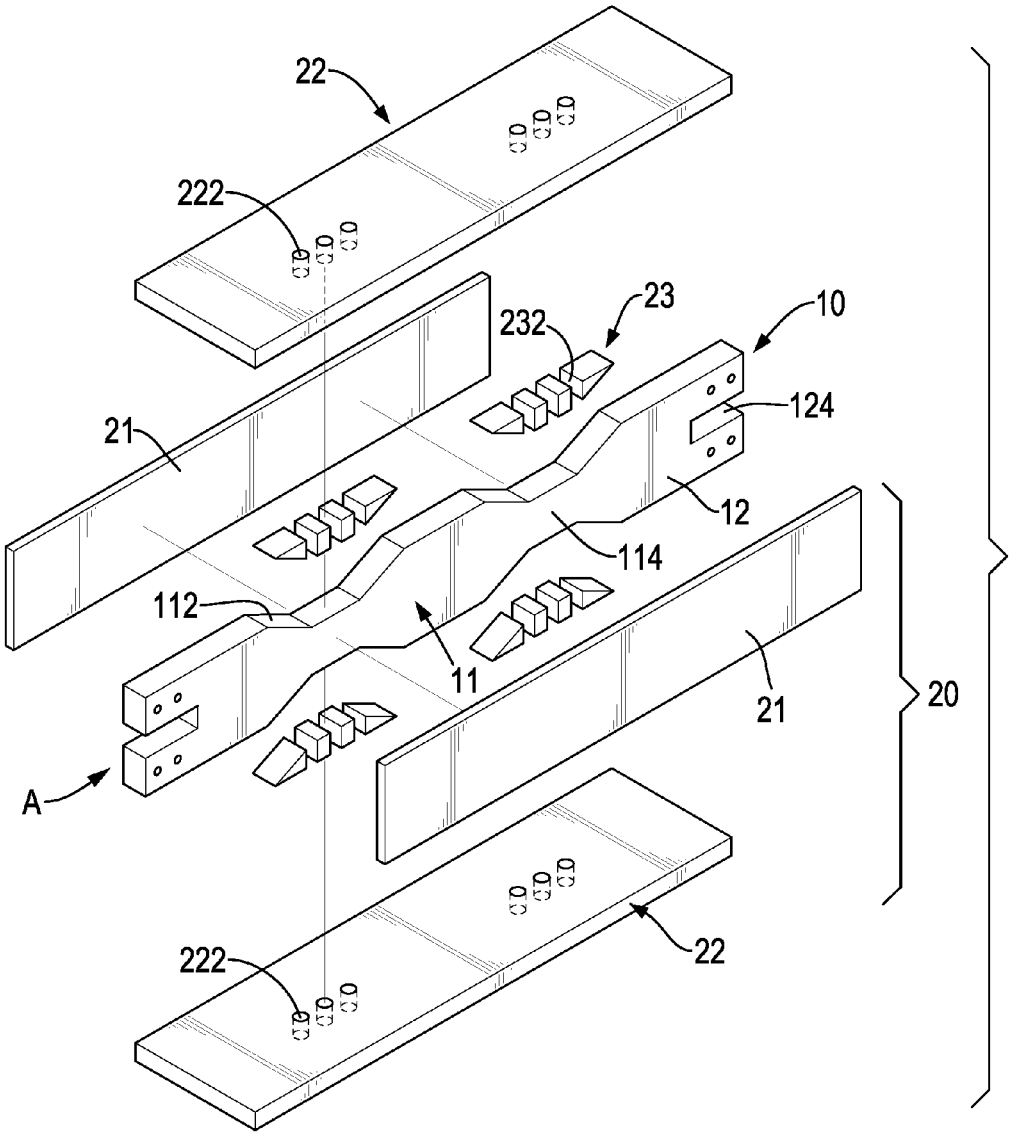
FIG. 41 is an exploded perspective view of a thirty-seventh embodiment of a bracing device in accordance with the present invention.
Figure 42:
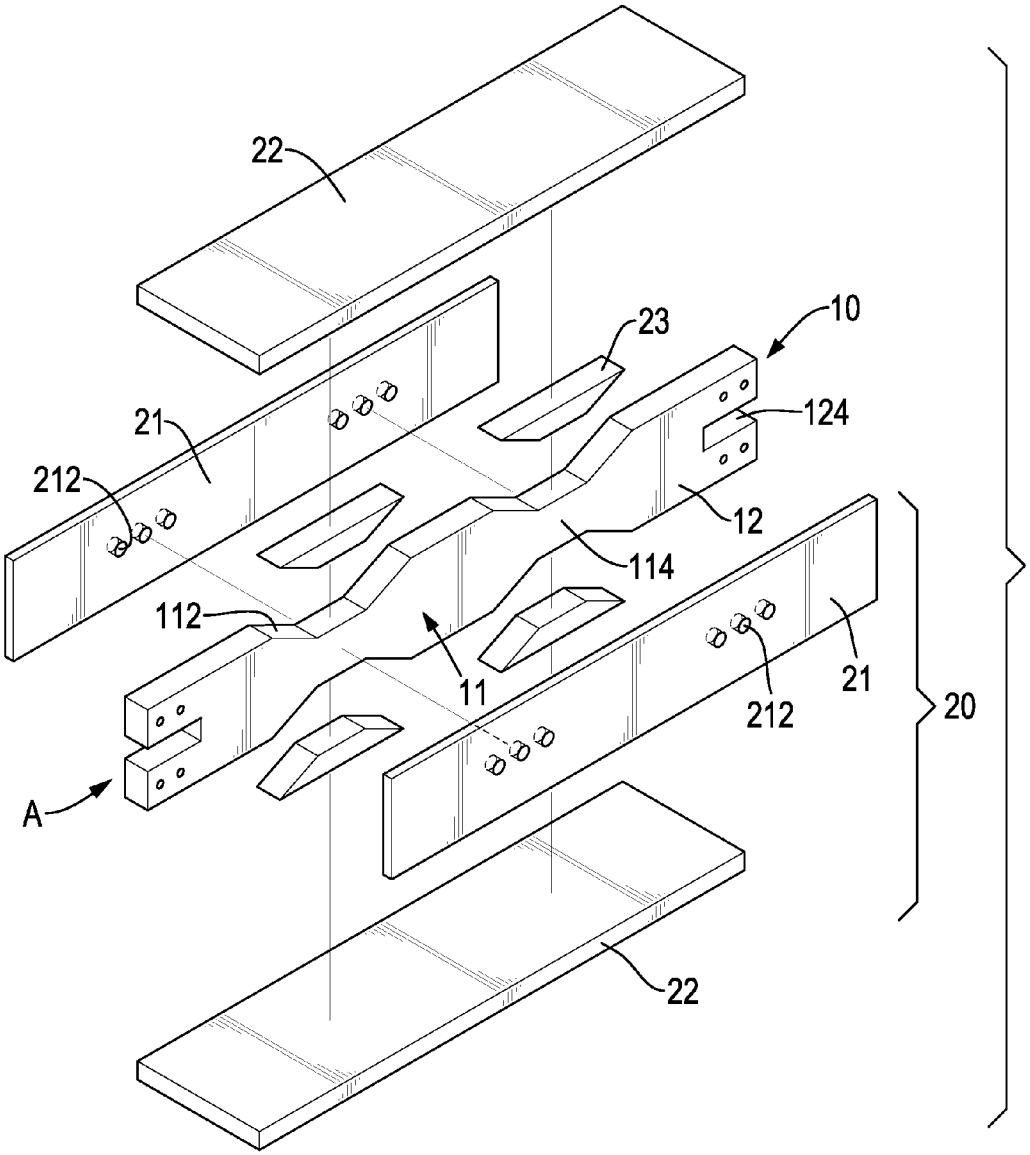
FIG. 42 is an exploded perspective view of a thirty-eighth embodiment of a bracing device in accordance with the present invention.
Figure 43:
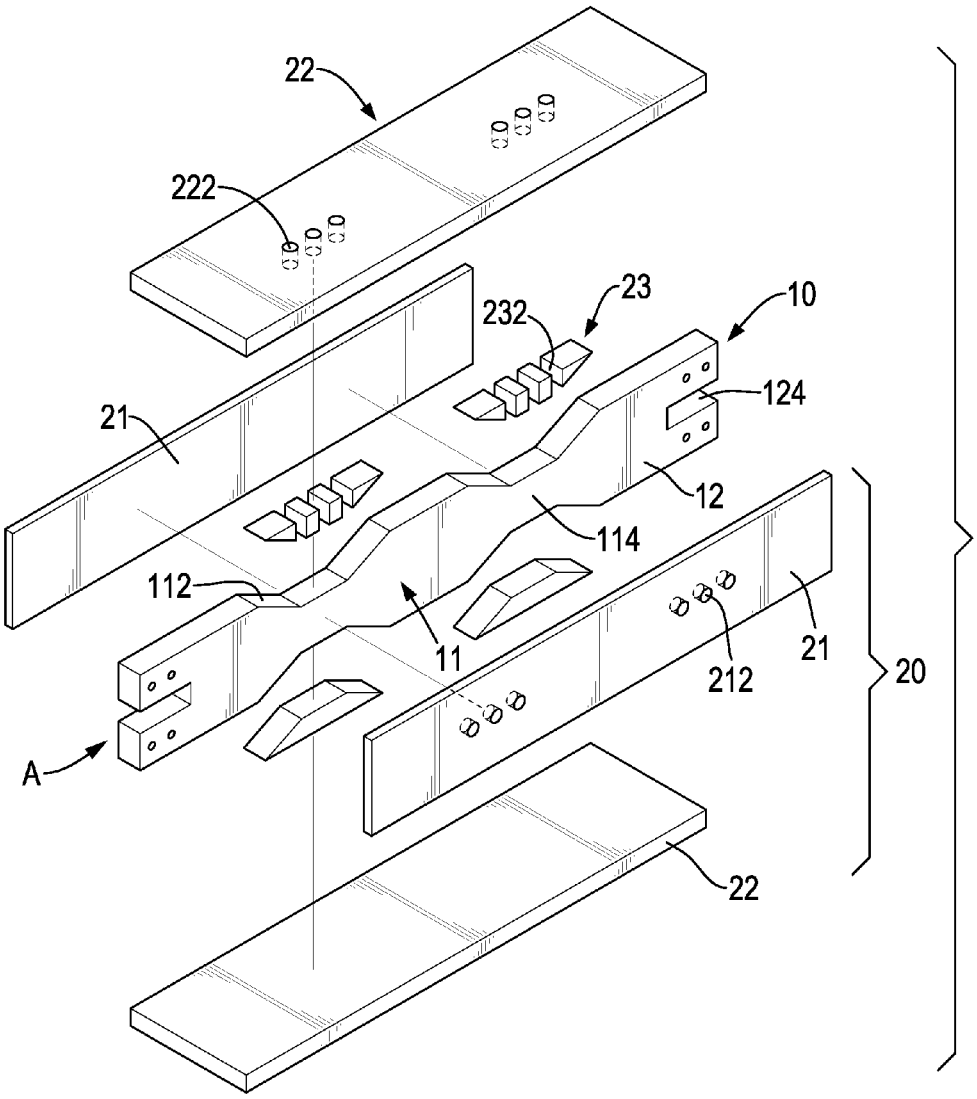
FIG. 43 is an exploded perspective view of a thirty-ninth embodiment of a bracing device in accordance with the present invention.
Figure 44:
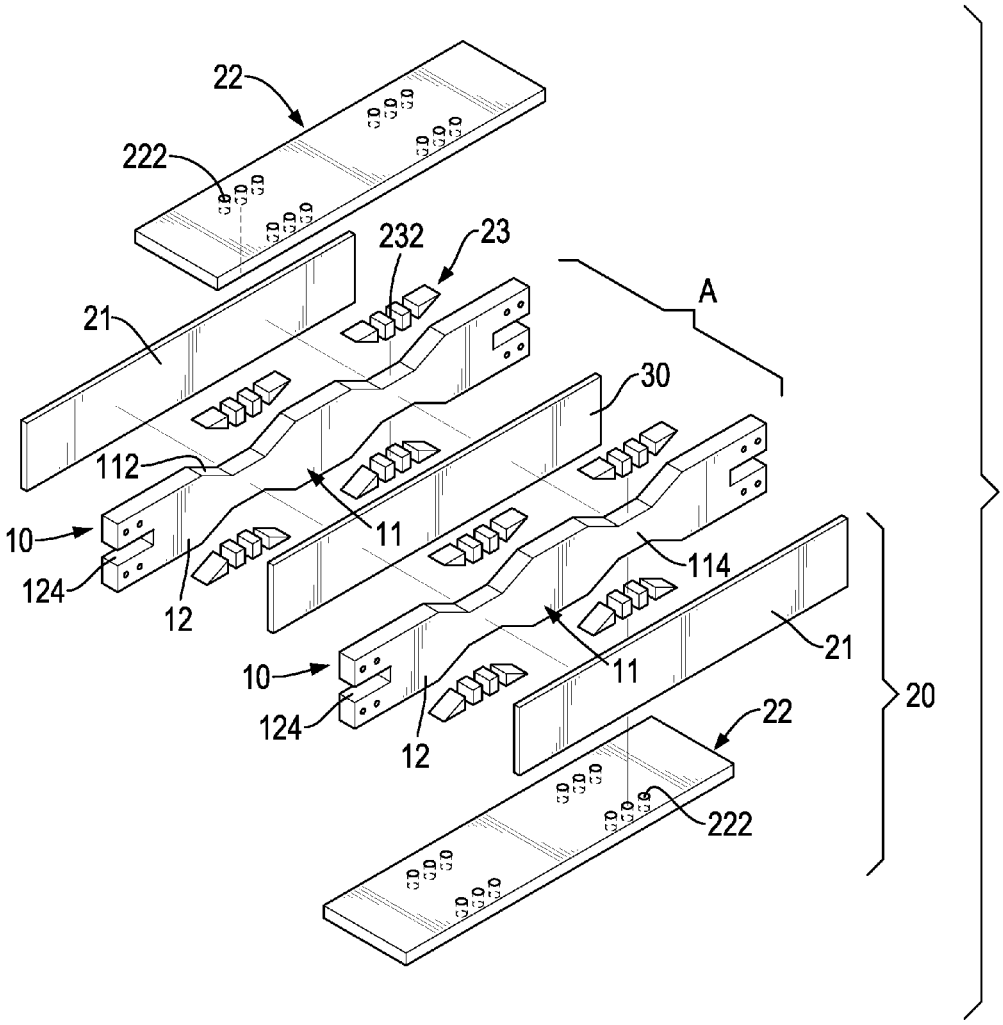
FIG. 44 is an exploded perspective view of a fortieth embodiment of a bracing device in accordance with the present invention.
Figure 45:
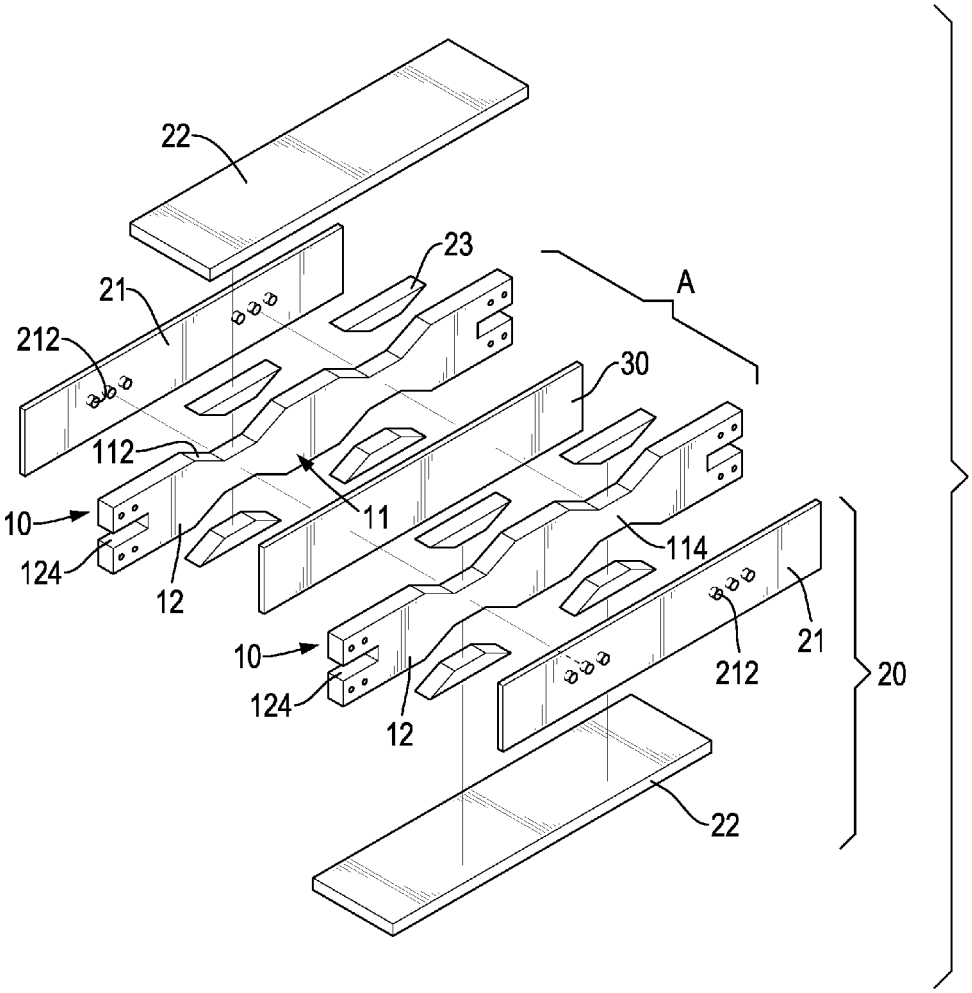
FIG. 45 is an exploded perspective view of a forty-first embodiment of a bracing device in accordance with the present invention.
Figure 46:
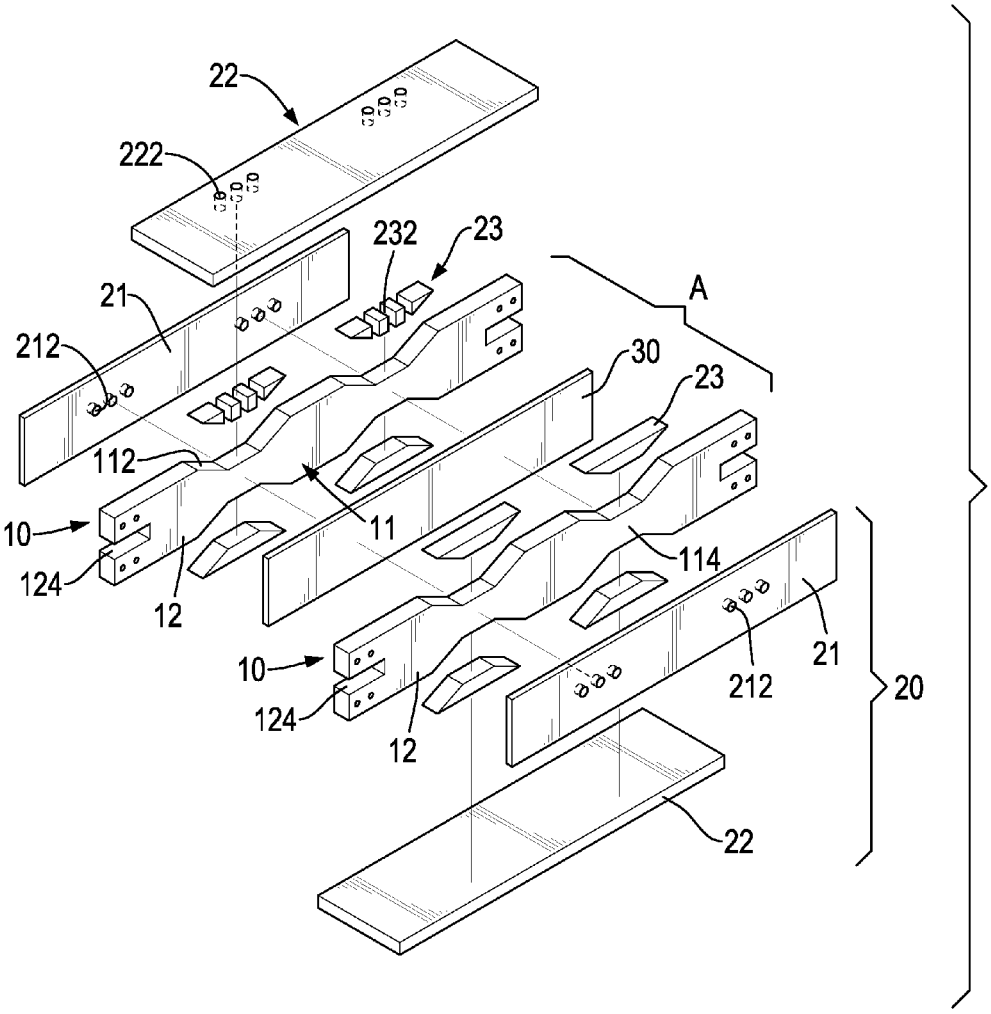
FIG. 46 is an exploded perspective view of a forty-second embodiment of a bracing device in accordance with the present invention.
Figure 47:
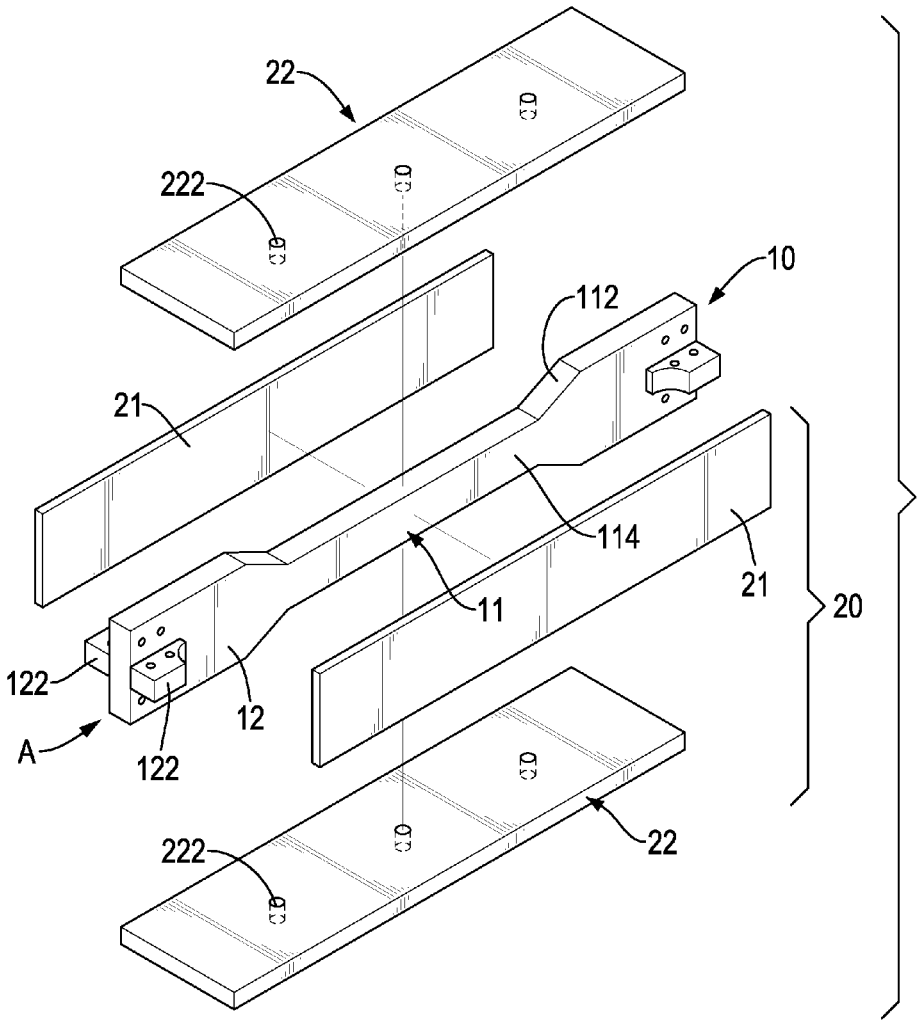
FIG. 47 is an exploded perspective view of a forty-third embodiment of a bracing device in accordance with the present invention.
Figure 48:
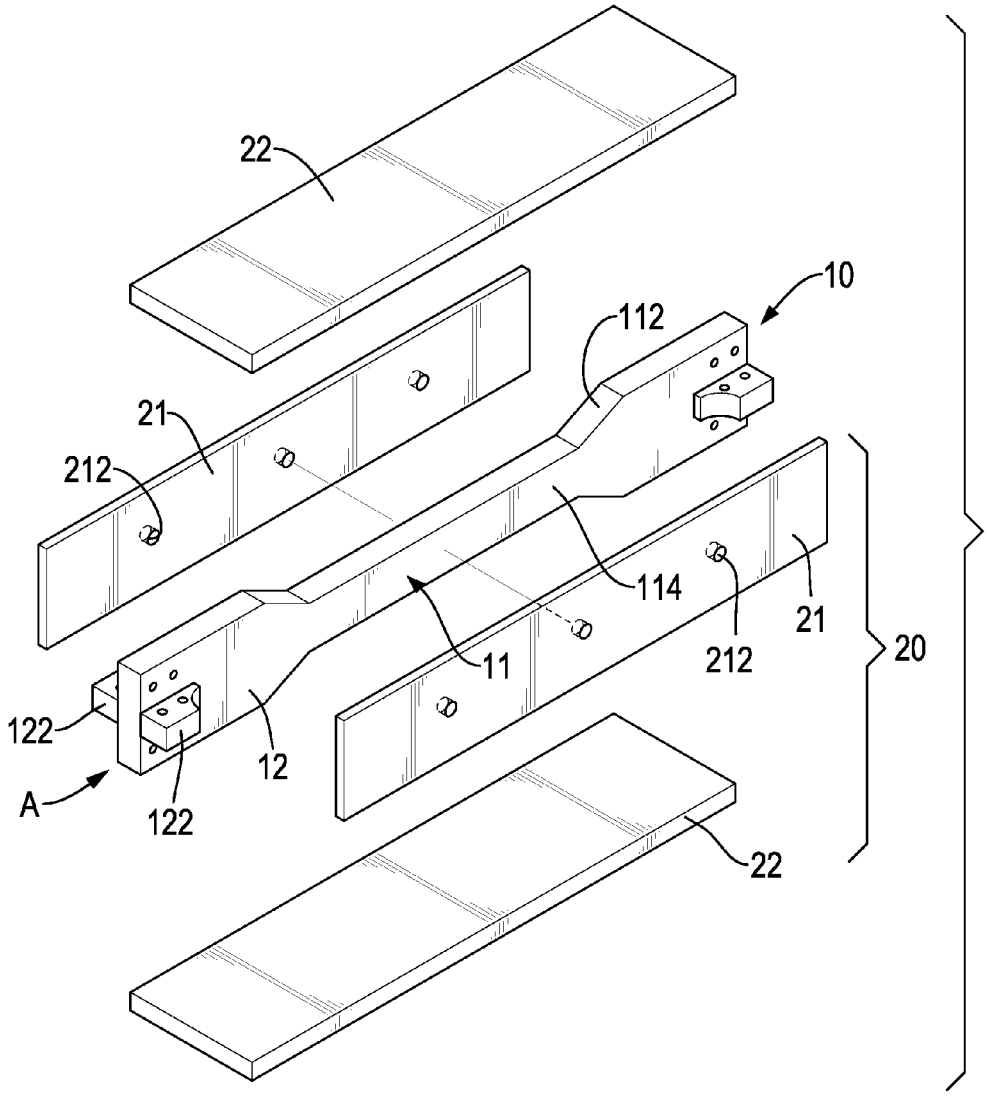
FIG. 48 is an exploded perspective view of a forty-fourth embodiment of a bracing device in accordance with the present invention.
Figure 49:
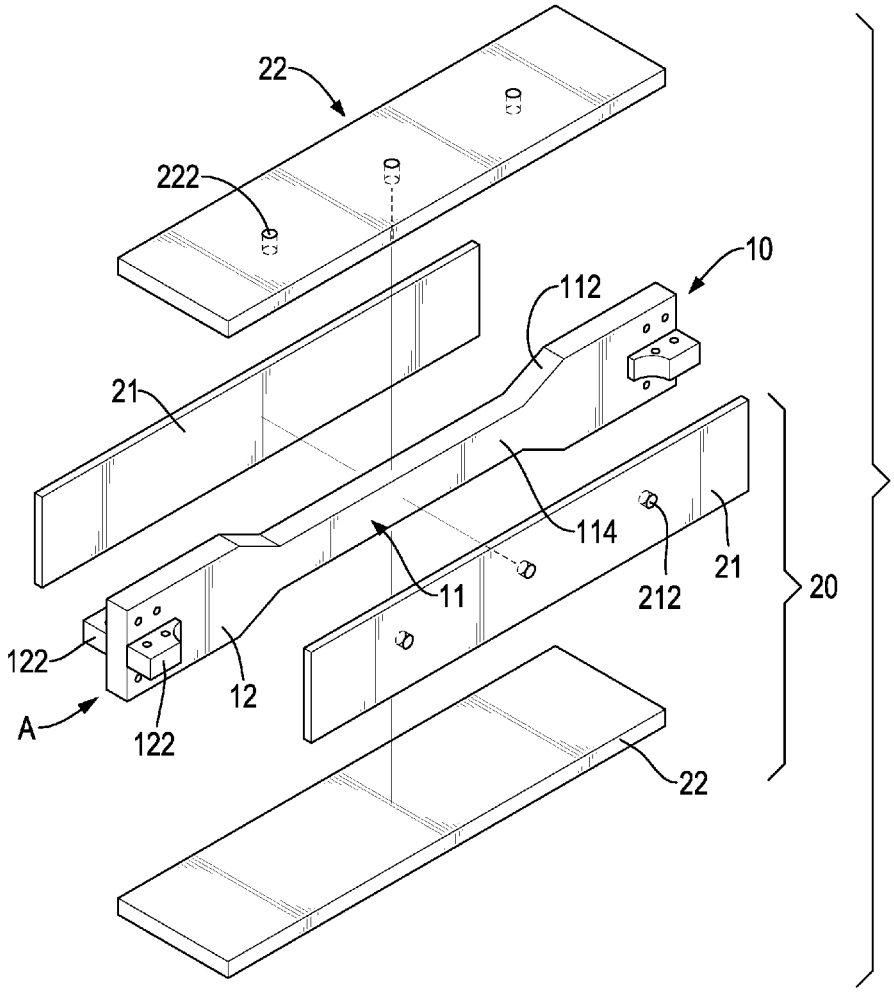
FIG. 49 is an exploded perspective view of a forty-fifth embodiment of a bracing device in accordance with the present invention.
Figure 50:
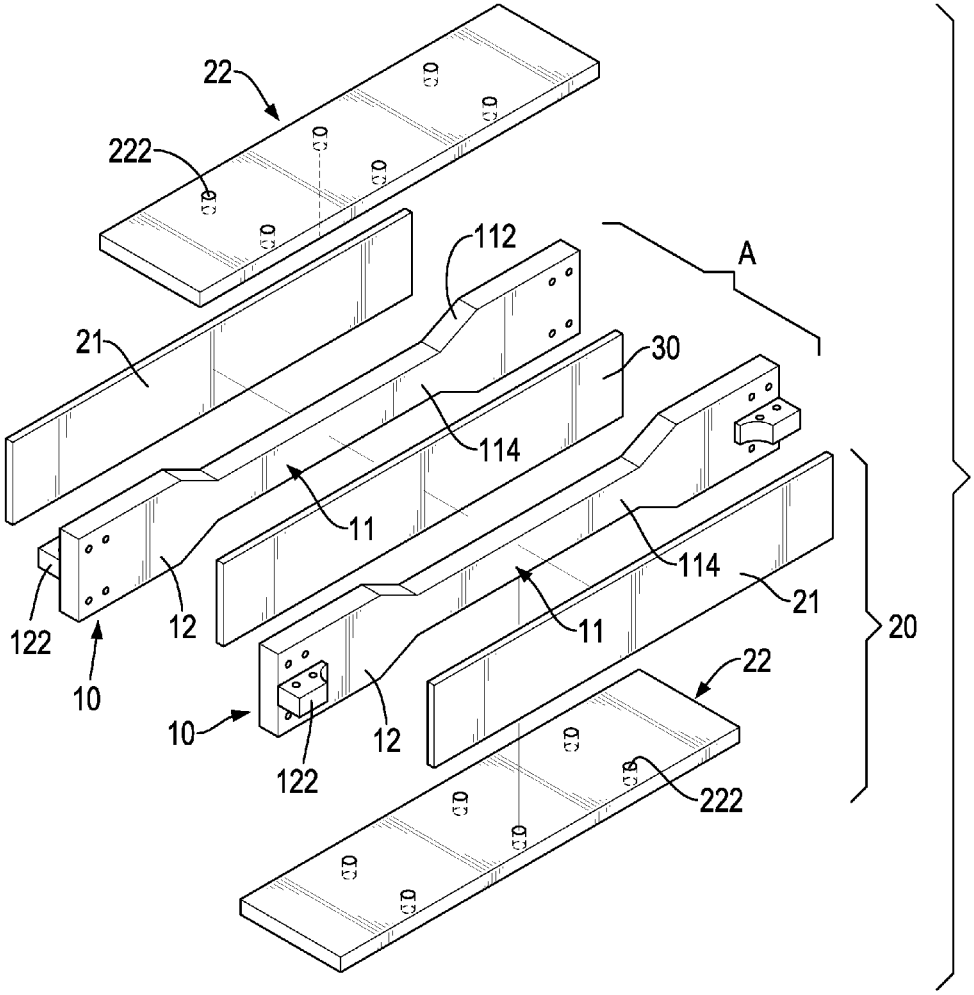
FIG. 50 is an exploded perspective view of a forty-sixth embodiment of a bracing device in accordance with the present invention.
Figure 51:
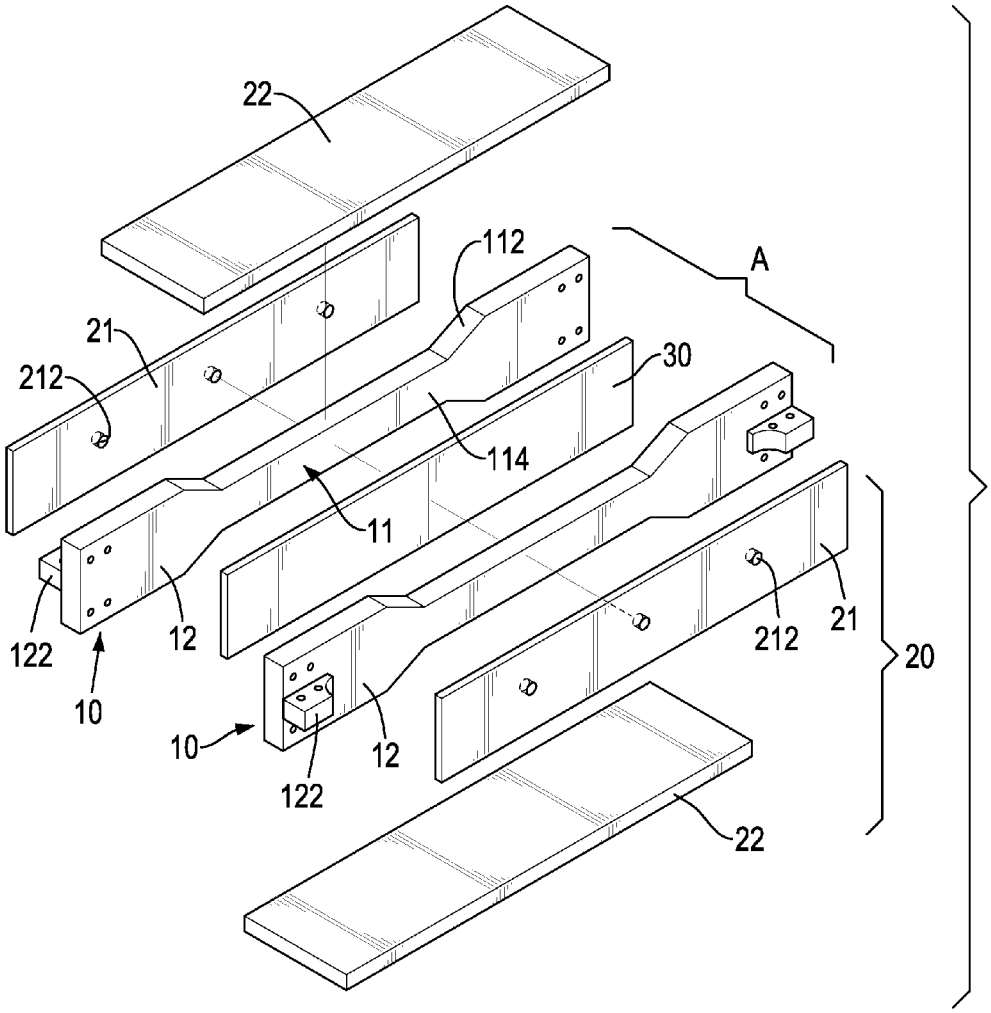
FIG. 51 is an exploded perspective view of a forty-seventh embodiment of a bracing device in accordance with the present invention.
Figure 52:
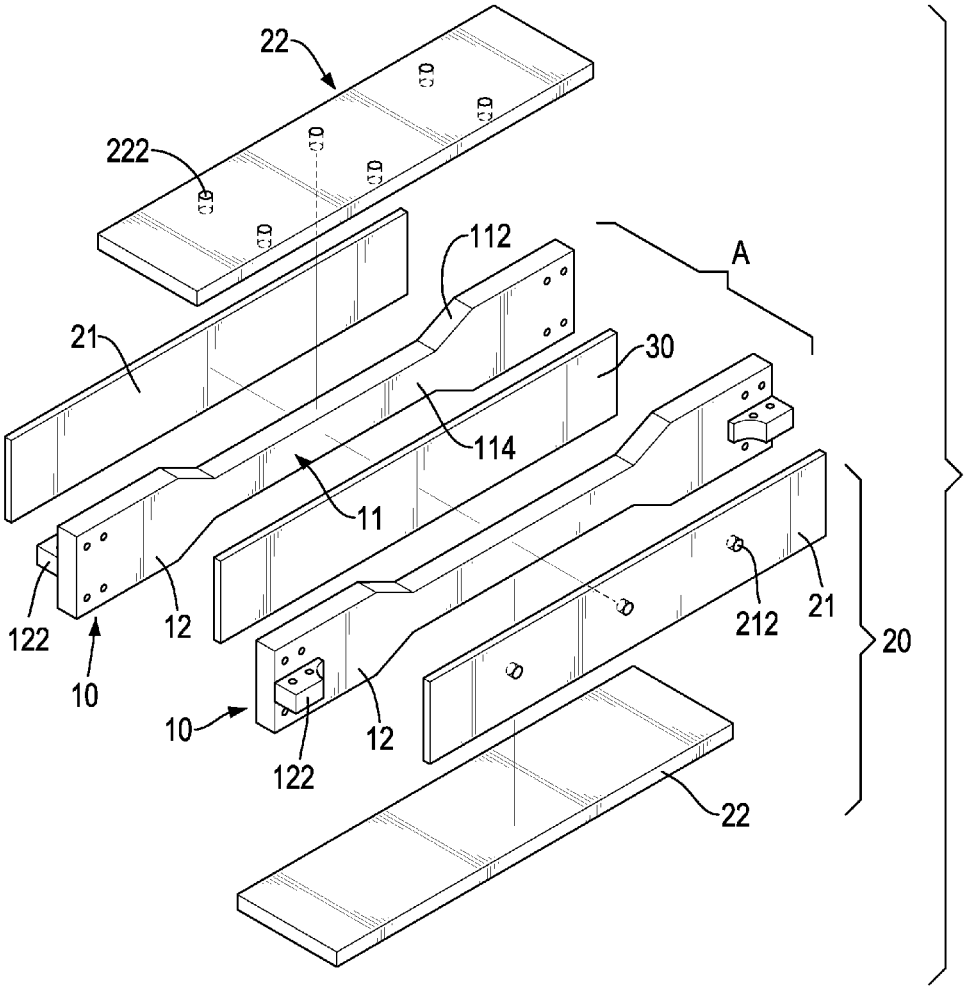
FIG. 52 is an exploded perspective view of a forty-eighth embodiment of a bracing device in accordance with the present invention.
Figure 53:
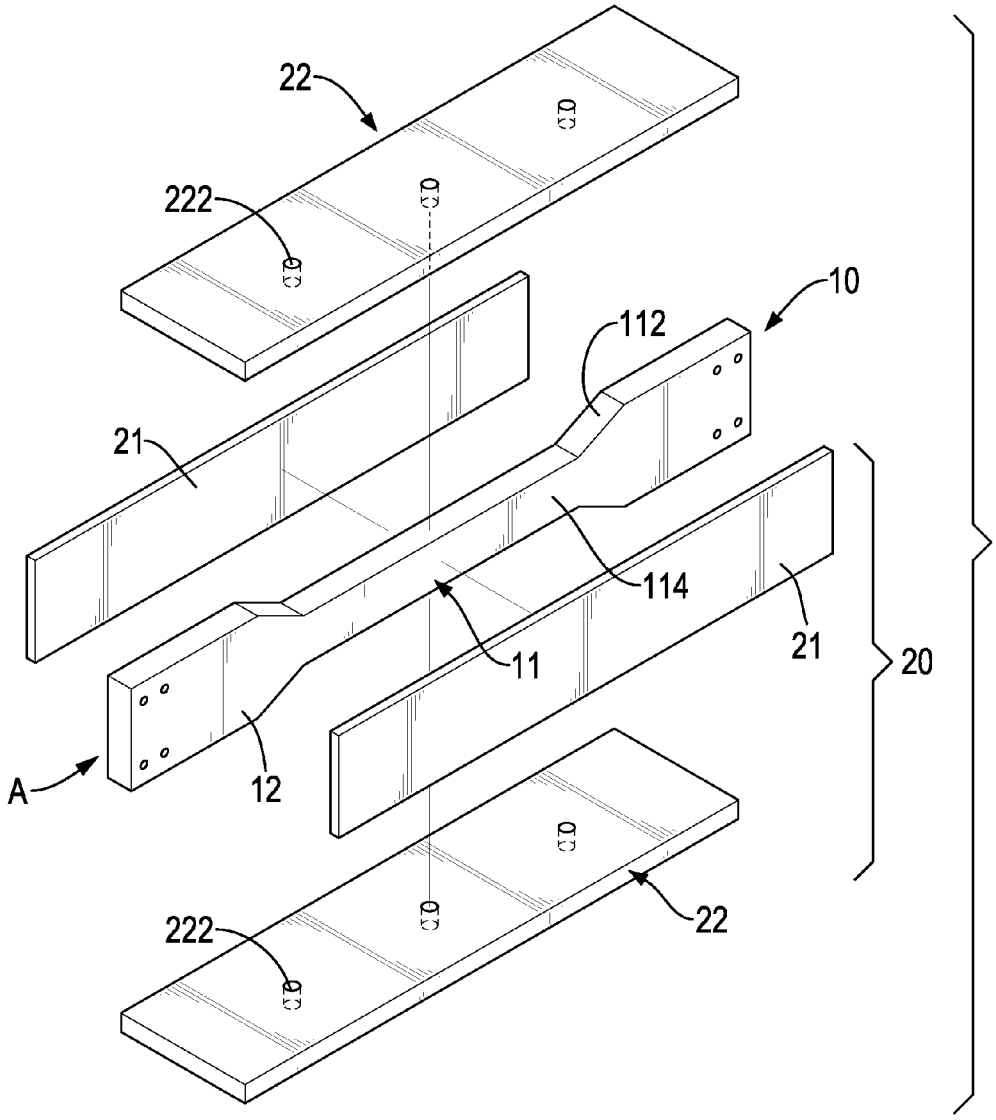
FIG. 53 is an exploded perspective view of a forty-ninth embodiment of a bracing device in accordance with the present invention.
Figure 54:
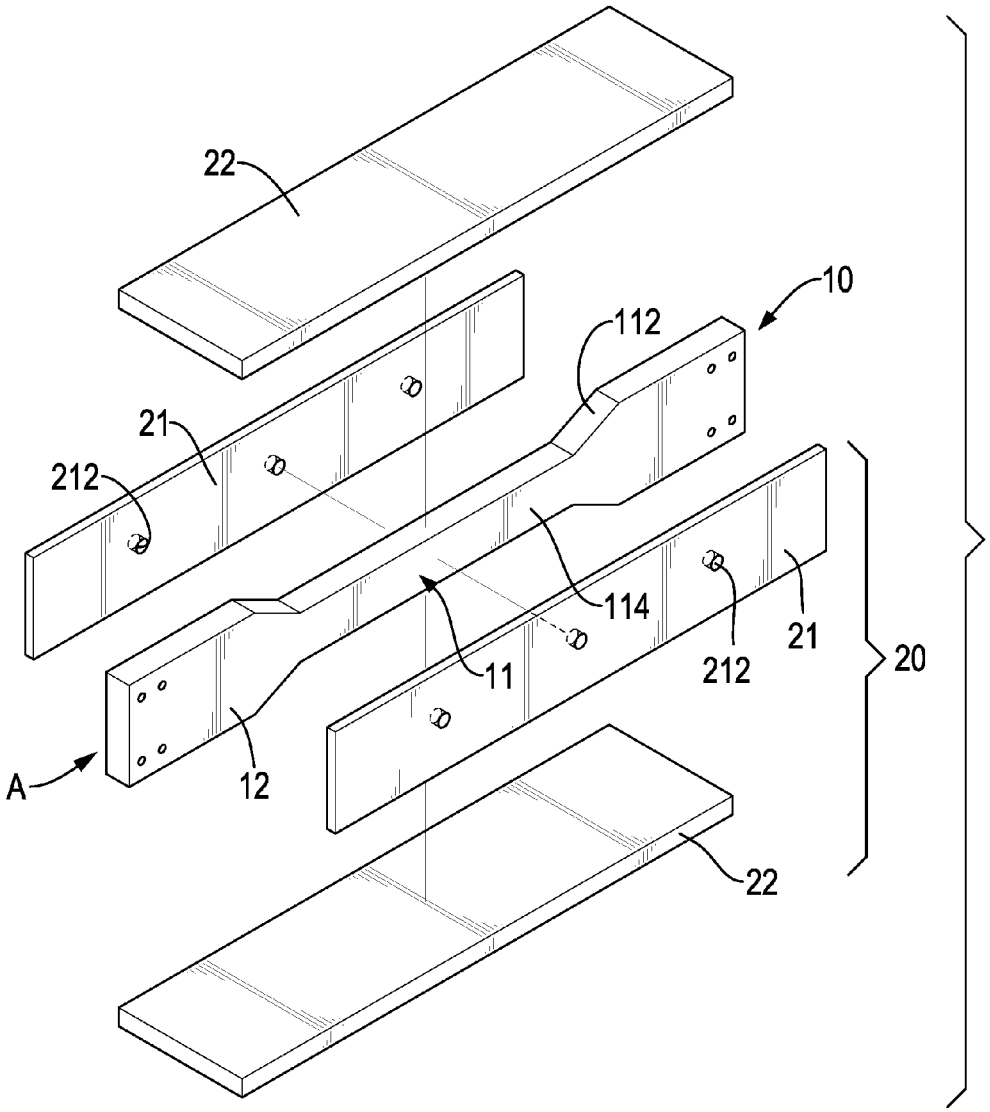
FIG. 54 is an exploded perspective view of a fiftieth embodiment of a bracing device in accordance with the present invention.
Figure 55:
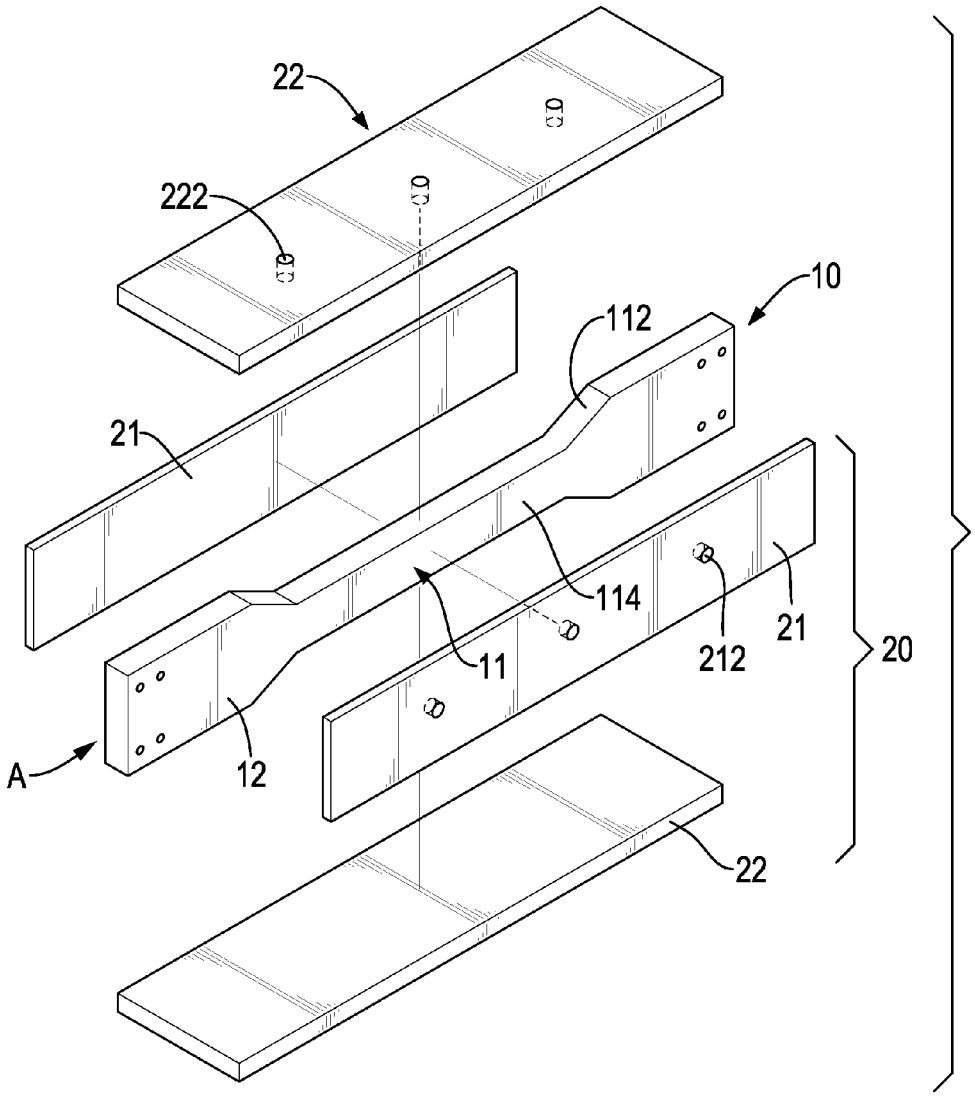
FIG. 55 is an exploded perspective view of a fifty-first embodiment of a bracing device in accordance with the present invention.
Figure 56:
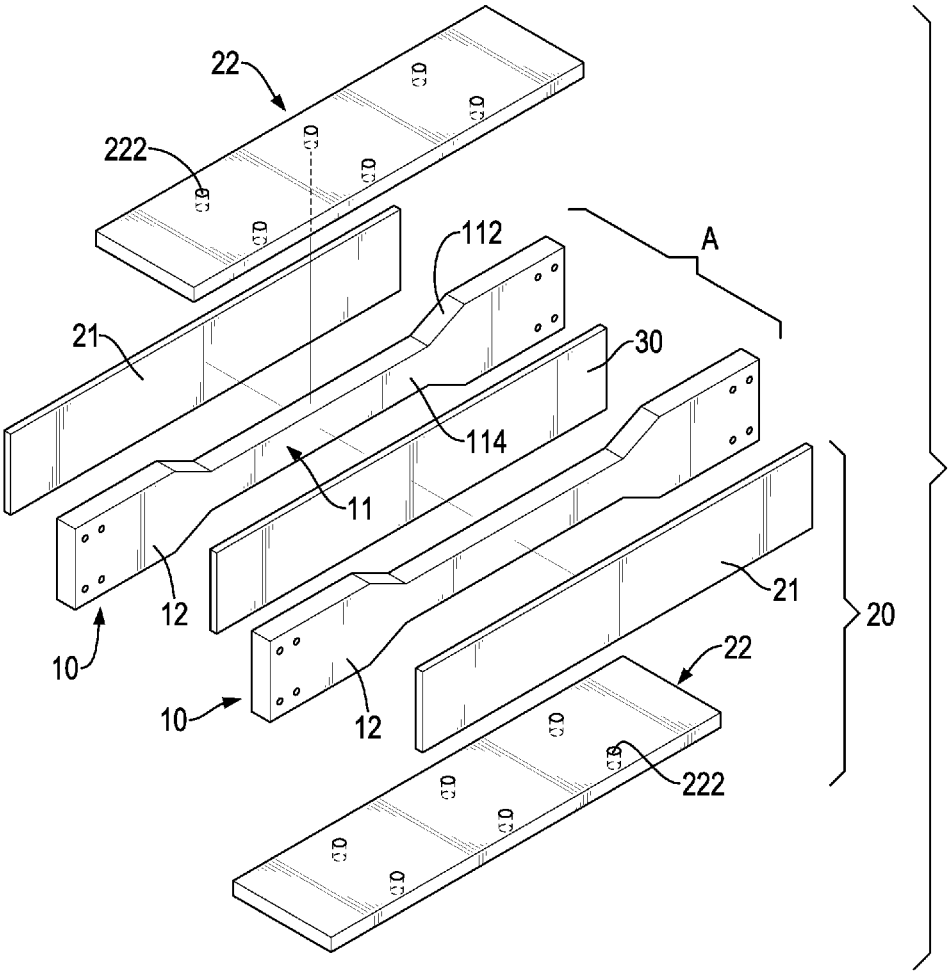
FIG. 56 is an exploded perspective view of a fifty-second embodiment of a bracing device in accordance with the present invention.
Figure 57:
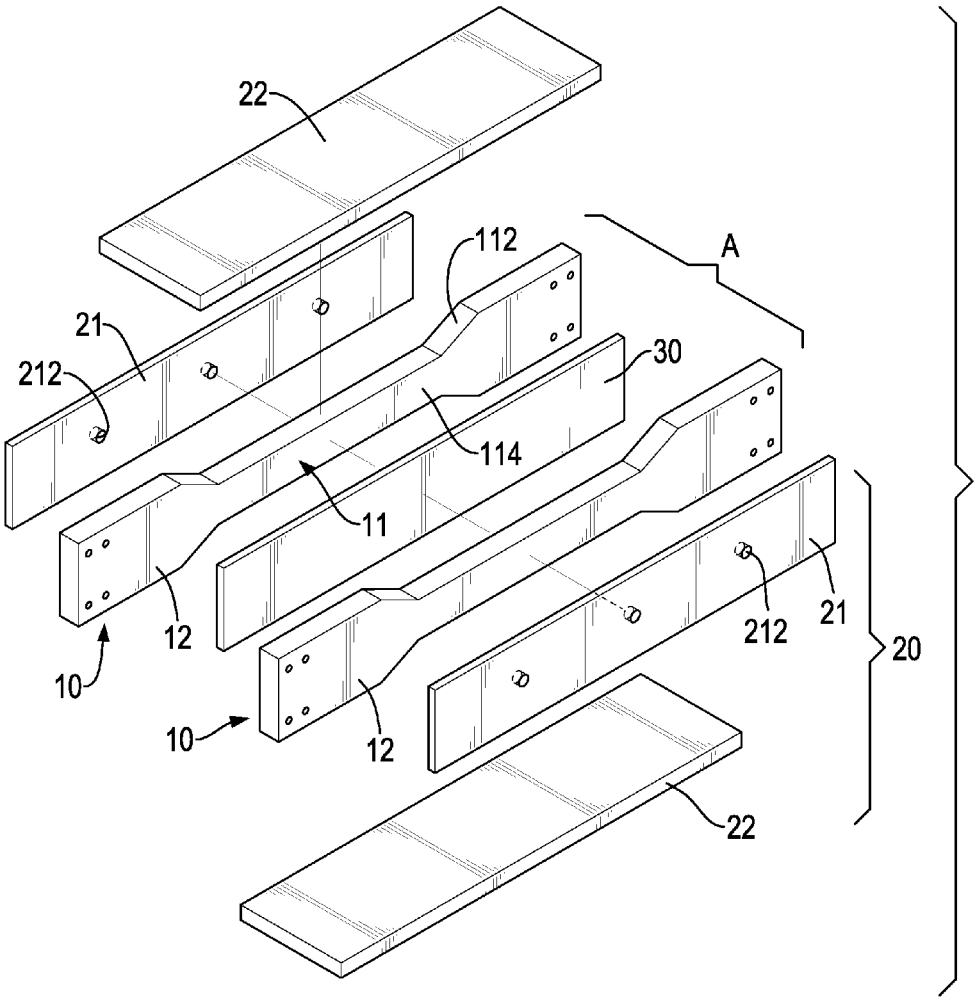
FIG. 57 is an exploded perspective view of a fifty-third embodiment of a bracing device in accordance with the present invention.
Figure 58:
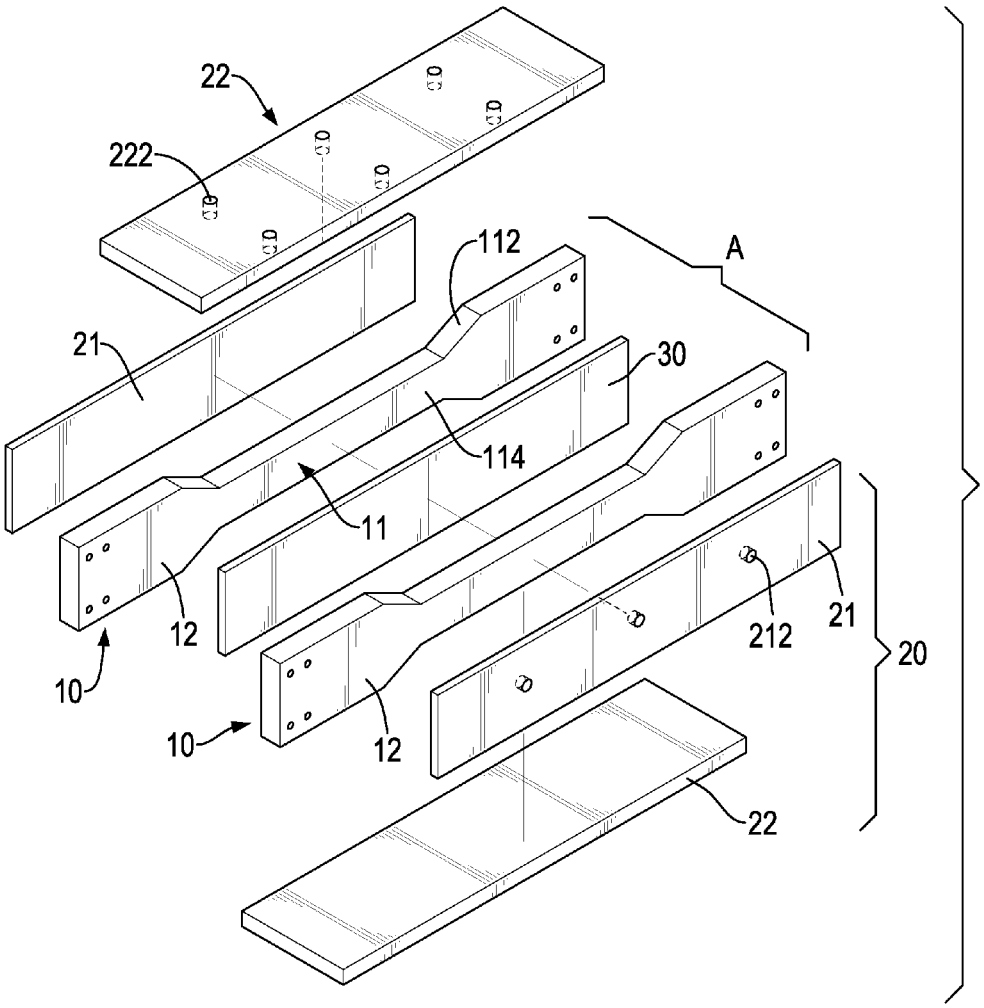
FIG. 58 is an exploded perspective view of a fifty-fourth embodiment of a bracing device in accordance with the present invention.
Figure 59:
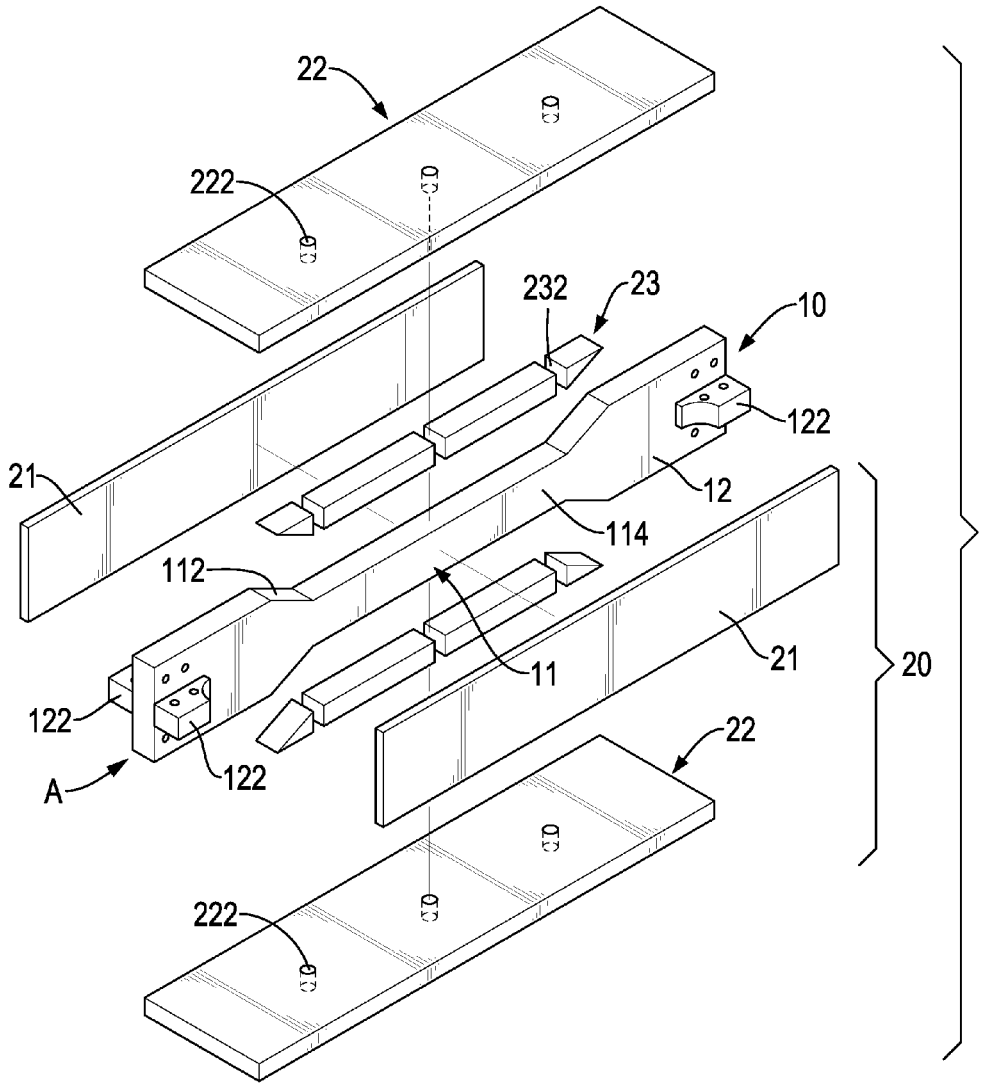
FIG. 59 is an exploded perspective view of a fifty-fifth embodiment of a bracing device in accordance with the present invention.
Figure 60:
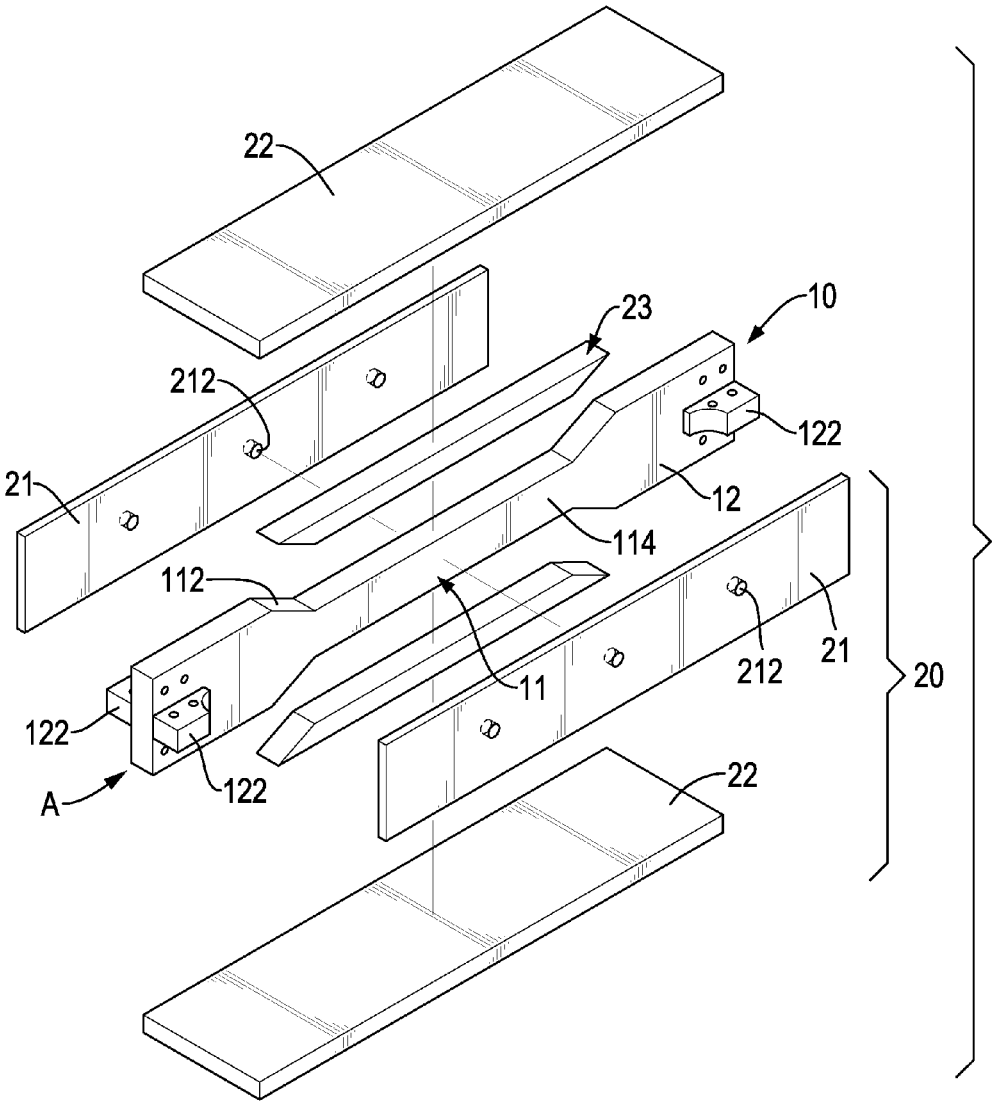
FIG. 60 is an exploded perspective view of a fifty-sixth embodiment of a bracing device in accordance with the present invention.
Figure 61:
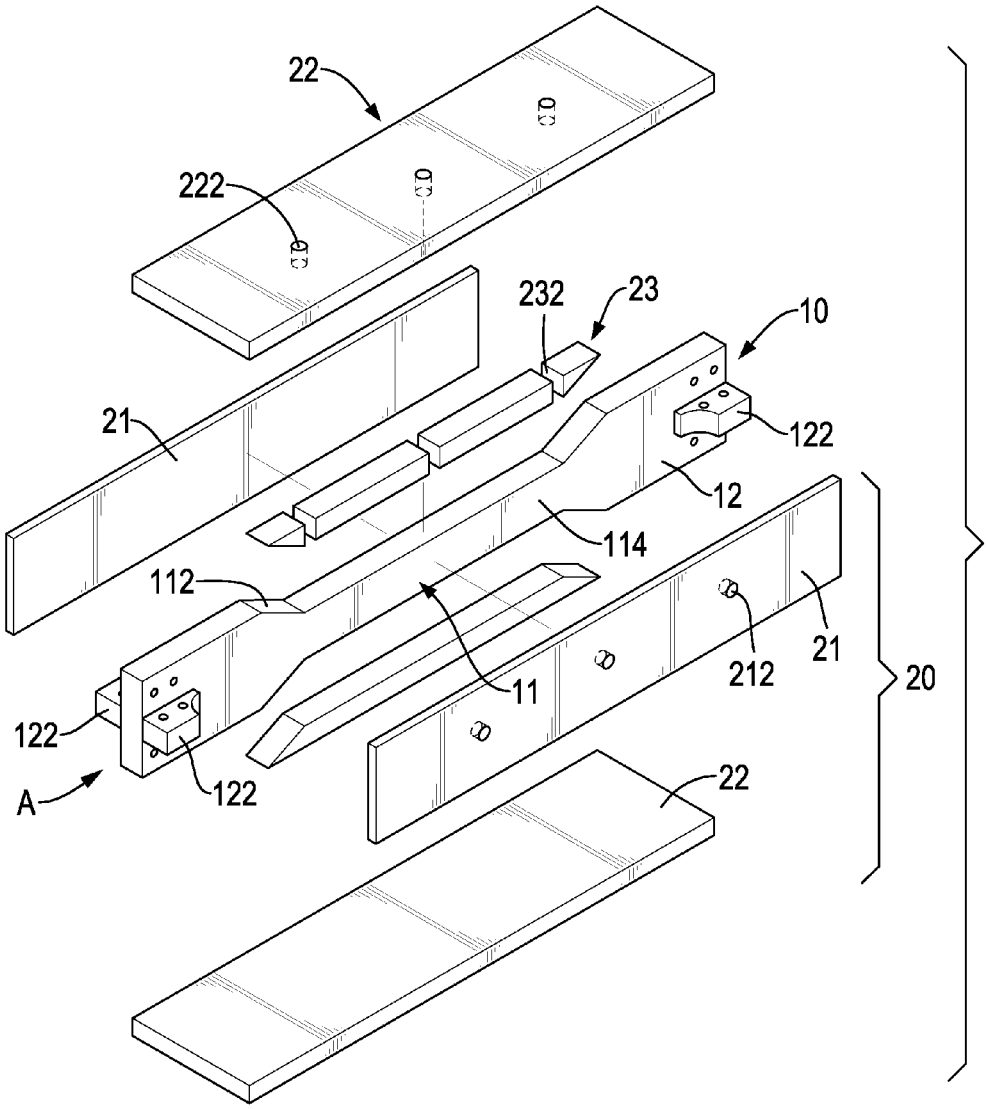
FIG. 61 is an exploded perspective view of a fifty-seventh embodiment of a bracing device in accordance with the present invention.
Figure 62:
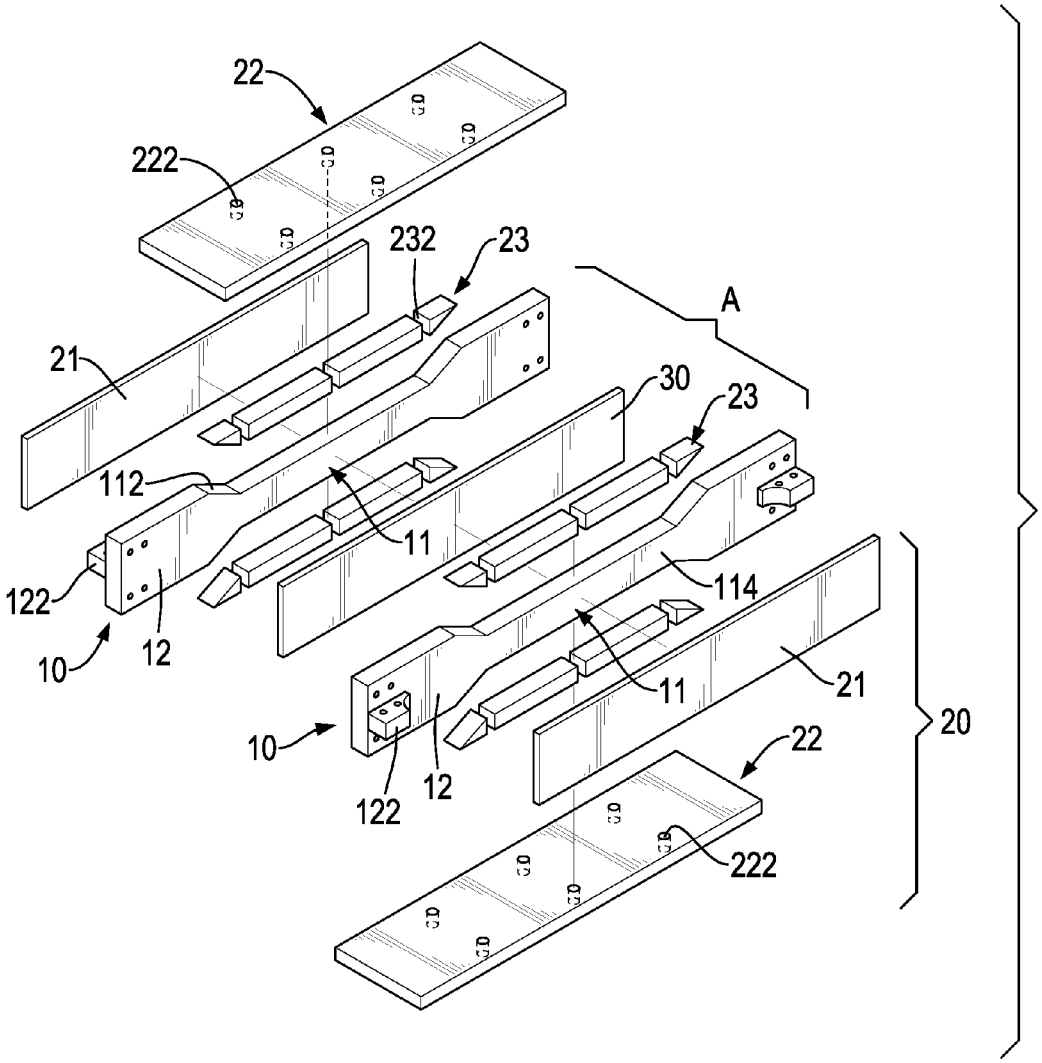
FIG. 62 is an exploded perspective view of a fifty-eighth embodiment of a bracing device in accordance with the present invention.
Figure 63:
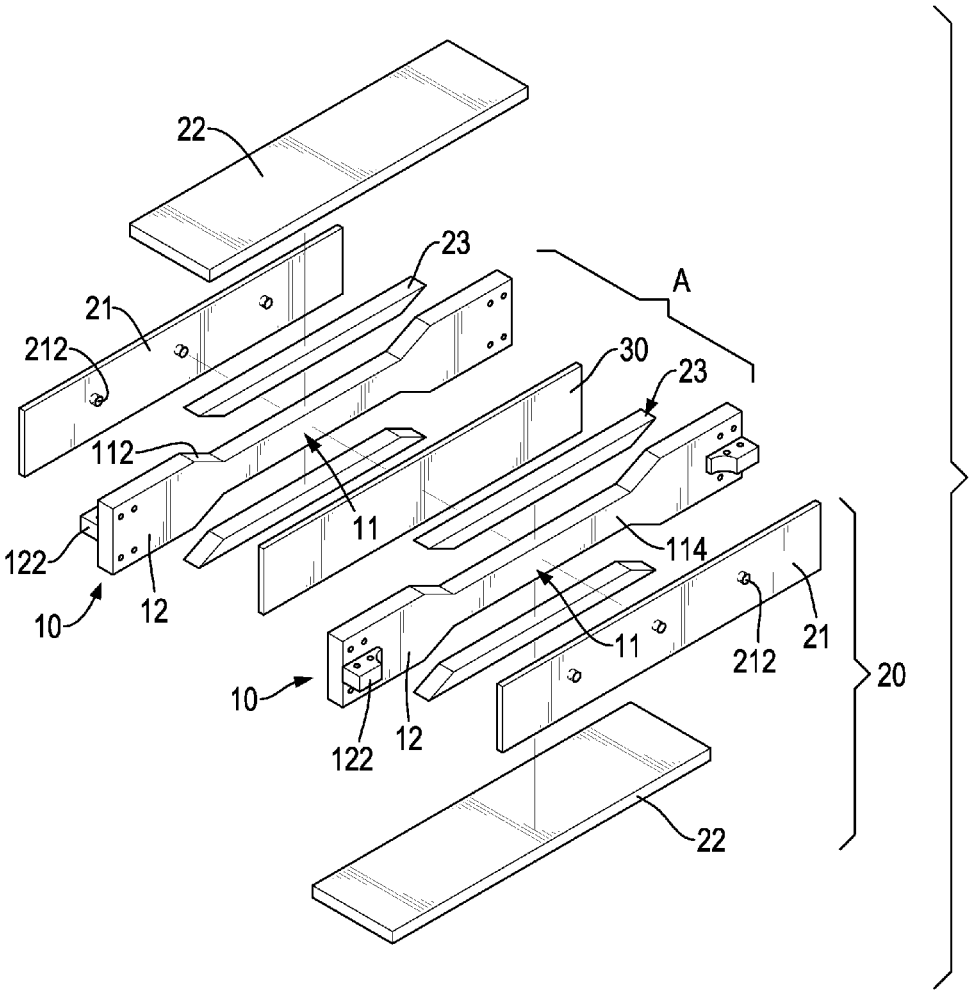
FIG. 63 is an exploded perspective view of a fifty-ninth embodiment of a bracing device in accordance with the present invention.
Figure 64:
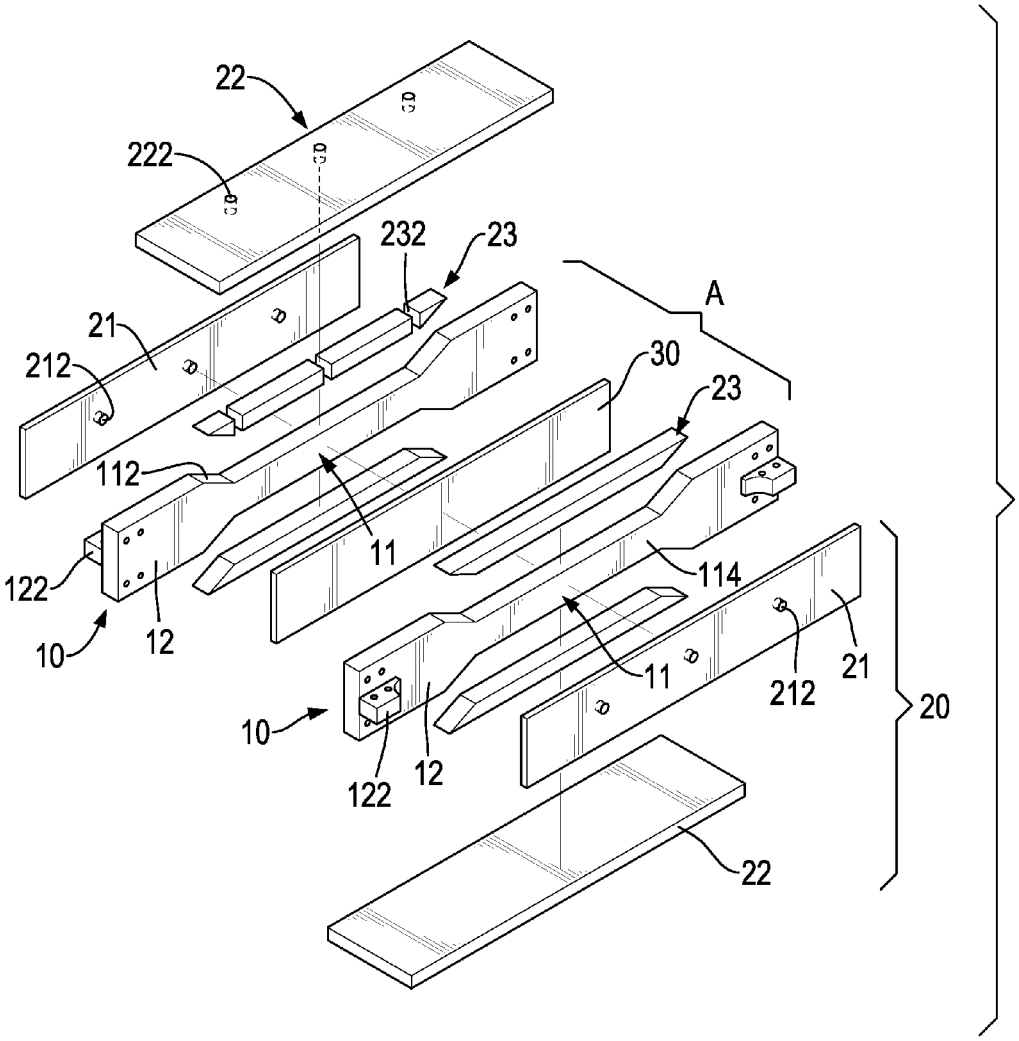
FIG. 64 is an exploded perspective view of a sixtieth embodiment of a bracing device in accordance with the present invention.
Figure 65:
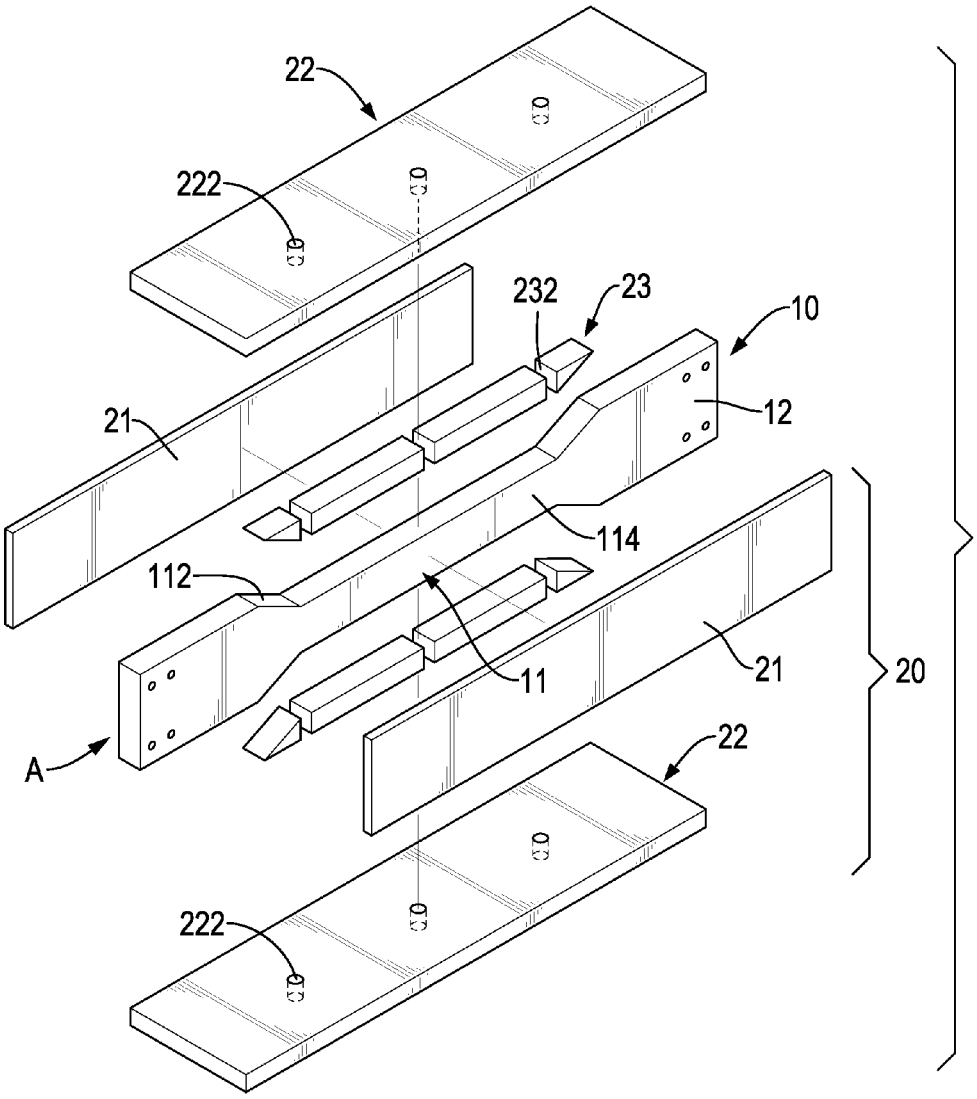
FIG. 65 is an exploded perspective view of a sixty-first embodiment of a bracing device in accordance with the present invention.
Figure 66:
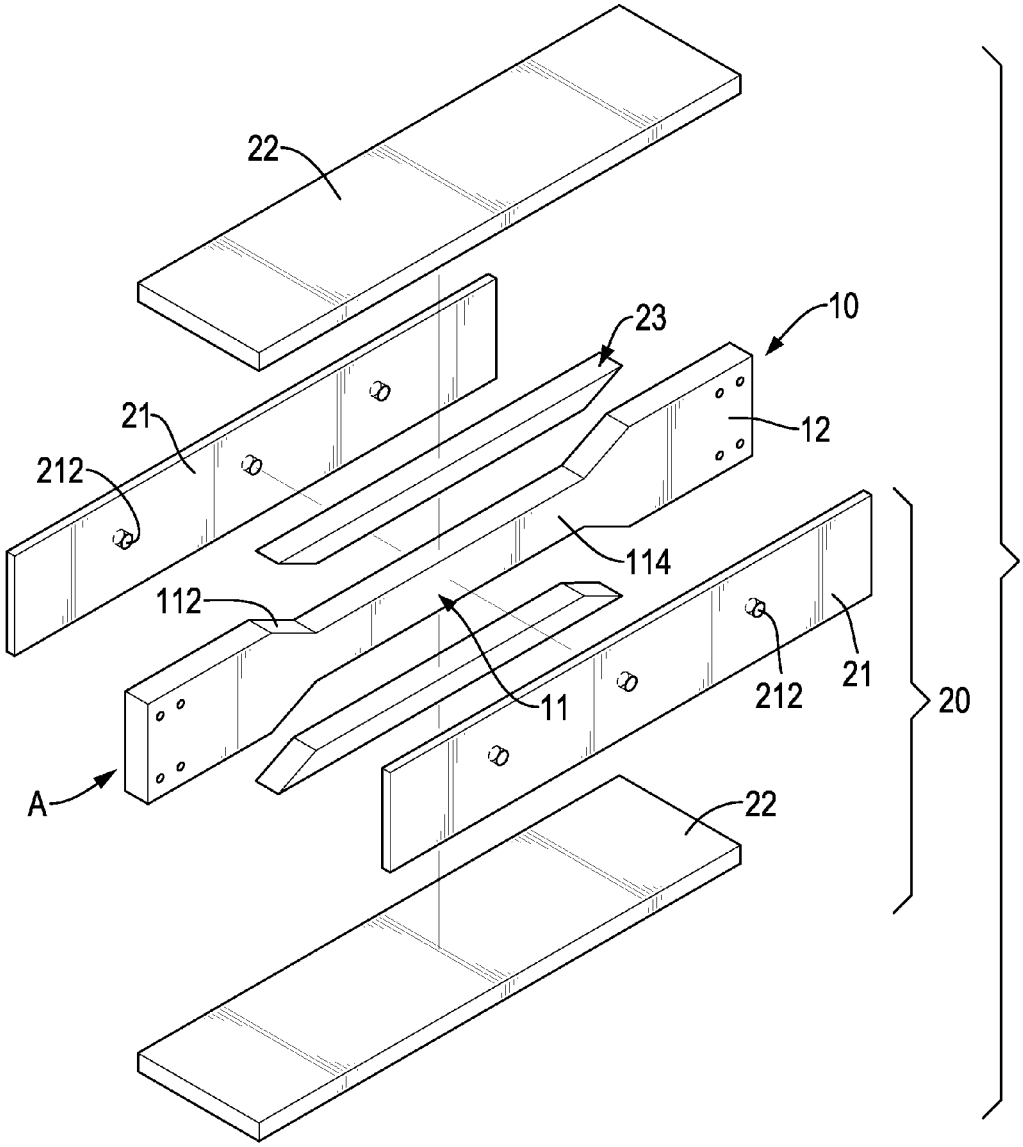
FIG. 66 is an exploded perspective view of a sixty-second embodiment of a bracing device in accordance with the present invention.
Figure 67:
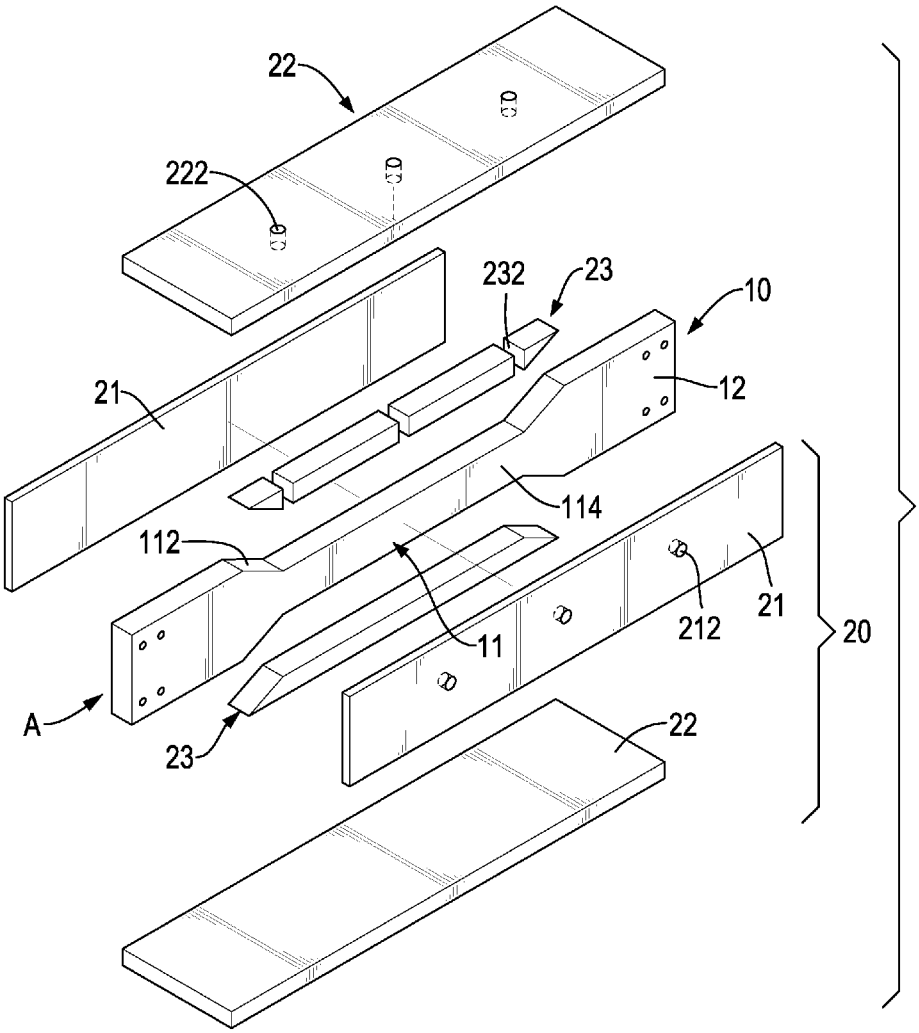
FIG. 67 is an exploded perspective view of a sixty-third embodiment of a bracing device in accordance with the present invention.
Figure 68:
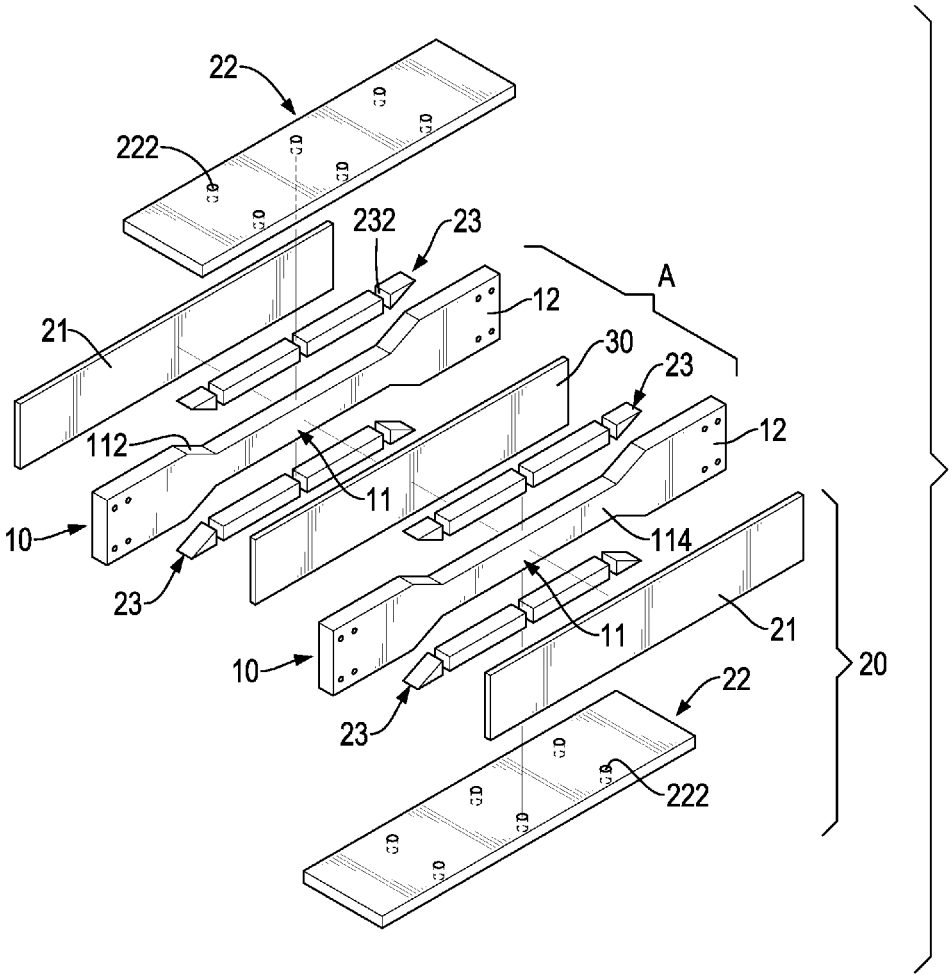
FIG. 68 is an exploded perspective view of a sixty-fourth embodiment of a bracing device in accordance with the present invention.
Figure 69:
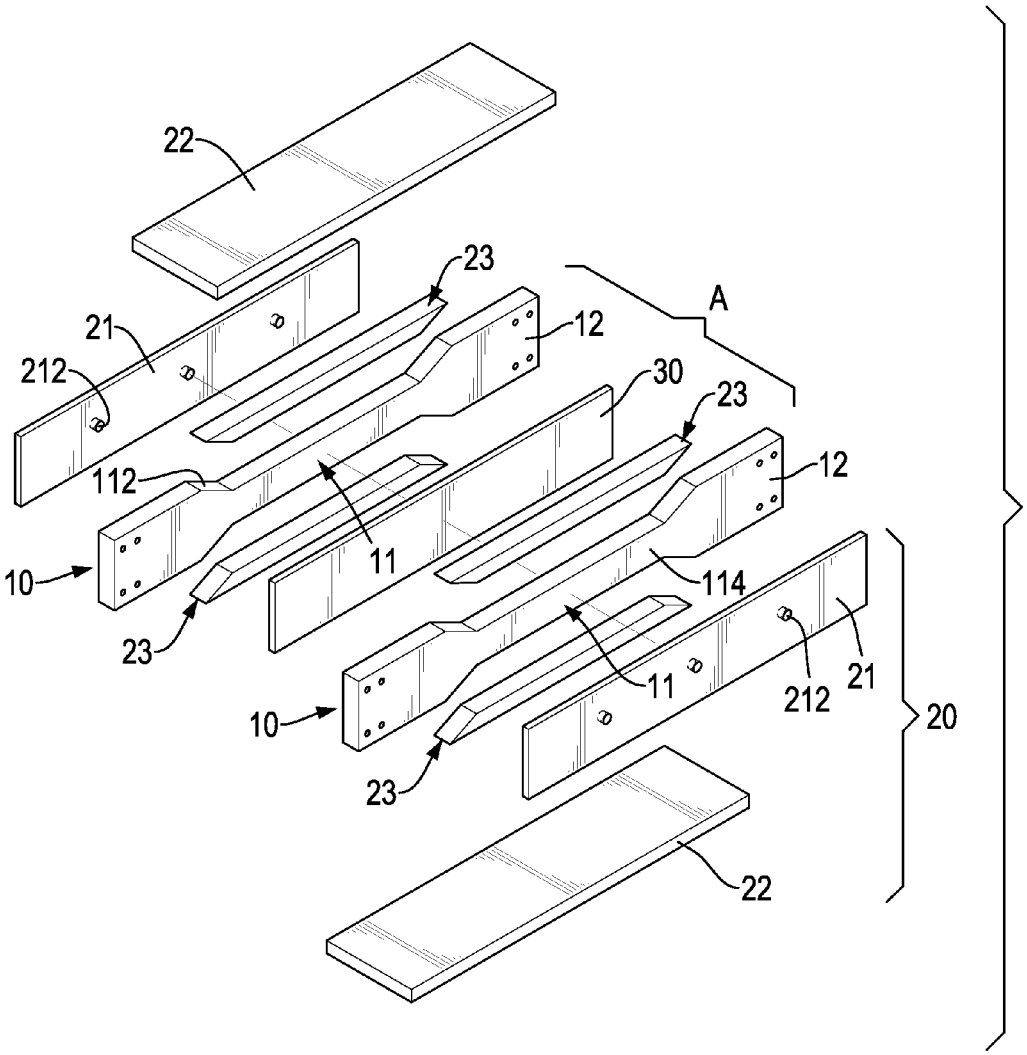
FIG. 69 is an exploded perspective view of a sixty-fifth embodiment of a bracing device in accordance with the present invention.
Figure 70:
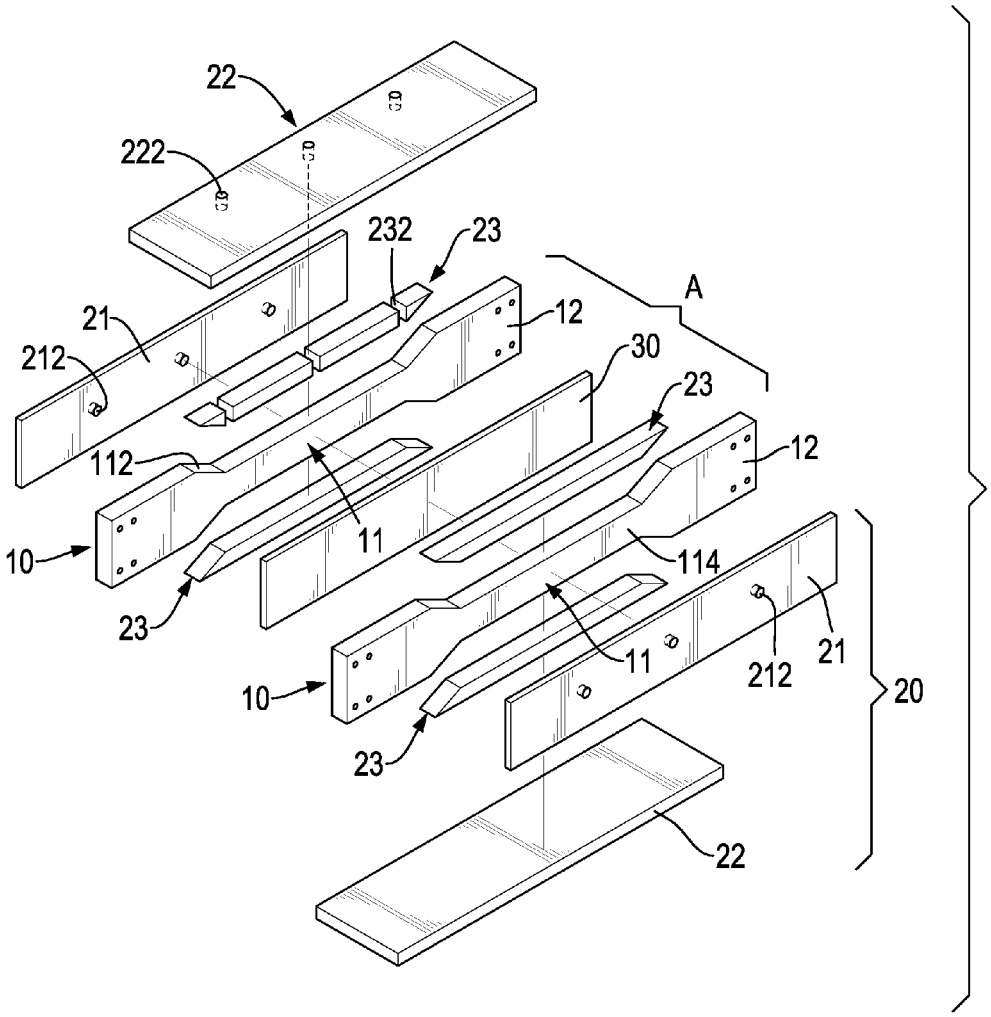
FIG. 70 is an exploded perspective view of a sixty-sixth embodiment of a bracing device in accordance with the present invention.
Figure 71:
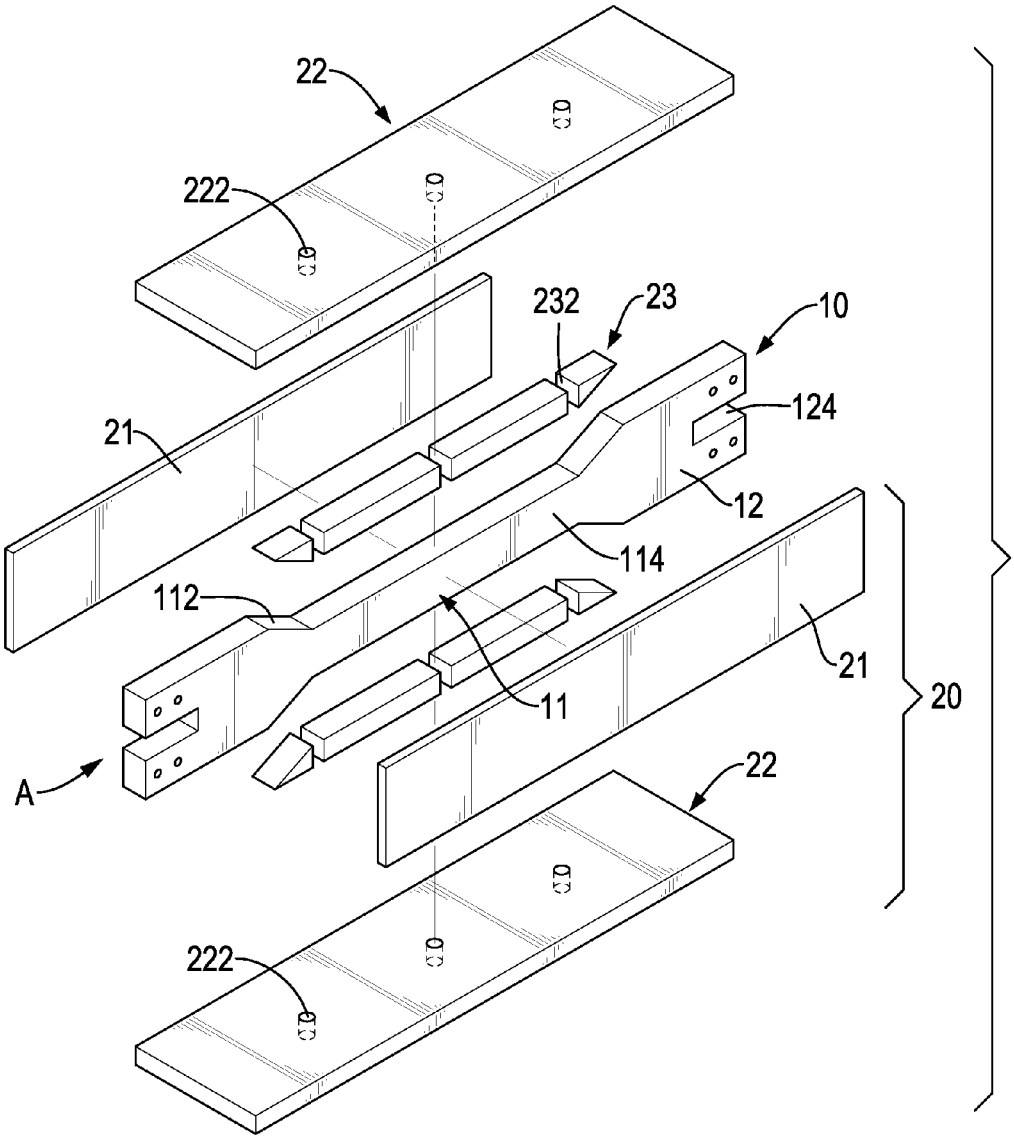
FIG. 71 is an exploded perspective view of a sixty-seventh embodiment of a bracing device in accordance with the present invention.
Figure 72:
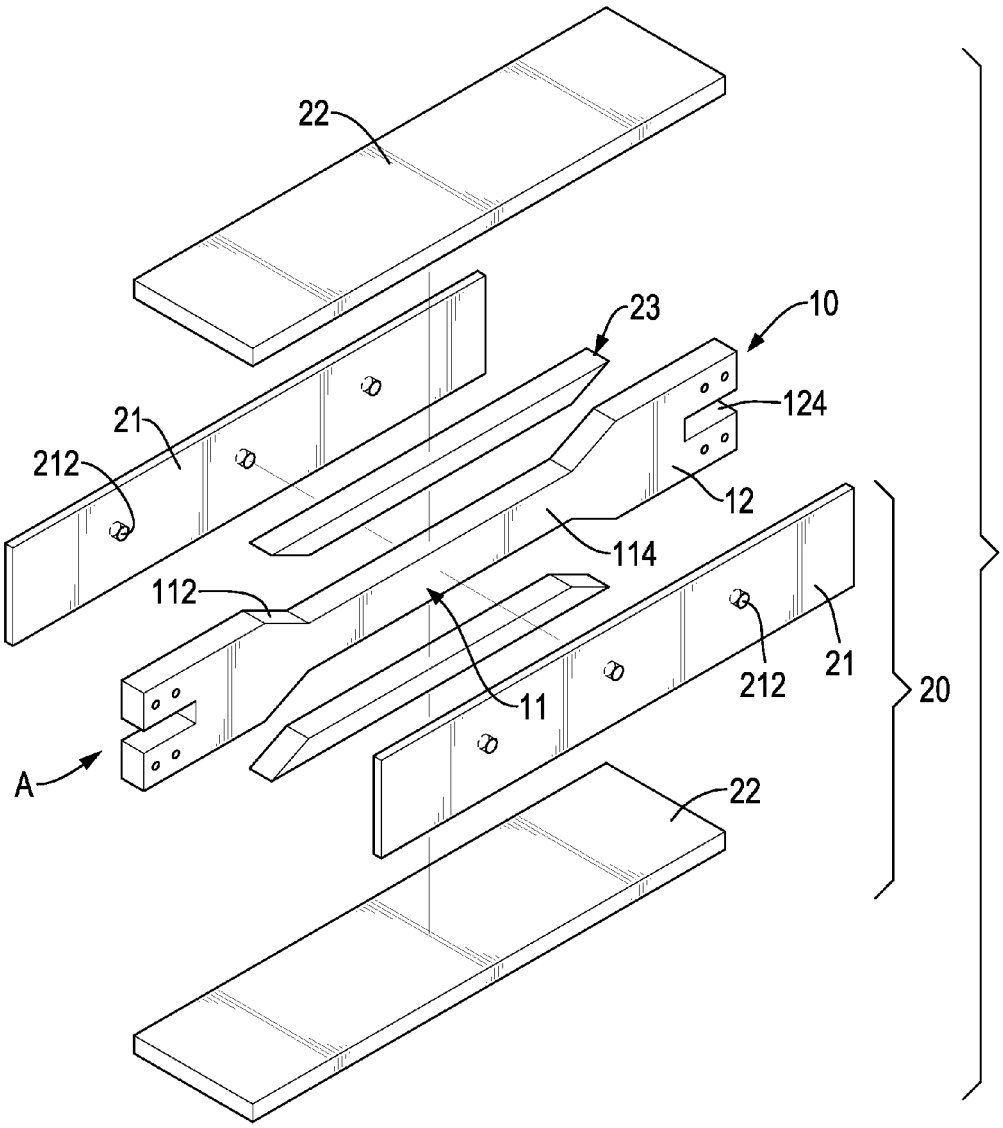
FIG. 72 is an exploded perspective view of a sixty-eighth embodiment of a bracing device in accordance with the present invention.
Figure 73:
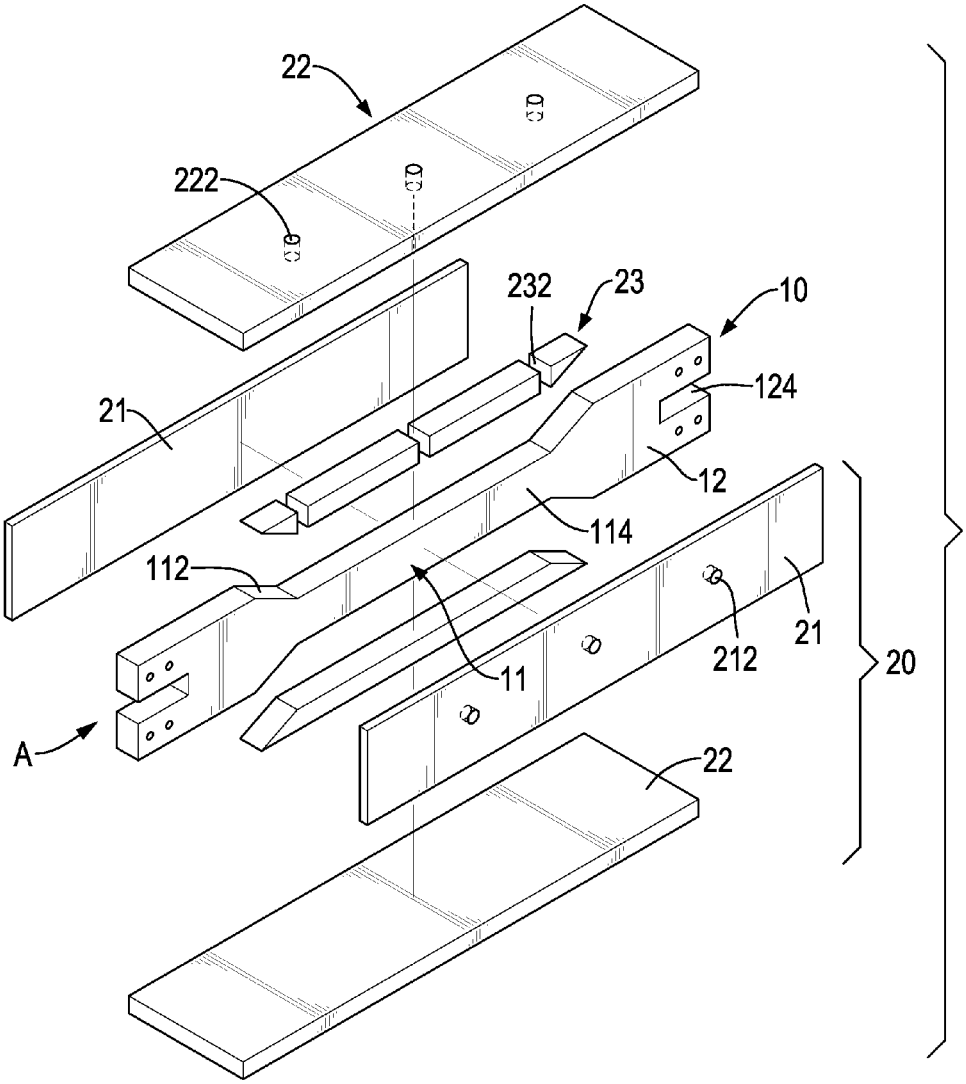
FIG. 73 is an exploded perspective view of a sixty-ninth embodiment of a bracing device in accordance with the present invention.
Figure 74:
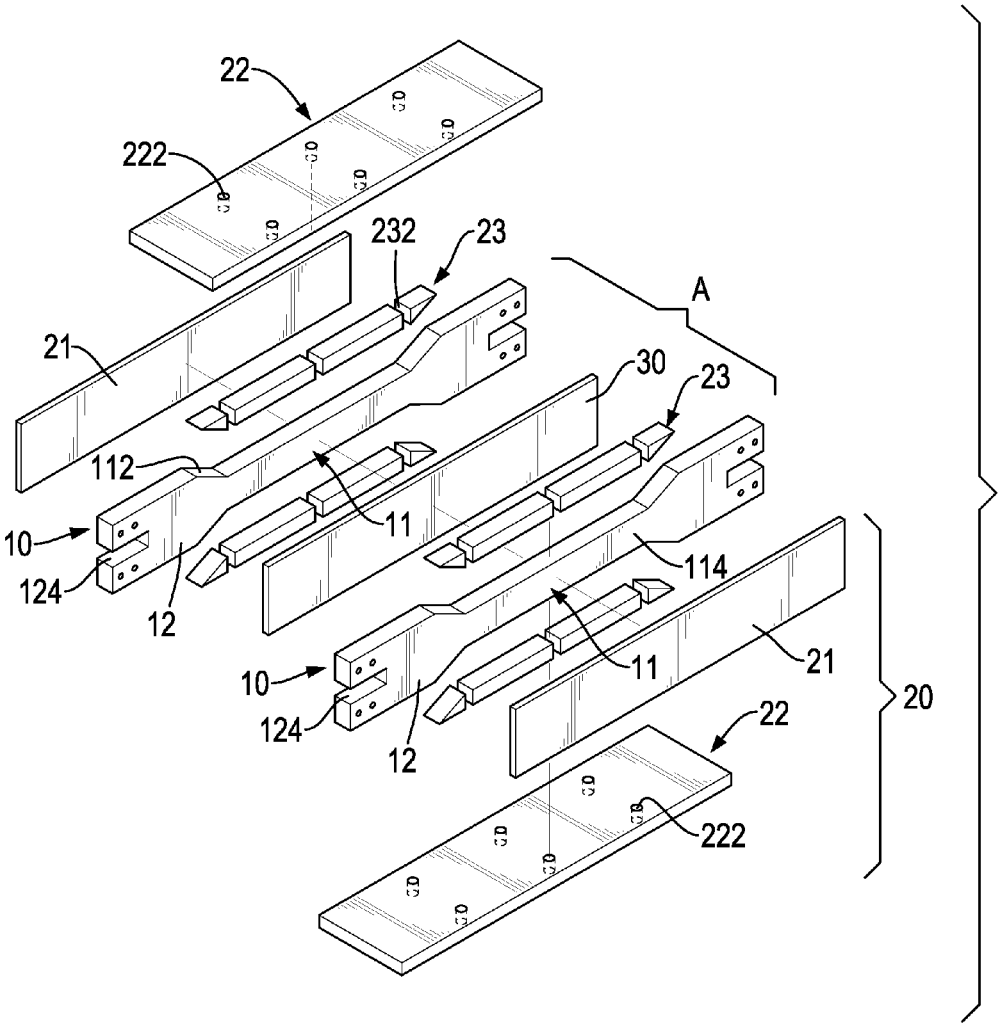
FIG. 74 is an exploded perspective view of a seventieth embodiment of a bracing device in accordance with the present invention.
Figure 75:
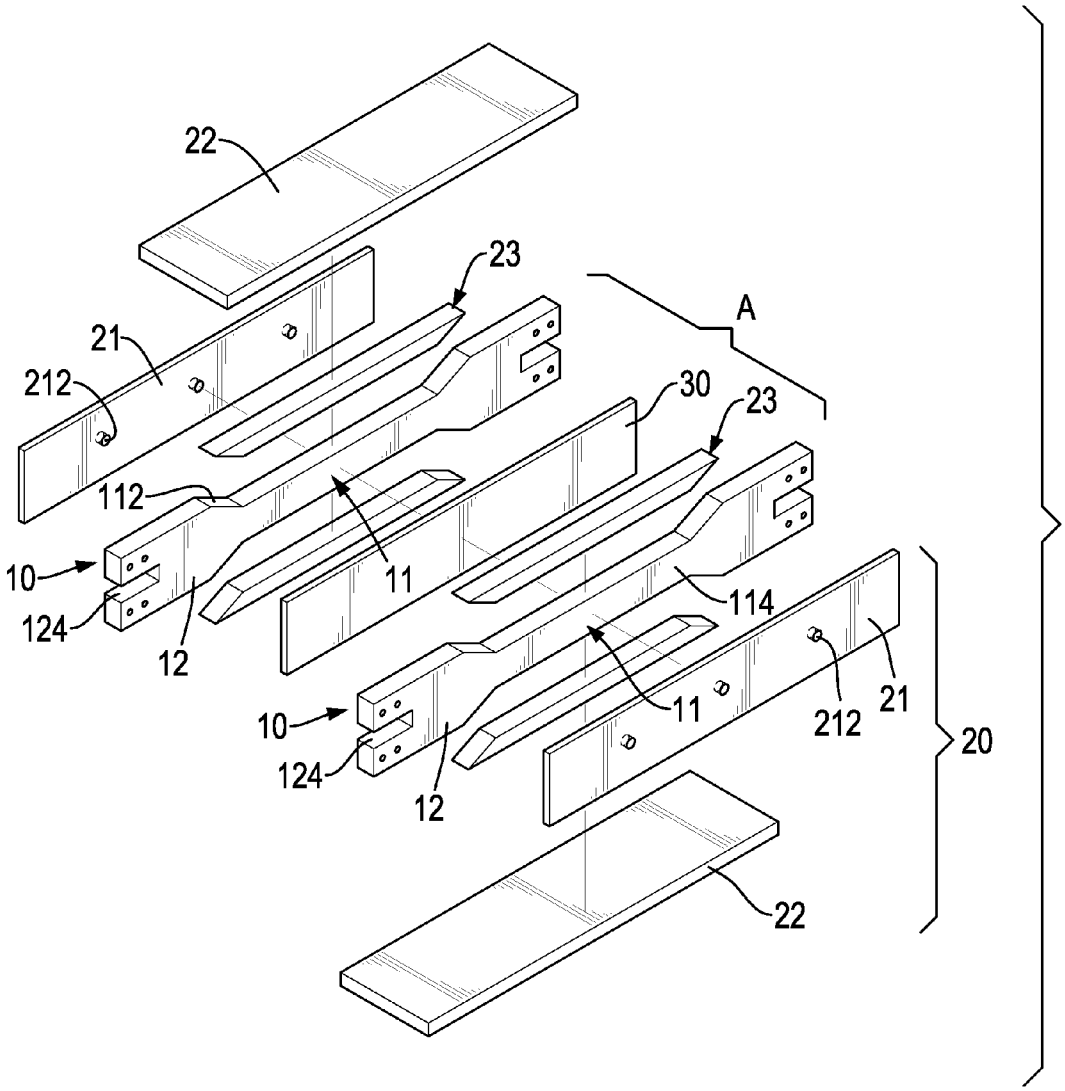
FIG. 75 is an exploded perspective view of a seventy-first embodiment of a bracing device in accordance with the present invention.
Figure 76:
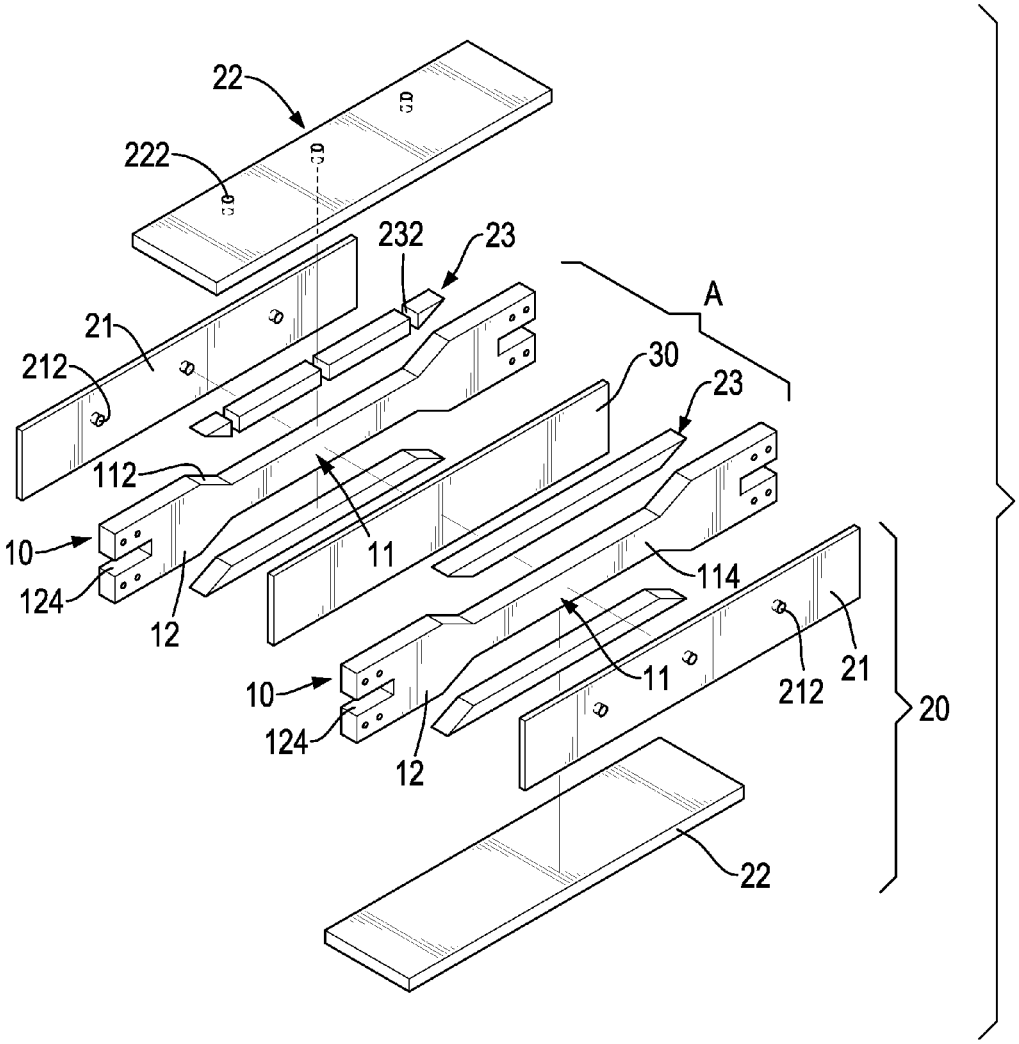
FIG. 76 is an exploded perspective view of a seventy-second embodiment of a bracing device in accordance with the present invention.

With reference to FIG. 34, a thirtieth embodiment of a bracing device in accordance with the present invention is and substantially the same as the twenty-eighth embodiment in FIG. 32 except the following features. Each one of the side boards 21 has six viewing holes 212 and one of the restraining boards 22 has six viewing holes 222 to see the loading sections 114 of the supporting elements 10. In addition, the positioning elements 23 of the restraining element 20 that align along the viewing holes 222 of the corresponding restraining board 22 each has three viewing holes 232.

With reference to FIGS. 35 to 40, thirty-first to thirty sixth embodiments of a bracing device in accordance with the present invention are respectively and substantially the same as the twenty-fifth to thirtieth embodiments in FIGS. 27 and 30 to 34 except the following features. Each one or at least one of the connecting heads 12 of each supporting element 10 is flat-shaped without having the connecting blocks 122, and the connecting holes are formed through the connecting head 12.

With reference to FIGS. 41 to 46, thirty-seventh to forty-second embodiments of a bracing device in accordance with the present invention are respectively and substantially the same as the twenty-fifth to thirtieth embodiments in FIGS. 27 and 30 to 34 except the following features. Each one or at least one of the connecting heads 12 of each supporting element 10 is flat-shaped without having the connecting blocks 122, and the connecting holes are formed through the connecting head 12. In addition, each one or at least one of the connecting heads 12 of each supporting element 10 has a connecting notch 124 formed through the connecting head 12 between the connecting holes.

With reference to FIGS. 47 to 52, forty-third to forty-eighth embodiments of a bracing device in accordance with the present invention are respectively and substantially the same as the nineteenth to twenty-fourth embodiments in FIGS. 21 to 26 except the following features. Each one or at least one of the connecting heads 12 of each supporting element 10 is a cross shaped or T-shaped and has multiple connecting holes.

With reference to FIGS. 53 to 58, forty-ninth to fifty-fourth embodiments of a bracing device in accordance with the present invention are respectively and substantially the same as the nineteenth to twenty-fourth embodiments in FIGS. 21 to 26 except the following features. Each one or at least one of the connecting heads 12 of each supporting element 10 is flat-shaped without having the connecting blocks 122, and the connecting holes are formed through the connecting head 12.

With reference to FIGS. 59 to 76, fifty-fifth to seventy-second embodiments of a bracing device in accordance with the present invention are respectively and substantially the same as the twenty-fifth to forty-second embodiments in FIGS. 27 and 30 to 46 except the following features. Each one of the supporting elements 10 has two concave edges 112 respectively formed in the first side and the second side of the axial segment 11 of the supporting element 10, and a loading section 114 formed on the axial segment 11 between the two concave edges 112. In addition, the restraining element 20 has a positioning element 23 mounted in each one of the concave edges 112 of each one of the supporting elements 10.

According to the above-mentioned embodiments of the bracing device in accordance with the present invention, after the earthquake or the strong wind, the user or an inspector can easily and conveniently see and inspect the damage and conditions of the loading sections 114 of each one of the at least one supporting element 10 of the supporting module A via the viewing holes 212, 222, 232 of the side boards 21, the restraining boards 22 and the positioning elements 23 without dismantling the restraining element 20 from the supporting module A. Then, the cost and process of re-constructing the restraining element 20 are naturally disappeared. In addition, the inspector can inspect the structural strength of the supporting module A of the bracing device to ensure the structural safety of the building.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bracing device comprising:

a supporting module having at least one supporting element, and each one of the at least one supporting element having an axial segment being elongated-plate-shaped and having a first side;

a second side;

two connecting ends;

at least one concave edge formed in the first side or the second side of the axial segment; and at least one loading section formed on the axial segment at a position corresponding to the at least one concave edge between the connecting ends of the axial segment; and two connecting heads respectively formed on the connecting ends of the axial segment; and a restraining element mounted around the supporting module to provide a restraining-supporting effect to the supporting module and having at least one viewing hole aligning along the at least one concave edge of the axial segment of the at least one supporting element to enable a user to see and inspect the at least one supporting element of the bracing device without dismantling the restraining element from the supporting module.

2. The bracing device as claimed in claim 1, wherein the restraining element has two side boards abutting on the axial segment of each one of the at least one supporting element, and each one of the side boards having a first side and a second side; and two restraining boards respectively and securely mounted on the first sides and the second sides of the side boards.

3. The bracing device as claimed in claim 2, wherein at least one of the restraining boards has at least one viewing hole formed through the restraining board and aligning along the at least one loading section of the axial segment of each one of the at least one supporting element.

4. The bracing device as claimed in claim 3, wherein the supporting module has one supporting element.

5. The bracing device as claimed in claim 4, wherein each one of the connecting heads of the supporting element is one of flat-shaped, cross shaped, T-shaped or flat-shaped with a connecting notch.

6. The bracing device as claimed in claim 4, wherein the supporting module has one supporting element; and the restraining element has a positioning element mounted in each one of the at least one concave edge of the supporting element.

7. The bracing device as claimed in claim 6, wherein each positioning element has at least one viewing hole formed through the positioning element and aligning along at least one viewing hole of each one of the at least one of the restraining boards.

8. The bracing device as claimed in claim 3, wherein the supporting module has one supporting element; and the restraining element has a positioning element mounted in each one of the at least one concave edge of the supporting element.

9. The bracing device as claimed in claim 8, wherein each positioning element has at least one viewing hole formed through the positioning element and aligning along at least one viewing hole of each one of the at least one of the restraining boards.

10. The bracing device as claimed in claim 3, wherein each positioning element has at least one viewing hole formed through the positioning element and aligning along at least one viewing hole of each one of the at least one of the restraining boards.

11. The bracing device as claimed in claim 3, wherein the supporting module has a connecting board being elongated-plate-shaped and having two sidewalls; and two supporting elements respectively abutting on the sidewalls of the connecting board.

12. The bracing device as claimed in claim 11, wherein each one of the connecting heads of each supporting element is one of flat-shaped, cross shaped, T-shaped or flat-shaped with a connecting notch.

13. The bracing device as claimed in claim 3, wherein the supporting module has a connecting board being elongated-plate-shaped and having two sidewalls; and two supporting elements respectively abutting on the sidewalls of the connecting board; and the restraining element has a positioning element mounted in and corresponding to each one of the at least one concave edge of each one of the supporting elements.

14. The bracing device as claimed in claim 13, wherein each positioning element has at least one viewing hole formed through the positioning element and aligning along at least one viewing hole of each one of the at least one of the restraining boards.

15. The bracing device as claimed in claim 2, wherein at least one of the side boards has at least one viewing hole formed through the side board and aligning along the at least one loading section of the axial segment of each one of the at least one supporting element.

16. The bracing device as claimed in claim 15, wherein the supporting module has one supporting element.

17. The bracing device as claimed in claim 16, wherein each one of the connecting heads of the supporting element is one of flat-shaped, cross shaped, T-shaped or flat-shaped with a connecting notch.

18. The bracing device as claimed in claim 16, wherein the supporting module has one supporting element; and the restraining element has a positioning element mounted in each one of the at least one concave edge of the supporting element.

19. The bracing device as claimed in claim 15, wherein the supporting module has one supporting element; and the restraining element has a positioning element mounted in each one of the at least one concave edge of the supporting element.

20. The bracing device as claimed in claim 15, wherein the supporting module has a connecting board being elongated-plate-shaped and having two sidewalls; and two supporting elements respectively abutting on the sidewalls of the connecting board.

21. The bracing device as claimed in claim 20, wherein each one of the connecting heads of each supporting element is one of flat-shaped, cross shaped, T-shaped or flat-shaped with a connecting notch.

22. The bracing device as claimed in claim 15, wherein the supporting module has a connecting board being elongated-plate-shaped and having two sidewalls; and two supporting elements respectively abutting on the sidewalls of the connecting board; and the restraining element has a positioning element mounted in and corresponding to each one of the at least one concave edge of each one of the supporting elements.

23. The bracing device as claimed in claim 22, wherein each positioning element has at least one viewing hole formed through the positioning element and aligning along at least one viewing hole of each one of the at least one of the restraining boards.

24. The bracing device as claimed in claim 2, wherein the supporting module has one supporting element.

25. The bracing device as claimed in claim 24, wherein each one of the connecting heads of the supporting element is one of flat-shaped, cross shaped, T-shaped or flat-shaped with a connecting notch.

26. The bracing device as claimed in claim 24, wherein the supporting module has one supporting element; and the restraining element has a positioning element mounted in each one of the at least one concave edge of the supporting element.

27. The bracing device as claimed in claim 2, wherein the supporting module has one supporting element; and the restraining element has a positioning element mounted in each one of the at least one concave edge of the supporting element.

28. The bracing device as claimed in claim 2, wherein the supporting module has a connecting board being elongated-plate-shaped and having two sidewalls; and two supporting elements respectively abutting on the sidewalls of the connecting board.

29. The bracing device as claimed in claim 28, wherein each one of the connecting heads of each supporting element is one of flat-shaped, cross shaped, T-shaped or flat-shaped with a connecting notch.

30. The bracing device as claimed in claim 2, wherein the supporting module has a connecting board being elongated-plate-shaped and having two sidewalls; and two supporting elements respectively abutting on the sidewalls of the connecting board; and the restraining element has a positioning element mounted in and corresponding to each one of the at least one concave edge of each one of the supporting elements.

31. The bracing device as claimed in claim 30, wherein each positioning element has at least one viewing hole formed through the positioning element and aligning along at least one viewing hole of each one of the at least one of the restraining boards.

32. The bracing device as claimed in claim 1, wherein the supporting module has one supporting element.

33. The bracing device as claimed in claim 32, wherein each one of the connecting heads of the supporting element is one of flat-shaped, cross shaped, T-shaped or flat-shaped with a connecting notch.

34. The bracing device as claimed in claim 32, wherein the supporting module has one supporting element; and the restraining element has a positioning element mounted in each one of the at least one concave edge of the supporting element.

35. The bracing device as claimed in claim 1, wherein the supporting module has a connecting board being elongated-plate-shaped and having two sidewalls; and two supporting elements respectively abutting on the sidewalls of the connecting board.

36. The bracing device as claimed in claim 35, wherein each one of the connecting heads of each supporting element is one of flat-shaped, cross shaped, T-shaped or flat-shaped with a connecting notch.

* * * * *